US010077122B2

(12) United States Patent
Chou et al.

(10) Patent No.: US 10,077,122 B2
(45) Date of Patent: Sep. 18, 2018

(54) METHOD OF PACKAGING MULTI-MONODOSE CONTAINERS

(71) Applicant: Tokitae LLC, Bellevue, WA (US)

(72) Inventors: Fong-Li Chou, Bellevue, WA (US); Philip A. Eckhoff, Kirkland, WA (US); Lawrence Morgan Fowler, Kirkland, WA (US); Shieng Liu, Bellevue, WA (US); Krishnan Natarajan, Issaquah, WA (US); Nels R. Peterson, Bellevue, WA (US); Lowell L. Wood, Jr., Bellevue, WA (US)

(73) Assignee: Tokitae LLC, Bellevue, WA (US)

( * ) Notice: Subject to any disclaimer, the term of this patent is extended or adjusted under 35 U.S.C. 154(b) by 474 days.

(21) Appl. No.: 14/963,768

(22) Filed: Dec. 9, 2015

(65) Prior Publication Data

US 2016/0361233 A1 Dec. 15, 2016

Related U.S. Application Data

(63) Continuation-in-part of application No. 14/736,542, filed on Jun. 11, 2015.

(51) Int. Cl.
*B65B 3/00* (2006.01)
*A61J 1/16* (2006.01)
(Continued)

(52) U.S. Cl.
CPC ..... *B65B 3/006* (2013.01); *A61J 1/067* (2013.01); *A61J 1/16* (2013.01); *B65B 5/045* (2013.01);
(Continued)

(58) Field of Classification Search
CPC ..... B65B 3/003; B65B 3/006; B65B 5/045; B65B 5/067; B65B 9/023; B65B 9/042;
(Continued)

(56) References Cited

U.S. PATENT DOCUMENTS 1,971,863 A 8/1934 Lupton
1,998,147 A 4/1935 Stegman
(Continued)

FOREIGN PATENT DOCUMENTS

CN 204250524 U * 4/2015
DE 1536138 A1 * 10/1969 ..... B65D 75/42
(Continued)

OTHER PUBLICATIONS

"Advisory Committee on Immunization Practices (ACIP) Recommended Immunization Schedules for Persons Ages 0 through 18 Years and Adults Aged 19 Years and Older"; Centers for Disease Control and Prevention MMWR; Feb. 1, 2013; 21 pages; vol. 62; Office of Surveillance, Epidemiology, and Laboratory Services, Centers for Disease Control and Prevention (CDC), U.S. Department of Health and Human Services, Atlanta, GA.
(Continued)

*Primary Examiner* — Stephen F Gerrity

(57) ABSTRACT

Methods are described for packaging a foldable container including covering a multi-monodose container in an expanded configuration with a hermetically-sealable overwrap, the multi-monodose container including a row of interconnected monodose pharmaceutical vials, each of the monodose pharmaceutical vials enclosing at least one pharmaceutical agent, the interconnected monodose pharmaceutical vials connected to one another by one or more articulating joints sufficiently flexible to form a folded configuration of the multi-monodose container; exerting a force on at least one of the monodose pharmaceutical vials; bending the one or more articulating joints to form the folded configuration of the multi-monodose container in response to the exerted force; and sealing the hermetically-sealable overwrap to form a hermetic seal around the folded configuration of the multi-monodose container.

42 Claims, 32 Drawing Sheets

(51) Int. Cl.

| | |
|---|---|
| ***B65D 1/09*** | (2006.01) |
| ***B65D 75/42*** | (2006.01) |
| ***B65D 1/30*** | (2006.01) |
| ***B65B 31/06*** | (2006.01) |
| ***B65B 5/04*** | (2006.01) |
| ***A61J 1/06*** | (2006.01) |
| ***B65B 31/00*** | (2006.01) |
| ***B65B 63/04*** | (2006.01) |
| ***B65B 51/14*** | (2006.01) |
| ***B65B 5/06*** | (2006.01) |
| *A61J 1/14* | (2006.01) |

(52) U.S. Cl.

CPC ..... *B65B 5/067* (2013.01); *B65B 31/00* (2013.01); *B65B 31/06* (2013.01); *B65B 51/146* (2013.01); *B65B 63/04* (2013.01); *B65D 1/095* (2013.01); *B65D 1/30* (2013.01); *B65D 75/42* (2013.01); *A61J 1/1406* (2013.01); *A61J 2200/70* (2013.01); *A61J 2205/30* (2013.01); *B65B 2220/16* (2013.01)

(58) Field of Classification Search

CPC ..... B65B 31/043; B65B 31/048; B65B 31/06; B65B 61/24; B65B 2220/16; B65B 2220/22; B65D 1/095; B65D 1/30; B65D 75/42; A61J 1/06; A61J 1/067; A61J 1/16; Y10S 206/82

USPC ..... 53/432, 434, 436, 527; 206/427, 431, 206/436, 499, 526, 820; 220/23.8; 604/415

See application file for complete search history.

(56) References Cited

U.S. PATENT DOCUMENTS

| | | | | |
|---|---|---|---|---|
| 2,726,004 | A | 12/1955 | McLeod | |
| 2,934,867 | A * | 5/1960 | Vogt | B65B 9/042 206/499 |
| 3,164,934 | A * | 1/1965 | Pancratz | B65B 31/06 206/497 |
| 3,245,528 | A * | 4/1966 | Holley | B65D 75/44 206/499 |
| 3,325,860 | A | 6/1967 | Hansen | |
| 3,424,329 | A | 1/1969 | Hershberg et al. | |
| 3,498,450 | A | 3/1970 | Stevens | |
| 3,605,374 | A * | 9/1971 | Mueller et al. | B65B 9/042 206/484 |
| 3,785,545 | A | 1/1974 | Roussel | |
| 3,804,423 | A | 4/1974 | Booy | |
| 3,885,737 | A * | 5/1975 | Watkins | B65B 9/023 239/34 |
| 3,936,264 | A | 2/1976 | Cornett, III et al. | |
| 3,993,223 | A | 11/1976 | Welker, III et al. | |
| 4,098,120 | A | 7/1978 | Manske | |
| 4,319,701 | A | 3/1982 | Cambio | |
| 4,643,309 | A | 2/1987 | Evers | |
| 4,856,706 | A | 8/1989 | Van Der Straten | |
| 4,919,293 | A | 4/1990 | Buckley | |
| 5,085,802 | A | 2/1992 | Jalinkski | |
| 5,254,473 | A | 10/1993 | Patel | |
| 5,503,885 | A * | 4/1996 | Anderson | B29C 49/421 206/820 |
| 5,852,590 | A | 12/1998 | de la Huerga | |
| 5,984,168 | A | 11/1999 | Clark | |
| 6,234,333 | B1 * | 5/2001 | Federighi et al. | B65D 1/095 215/250 |
| 6,244,501 | B1 | 6/2001 | Choi | |
| 6,544,925 | B1 | 4/2003 | Prusik et al. | |
| 6,626,308 | B2 | 9/2003 | Weiler | |
| 6,951,898 | B2 | 10/2005 | Hammond et al. | |
| 8,074,801 | B2 | 12/2011 | Slayton et al. | |
| 8,501,100 | B2 | 8/2013 | Fukui | |
| 8,707,766 | B2 | 4/2014 | Harris et al. | |
| 2002/0148855 | A1 * | 10/2002 | Sokolsky et al. | B65D 75/5822 222/107 |
| 2003/0054073 | A1 * | 3/2003 | DelDuca et al. | B65B 31/06 426/124 |
| 2004/0094449 | A1 * | 5/2004 | Schmid | A61J 1/067 206/524.1 |
| 2005/0261659 | A1 | 11/2005 | Mizuo et al. | |
| 2006/0177610 | A1 * | 8/2006 | McAffer et al. | B65D 1/09 428/34.1 |
| 2009/0100802 | A1 | 4/2009 | Bush et al. | |
| 2010/0326933 | A1 | 12/2010 | Manuel et al. | |
| 2011/0081715 | A1 * | 4/2011 | Robinson et al. | C12M 23/08 435/304.1 |
| 2011/0315269 | A1 * | 12/2011 | Williamson et al. | A61M 5/1782 141/2 |
| 2013/0079301 | A1 * | 3/2013 | Szabocsik | A61K 31/728 206/438 |
| 2014/0346071 | A1 | 11/2014 | Genosar | |

FOREIGN PATENT DOCUMENTS

| | | | | |
|---|---|---|---|---|
| EP | 1 746 031 | A1 | 1/2007 | |
| FR | 2129213 | A5 * | 10/1972 | B65D 75/42 |
| GB | 471446 | A * | 9/1937 | A61J 1/06 |
| GB | 582666 | A * | 11/1946 | A61J 1/06 |
| JP | 2000-206652 | A | 7/2000 | |
| JP | 2000206652 | A * | 7/2000 | |
| KR | 20-1993-0003779 | Y1 | 6/1993 | |
| WO | WO 2014/145906 | A2 | 9/2014 | |

OTHER PUBLICATIONS

Cho et al.; "A 5.1-μW UHF RFID Tag chip integrated with Sensors for Wireless Environmental Monitoring"; Proceedings of ESSCIRC; accessed Aug. 20, 2015; pp. 279-282; IEEE.

Hopkins et al.; "Large-volume IM injections: A review of best practices"; Oncology Nurse Advisor; Jan./Feb. 2013; pp. 32-37.

Kamal El Deen et al.; "The Intelligent Colorimetric Timer Indicator Systems to develop label Packaging Industry in Egypt"; International Design Journal; accessed Aug. 20, 2015; pp. 295-304; vol. 4, Issue 2.

Kartoglu et al.; "Tools and approaches to ensure quality of vaccines throughout the cold chain"; Expert Rev. Vaccines; bearing a date of Apr. 7, 2015; pp. 843-854; vol. 13, Issue 7; Informa UK Ltd.

Mills, Andrew; "Oxygen indicators and intelligent inks for packaging food"; Chemical Society Reviews; bearing a date of Jun. 20, 2005; pp. 1003-1011; vol. 34; The Royal Society of Chemistry.

"Safety Considerations for Container Labels and Carton Labeling Design to Minimize Medication Errors"; Guidance for Industry; Apr. 2013; 26 pages; U.S. Department of Health and Human Services Food and Drug Administration Center for Drug Evaluation and Research (CDER).

"Vaccine Vial Monitor"; PQS performance specification; bearing a date of Jul. 26, 2011; pp. 1-10.

PCT International Search Report; International App. No. PCT/US2016/036151; Aug. 24, 2016; pp. 1-4.

PCT International Search Report; International App. No. PCT/US2016/065534; dated Mar. 30, 2017; pp. 1-4.

* cited by examiner

100

FIG. 11

110
covering a molded structure with a hermetically-sealable overwrap, the molded structure including a first portion and a second portion, the first portion including a row of interconnected monodose pharmaceutical vials, each of the interconnected monodose pharmaceutical vials enclosing a dose of at least one pharmaceutical agent, the second portion affixed to the first portion and including a textured surface pattern positioned to direct gas flow between the first portion and a region adjacent to the second portion 120
evacuating at least a portion of air from around the molded structure covered by the hermetically-sealable overwrap, the evacuated at least a portion of the air at least partially flowing over the textured surface pattern of the second portion of the molded structure 130
forming a hermetic seal around the row of interconnected monodose pharmaceutical vials by bonding the hermetically-sealable overwrap to at least a portion of a surface of the molded structure 1100 forming a gas-impermeable seal around the row of interconnected monodose pharmaceutical vials 1110 forming a vapor-impermeable seal around the row of interconnected monodose pharmaceutical vials 1120 forming a light-impermeable seal around the row of interconnected monodose pharmaceutical vials 1130 forming an electrostatic discharge-protective seal around the row of interconnected monodose pharmaceutical vials 1140 forming the hermetic seal around the row of interconnected monodose pharmaceutical vials under balanced or near-balanced pressure 1150 forming the hermetic seal around the row of interconnected monodose pharmaceutical vials under positive pressure 140
separating the second portion of the molded structure from the first portion of the molded structure

100

FIG. 12

110 covering a molded structure with a hermetically-sealable overwrap, the molded structure including a first portion and a second portion, the first portion including a row of interconnected monodose pharmaceutical vials, each of the interconnected monodose pharmaceutical vials enclosing a dose of at least one pharmaceutical agent, the second portion affixed to the first portion and including a textured surface pattern positioned to direct gas flow between the first portion and a region adjacent to the second portion 120 evacuating at least a portion of air from around the molded structure covered by the hermetically-sealable overwrap, the evacuated at least a portion of the air at least partially flowing over the textured surface pattern of the second portion of the molded structure 130 forming a hermetic seal around the row of interconnected monodose pharmaceutical vials by bonding the hermetically-sealable overwrap to at least a portion of a surface of the molded structure 1200 bonding the hermetically-sealable overwrap to a surface of the first portion of the molded structure proximal to the second portion of the molded structure 1210 bonding the hermetically-sealable overwrap to a surface of the first portion of the molded structure between each of the interconnected monodose pharmaceutical vials 1220 applying heat to bond the hermetically-sealable overwrap to the at least a portion of the surface of the molded structure 1230 applying pressure to bond the hermetically-sealable overwrap to the at least a portion of the surface of the molded structure 1240 chemically-bonding the hermetically-sealable overwrap to the at least a portion of the surface of the molded structure 1250 at least partially perforating the hermetically-sealable overwrap to add a frangible portion the hermetically-sealable overwrap between each of the interconnected monodose pharmaceutical vials 1260 applying at least one label having at least one sensor to an external surface of the hermetically-sealable overwrap 140 separating the second portion of the molded structure from the first portion of the molded structure

1300

FIG. 14

1310
covering a molded structure with a hermetically-sealable overwrap, the molded structure including a row of interconnected monodose pharmaceutical vials, each of the interconnected monodose pharmaceutical vials enclosing a dose of at least one pharmaceutical agent, and a textured surface pattern positioned to direct gas flow between a first portion of the molded structure and a region adjacent to a second portion of the molded structure 1400 inserting the molded structure into an opening defined by the hermetically-sealable overwrap 1410 positioning the molded structure between a first layer of hermetically-sealable overwrap and a second layer of hermetically-sealable overwrap; and sealing together one or more edges of the first layer and the second layer of the hermetically-sealable overwrap 1420 covering the molded structure with a hermetically-sealable pouch 1430 covering the molded structure with a hermetically-sealable sleeve 1440 covering the molded structure with a hermetically-sealable foil laminate 1450 covering the molded structure with a gas-impermeable overwrap 1460 covering the molded structure with a vapor-impermeable overwrap 1470 covering the molded structure with a light-impermeable overwrap 1480 covering the molded structure with an electrostatic discharge-protective overwrap 1320
evacuating at least a portion of air from around the molded structure covered by the hermetically-sealable overwrap, the evacuated at least a portion of the air at least partially flowing over the textured surface pattern on the molded structure 1330
forming a hermetic seal around the row of interconnected monodose pharmaceutical vials

1300

FIG. 18

1310 covering a molded structure with a hermetically-sealable overwrap, the molded structure including a row of interconnected monodose pharmaceutical vials, each of the interconnected monodose pharmaceutical vials enclosing a dose of at least one pharmaceutical agent, and a textured surface pattern positioned to direct gas flow between a first portion of the molded structure and a region adjacent to a second portion of the molded structure 1320 evacuating at least a portion of air from around the molded structure covered by the hermetically-sealable overwrap, the evacuated at least a portion of the air at least partially flowing over the textured surface pattern on the molded structure 1330 forming a hermetic seal around the row of interconnected monodose pharmaceutical vials 1800 forming a hermetic seal around the entirety of the molded structure including the row of interconnected monodose pharmaceutical vials 1810 bonding at least a portion of the hermetically-sealable overwrap to at least a portion of a surface of the molded structure 1820 bonding at least a portion of the hermetically-sealable overwrap to at least a portion of a surface of the molded structure around and between each of the interconnected monodose pharmaceutical vials 1830 applying heat to the hermetically-sealable overwrap to form the hermetic seal around the row of interconnected monodose pharmaceutical vials 1840 applying pressure to the hermetically-sealable overwrap to form the hermetic seal around the row of interconnected monodose pharmaceutical vials 1850 chemically-bonding the hermetically-sealable overwrap to form the hermetic seal around the row of interconnected monodose pharmaceutical vials 1860 separating the first portion of the molded structure from the second portion of the molded structure 1870 at least partially perforating the hermetically-sealable overwrap to add a frangible portion to the hermetically-sealable overwrap between each of the monodose pharmaceutical vials in the row of interconnected monodose pharmaceutical vials 1880 applying at least one label having at least one sensor to an external surface of the hermetically-sealable overwrap

FIG. 20

1900

1910
covering a multi-monodose container in an expanded configuration with a hermetically-sealable overwrap, the multi-monodose container including a row of interconnected monodose pharmaceutical vials, each of the monodose pharmaceutical vials enclosing a dose of at least one pharmaceutical agent; and one or more articulating joints connecting each of the monodose pharmaceutical vials in the row of interconnected monodose pharmaceutical vials to at least one adjacent monodose pharmaceutical vial, the one or more articulating joints sufficiently flexible to reversibly mate a planar outer surface of each of the monodose pharmaceutical vials with a planar outer surface of the at least one adjacent monodose pharmaceutical vial to form a folded configuration of the multi-monodose container 2000 inserting the multi-monodose container in an expanded configuration through an opening defined by the hermetically-sealable overwrap 2010 positioning the multi-monodose container in an expanded configuration between a first layer of hermetically-sealable overwrap and a second layer of hermetically-sealable overwrap; and sealing together one or more edges of the first layer and the second layer of the hermetically-sealable overwrap 2020 covering the multi-monodose container in an expanded configuration with a hermetically-sealable pouch 2030 covering the multi-monodose container in an expanded configuration with a hermetically-sealable sleeve 1920 exerting a force on at least one of the monodose pharmaceutical vials in the row of interconnected monodose pharmaceutical vials, the exerted force directed toward the at least one adjacent monodose pharmaceutical vial 1930 bending the one or more articulating joints to form the folded configuration of the multi-monodose container in response to exerting the force on the at least of the monodose pharmaceutical vials in the row of interconnected monodose pharmaceutical vials 1940 sealing the hermetically-sealable overwrap to form a hermetic seal around the folded configuration of the multi-monodose container therein

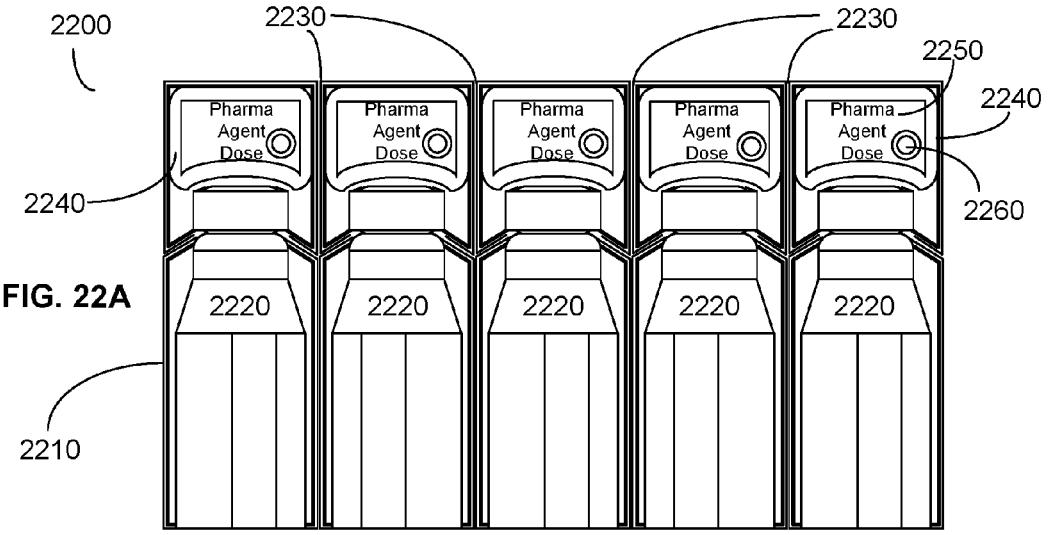
FIG. 22A
FIG. 22B
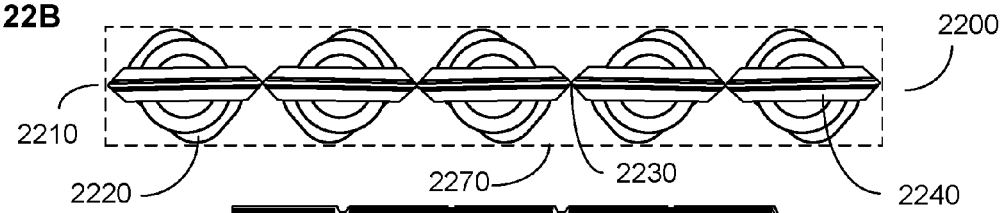
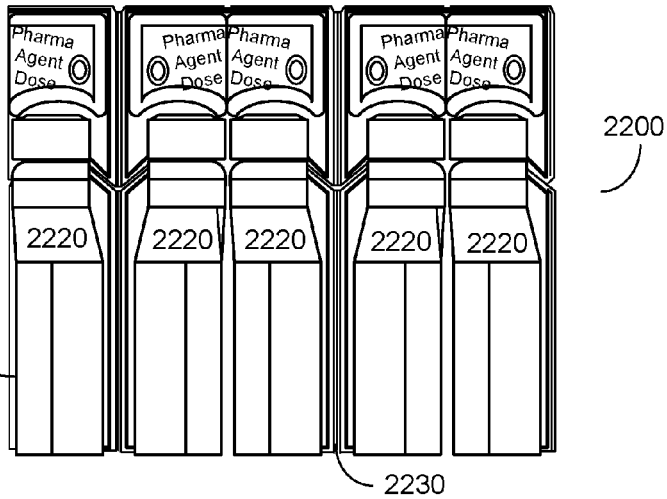
FIG. 22C
FIG. 22D
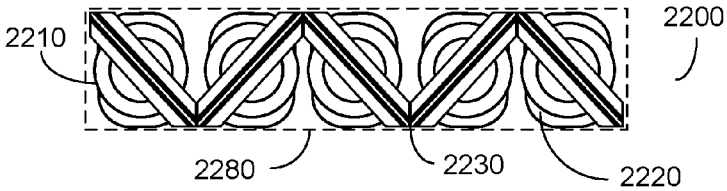
FIG. 22E
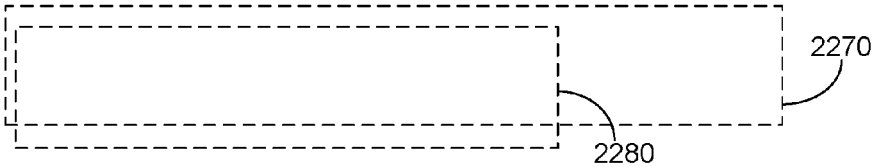

1900

FIG. 24

1910 covering a multi-monodose container in an expanded configuration with a hermetically-sealable overwrap, the multi-monodose container including a row of interconnected monodose pharmaceutical vials, each of the monodose pharmaceutical vials enclosing a dose of at least one pharmaceutical agent; and one or more articulating joints connecting each of the monodose pharmaceutical vials in the row of interconnected monodose pharmaceutical vials to at least one adjacent monodose pharmaceutical vial, the one or more articulating joints sufficiently flexible to reversibly mate a planar outer surface of each of the monodose pharmaceutical vials with a planar outer surface of the at least one adjacent monodose pharmaceutical vial to form a folded configuration of the multi-monodose container 1920 exerting a force on at least one of the monodose pharmaceutical vials in the row of interconnected monodose pharmaceutical vials, the exerted force directed toward the at least one adjacent monodose pharmaceutical vial 1930 bending the one or more articulating joints to form the folded configuration of the multi-monodose container in response to exerting the force on the at least of the monodose pharmaceutical vials in the row of interconnected monodose pharmaceutical vials 2400 evacuating at least a portion of air from around the folded configuration of the multi-monodose container covered by the hermetically-sealable overwrap 2410 inserting a flow conduit connected to a vacuum source into an opening defined by the hermetically-sealable overwrap; pressure sealing a portion of the hermetically-sealable overwrap around the inserted flow conduit to form a pocket around the folded configuration of the multi-monodose container; and evacuating the at least a portion of the air from the pocket around the folded configuration of the multi-monodose container 2420 injecting an inert gas around the folded configuration of the multi-monodose container covered by the hermetically-sealable overwrap; and evacuating at least a portion of the injected inert gas from around the folded configuration of the multi-monodose container covered by the hermetically-sealable overwrap 2430 injecting nitrogen around the folded configuration of the multi-monodose container covered by the hermetically-sealable overwrap 2440 injecting a noble gas around the folded configuration of the multi-monodose container covered by the hermetically-sealable overwrap 2450 inserting a flow conduit connected to a vacuum source into an opening defined by the hermetically-sealable overwrap; pressure sealing a portion of the hermetically-sealable overwrap around the inserted flow conduit to form a pocket around the folded configuration of the multi-monodose container; and evacuating the at least a portion of the injected inert gas from the pocket around the folded configuration of the multi-monodose container 2460 evacuating at least a portion air from around the folded configuration of the multi-monodose container covered by the hermetically-sealable overwrap prior to injecting the inert gas around the folded configuration of the multi-monodose container 1940 sealing the hermetically-sealable overwrap to form a hermetic seal around the folded configuration of the multi-monodose container therein

FIG. 25

1900

1910 covering a multi-monodose container in an expanded configuration with a hermetically-sealable overwrap, the multi-monodose container including a row of interconnected monodose pharmaceutical vials, each of the monodose pharmaceutical vials enclosing a dose of at least one pharmaceutical agent; and one or more articulating joints connecting each of the monodose pharmaceutical vials in the row of interconnected monodose pharmaceutical vials to at least one adjacent monodose pharmaceutical vial, the one or more articulating joints sufficiently flexible to reversibly mate a planar outer surface of each of the monodose pharmaceutical vials with a planar outer surface of the at least one adjacent monodose pharmaceutical vial to form a folded configuration of the multi-monodose container 1920 exerting a force on at least one of the monodose pharmaceutical vials in the row of interconnected monodose pharmaceutical vials, the exerted force directed toward the at least one adjacent monodose pharmaceutical vial 1930 bending the one or more articulating joints to form the folded configuration of the multi-monodose container in response to exerting the force on the at least of the monodose pharmaceutical vials in the row of interconnected monodose pharmaceutical vials 1940 sealing the hermetically-sealable overwrap to form a hermetic seal around the folded configuration of the multi-monodose container therein 2500 heat-sealing the hermetically-sealable overwrap to form the hermetic seal around the folded configuration of the multi-monodose container therein 2510 pressure-sealing the hermetically-sealable overwrap to form the hermetic seal around the folded configuration of the multi-monodose container therein 2520 chemically-sealing the hermetically-sealable overwrap to form the hermetic seal around the folded configuration of the multi-monodose container therein 2530 sealing at least a portion of the hermetically-sealable overwrap to form a pouch around the folded configuration of the multi-monodose container; injecting an inert gas into the formed pouch around the folded configuration of the multi-monodose container; evacuating at least a portion of the injected inert gas from the formed pouch around the folded configuration of the multi-monodose container; and sealing the formed pouch to form a hermetic seal around the folded configuration of the multi-monodose container therein 2540 attaching at least one label to an outer surface of the hermetically-sealable overwrap, the at least one label including at least one sensor 2550 attaching at least one label to an outer surface of the hermetically-sealable overwrap, the at least one label including at least one temperature sensor

FIG. 29

2800

2810 covering the multi-monodose container with a hermetically-sealable overwrap, the multi-monodose container including a row of interconnected monodose pharmaceutical vials, each of the monodose pharmaceutical vials enclosing a dose of at least one pharmaceutical agent; and one or more articulating joints connecting each of the monodose pharmaceutical vials in the row of interconnected monodose pharmaceutical vials to at least one adjacent monodose pharmaceutical vial, the one or more articulating joints sufficiently flexible to reversibly mate a planar outer surface of each of the monodose pharmaceutical vials with a planar outer surface of the at least one adjacent monodose pharmaceutical vial to form a folded configuration of the multi-monodose container 2900 inserting the multi-monodose container through an opening defined by the hermetically-sealable overwrap 2910 positioning the multi-monodose container between a first layer of hermetically-sealable overwrap and a second layer of hermetically-sealable overwrap; and sealing together one or more edges of the first layer and the second layer of the hermetically-sealable overwrap 2920 covering the multi-monodose container with a hermetically-sealable pouch 2930 covering the multi-monodose container with a hermetically-sealable sleeve 2940 covering the multi-monodose container with a hermetically-sealable foil laminate 2950 covering the multi-monodose container with a gas-impermeable overwrap 2960 covering the multi-monodose container with a vapor-impermeable overwrap 2970 covering the multi-monodose container with a light-impermeable overwrap 2980 covering the multi-monodose container with an electrostatic discharge-protective overwrap 2820 exerting a force on at least a portion of an external surface of the hermetically-sealable overwrap covering the multi-monodose container, the exerted force directed toward the one or more articulating joints of the multi-monodose container 2830 evacuating at least a portion of air from around the multi-monodose container covered by the hermetically-sealable overwrap 2840 sealing the hermetically-sealable overwrap covering the multi-monodose container to hermetically seal the multi-monodose container therein

2800

FIG. 30

2810 covering the multi-monodose container with a hermetically-sealable overwrap, the multi-monodose container including a row of interconnected monodose pharmaceutical vials, each of the monodose pharmaceutical vials enclosing a dose of at least one pharmaceutical agent; and one or more articulating joints connecting each of the monodose pharmaceutical vials in the row of interconnected monodose pharmaceutical vials to at least one adjacent monodose pharmaceutical vial, the one or more articulating joints sufficiently flexible to reversibly mate a planar outer surface of each of the monodose pharmaceutical vials with a planar outer surface of the at least one adjacent monodose pharmaceutical vial to form a folded configuration of the multi-monodose container 2820 exerting a force on at least a portion of an external surface of the hermetically-sealable overwrap covering the multi-monodose container, the exerted force directed toward the one or more articulating joints of the multi-monodose container 3000 exerting the force on the at least a portion of the external surface of the hermetically-sealable overwrap covering the multi-monodose container with one or more mechanical probes 3010 exerting the force on the at least a portion of the external surface of the hermetically-sealable overwrap covering the multi-monodose container with pressurized gas 2830 evacuating at least a portion of air from around the multi-monodose container covered by the hermetically-sealable overwrap 3020 inserting a flow conduit connected to a vacuum source into an opening defined by the hermetically-sealable overwrap covering the multi-monodose container; pressure sealing a portion of the hermetically-sealable overwrap around the inserted flow conduit to form a pocket around the multi-monodose container; and evacuating the at least a portion of the air from the pocket around the multi-monodose container 3030 injecting an inert gas around the multi-monodose container covered by the hermetically-sealable overwrap; and evacuating at least a portion of the injected inert gas from around the multi-monodose container covered by the hermetically-sealable overwrap 3040 injecting nitrogen around the multi-monodose container covered by the hermetically-sealable overwrap 3050 injecting a noble gas around the multi-monodose container covered by the hermetically-sealable overwrap 3060 evacuating the at least a portion the air from around the multi-monodose container covered by the hermetically-sealable overwrap prior to injecting the inert gas around the multi-monodose container 2840 sealing the hermetically-sealable overwrap covering the multi-monodose container to hermetically seal the multi-monodose container therein

FIG. 31

2800

2810 covering the multi-monodose container with a hermetically-sealable overwrap, the multi-monodose container including a row of interconnected monodose pharmaceutical vials, each of the monodose pharmaceutical vials enclosing a dose of at least one pharmaceutical agent; and one or more articulating joints connecting each of the monodose pharmaceutical vials in the row of interconnected monodose pharmaceutical vials to at least one adjacent monodose pharmaceutical vial, the one or more articulating joints sufficiently flexible to reversibly mate a planar outer surface of each of the monodose pharmaceutical vials with a planar outer surface of the at least one adjacent monodose pharmaceutical vial to form a folded configuration of the multi-monodose container 2820 exerting a force on at least a portion of an external surface of the hermetically-sealable overwrap covering the multi-monodose container, the exerted force directed toward the one or more articulating joints of the multi-monodose container 2830 evacuating at least a portion of air from around the multi-monodose container covered by the hermetically-sealable overwrap 2840 sealing the hermetically-sealable overwrap covering the multi-monodose container to hermetically seal the multi-monodose container therein 3100 sealing a first layer of hermetically-sealable overwrap to a second layer of hermetically-sealable overwrap to hermetically seal the multi-monodose container therein 3110 bonding at least a portion of the hermetically-sealable overwrap covering the multi-monodose container to at least a portion of a surface of the multi-monodose container to hermetically seal the multi-monodose container therein 3120 bonding at least a portion of the hermetically-sealable overwrap covering the multi-monodose container to at least a portion of a surface of the multi-monodose container associated with the one or more articulating joints to hermetically seal the multi-monodose container therein 3130 bonding at least a portion of the hermetically-sealable overwrap covering the multi-monodose container to at least a portion of a surface of the multi-monodose container around and between each of the monodose pharmaceutical vials in the row of interconnected monodose pharmaceutical vials 3140 heat-sealing the hermetically-sealable overwrap covering the multi-monodose container to hermetically seal the multi-monodose container therein 3150 pressure-sealing the hermetically-sealable overwrap covering the multi-monodose container to hermetically seal the multi-monodose container therein 3160 chemically-sealing the hermetically-sealable overwrap covering the multi-monodose container to hermetically seal the multi-monodose container therein

FIG. 32

2800

2810 covering the multi-monodose container with a hermetically-sealable overwrap, the multi-monodose container including a row of interconnected monodose pharmaceutical vials, each of the monodose pharmaceutical vials enclosing a dose of at least one pharmaceutical agent; and one or more articulating joints connecting each of the monodose pharmaceutical vials in the row of interconnected monodose pharmaceutical vials to at least one adjacent monodose pharmaceutical vial, the one or more articulating joints sufficiently flexible to reversibly mate a planar outer surface of each of the monodose pharmaceutical vials with a planar outer surface of the at least one adjacent monodose pharmaceutical vial to form a folded configuration of the multi-monodose container 2820 exerting a force on at least a portion of an external surface of the hermetically-sealable overwrap covering the multi-monodose container, the exerted force directed toward the one or more articulating joints of the multi-monodose container 2830 evacuating at least a portion of air from around the multi-monodose container covered by the hermetically-sealable overwrap 2840 sealing the hermetically-sealable overwrap covering the multi-monodose container to hermetically seal the multi-monodose container therein 3200 attaching at least one label to an outer surface of the hermetically-sealable overwrap, the at least one label including at least one sensor 3210 attaching at least one label to an outer surface of the hermetically-sealable overwrap, the at least one label including at least one temperature sensor 3220 bending the hermetically sealed multi-monodose container at the one or more articulating joints of the multi-monodose container to form a folded configuration; and adding a tertiary covering to maintain the hermetically sealed multi-monodose container in the folded configuration 3230 at least partially perforating the hermetically-sealable overwrap to add a frangible portion to the hermetically-sealable overwrap between each of the monodose pharmaceutical vials in the row of interconnected monodose pharmaceutical vials

METHOD OF PACKAGING MULTI-MONODOSE CONTAINERS

If an Application Data Sheet (ADS) has been filed on the filing date of this application, it is incorporated by reference herein. Any applications claimed on the ADS for priority under 35 U.S.C. §§ 119, 120, 121, or 365(c), and any and all parent, grandparent, great-grandparent, etc. applications of such applications, are also incorporated by reference, including any priority claims made in those applications and any material incorporated by reference, to the extent such subject matter is not inconsistent herewith.

CROSS-REFERENCE TO RELATED APPLICATIONS

The present application claims the benefit of the earliest available effective filing date(s) from the following listed application(s) (the "Priority Applications"), if any, listed below (e.g., claims earliest available priority dates for other than provisional patent applications or claims benefits under 35 USC § 119(e) for provisional patent applications, for any and all parent, grandparent, great-grandparent, etc. applications of the Priority Application(s)).

PRIORITY APPLICATIONS

The present application constitutes a continuation-in-part of U.S. patent application Ser. No. 14/736,542, entitled MULTI-MONODOSE CONTAINERS, naming Fong-Li Chou; Philip A. Eckhoff; Lawrence Morgan Fowler; Shieng Liu; Krishnan Natarajan; Nels R. Peterson; Lowell L. Wood, Jr. as inventors, filed 11 Jun. 2015, which is currently co-pending or is an application of which a currently co-pending application is entitled to the benefit of the filing date.

If the listings of applications provided above are inconsistent with the listings provided via an ADS, it is the intent of the Applicant to claim priority to each application that appears in the Domestic Benefit/National Stage Information section of the ADS and to each application that appears in the Priority Applications section of this application.

All subject matter of the Priority Applications and of any and all applications related to the Priority Applications by priority claims (directly or indirectly), including any priority claims made and subject matter incorporated by reference therein as of the filing date of the instant application, is incorporated herein by reference to the extent such subject matter is not inconsistent herewith.

SUMMARY

In an aspect, a method of packaging a multi-monodose container includes, but is not limited to, covering a molded structure with a hermetically-sealable overwrap, the molded structure including a first portion and a second portion, the first portion including a row of interconnected monodose pharmaceutical vials, each of the interconnected monodose pharmaceutical vials enclosing a dose of at least one pharmaceutical agent; the second portion affixed to the first portion and including a textured surface pattern positioned to direct gas flow between the first portion and a region adjacent to the second portion; evacuating at least a portion of air from around the molded structure covered by the hermetically-sealable overwrap, the evacuated at least a portion of the air at least partially flowing over the textured surface pattern of the second portion of the molded structure; forming a hermetic seal around the row of interconnected monodose pharmaceutical vials by bonding the hermetically-sealable overwrap to at least a portion of the molded structure; and separating the second portion of the molded structure from the first portion of the molded structure. In addition to the foregoing, other method aspects are described in the claims, drawings, and text forming a part of the present disclosure.

In an aspect, a method of packaging a multi-monodose container includes, but is not limited to, covering a molded structure with a hermetically-sealable overwrap, the molded structure including a row of interconnected monodose pharmaceutical vials, each of the interconnected monodose pharmaceutical vials enclosing a dose of at least one pharmaceutical agent, and a textured surface pattern positioned to direct gas flow between a first portion of the molded structure and a region adjacent to a second portion of the molded structure; evacuating at least a portion of air from around the molded structure covered by the hermetically-sealable overwrap, the evacuated at least a portion of the air at least partially flowing over the textured surface pattern on the molded structure; and forming a hermetic seal around the row of interconnected monodose pharmaceutical vials. In addition to the foregoing, other method aspects are described in the claims, drawings, and text forming a part of the present disclosure.

In an aspect, a multi-monodose container includes, but is not limited to, a molded structure including a first portion and a second portion, the first portion including a row of interconnected monodose pharmaceutical vials, each of the interconnected monodose pharmaceutical vials having an internal volume configured to hold a dose of at least one pharmaceutical agent; and the second portion affixed to the first portion, the second portion including a textured surface pattern positioned to direct gas flow between the first portion and a region adjacent to the second portion. In addition to the foregoing, other multi-monodose container aspects are described in the claims, drawings, and text forming a part of the present disclosure.

In an aspect, a multi-monodose container includes, but is not limited to, a molded structure including a row of interconnected monodose pharmaceutical vials, each of the interconnected monodose pharmaceutical vials having an internal volume configured to hold a dose of at least one pharmaceutical agent; and a textured surface pattern positioned to direct gas flow between a first portion of the molded structure and a region adjacent to a second portion of the molded structure. In addition to the foregoing, other multi-monodose container aspects are described in the claims, drawings, and text forming a part of the present disclosure.

In an aspect, a method of packaging a foldable container includes, but is not limited to, covering a multi-monodose container in an expanded configuration with a hermetically-sealable overwrap, the multi-monodose container including a row of interconnected monodose pharmaceutical vials, each of the monodose pharmaceutical vials enclosing a dose of at least one pharmaceutical agent, and one or more articulating joints connecting each of the monodose pharmaceutical vials in the row of interconnected monodose pharmaceutical vials to at least one adjacent monodose pharmaceutical vial, the one or more articulating joints sufficiently flexible to reversibly mate a planar outer surface of each of the monodose pharmaceutical vials with a planar outer surface of the at least one adjacent monodose pharmaceutical vial to form a folded configuration of the multi-monodose container; exerting a force on at least one of the monodose pharmaceutical vials in the row of interconnected monodose pharmaceutical vials, the exerted force directed toward the at least one adjacent monodose pharmaceutical vial; bending the one or more articulating joints to form the folded configuration of the multi-monodose container in response to exerting the force on the at least one of the monodose pharmaceutical vials in the row of interconnected monodose pharmaceutical vials; and sealing the hermetically-sealable overwrap to form a hermetic seal around the folded configuration of multi-monodose container therein. In addition to the foregoing, other method aspects are described in the claims, drawings, and text forming a part of the present disclosure.

In an aspect, a method of packaging a multi-monodose container includes, but is not limited to, covering the multi-monodose container with a hermetically-sealable overwrap, the multi-monodose container including a row of interconnected monodose pharmaceutical vials, each of the monodose pharmaceutical vials enclosing a dose of at least one pharmaceutical agent; and one or more articulating joints connecting each of the monodose pharmaceutical vials in the row of interconnected monodose pharmaceutical vials to at least one adjacent monodose pharmaceutical vial, the one or more articulating joints sufficiently flexible to reversibly mate a planar outer surface of each of the monodose pharmaceutical vials with a planar outer surface of the at least one adjacent monodose pharmaceutical vial to form a folded configuration of the multi-monodose container; exerting a force on at least a portion of an external surface of the hermetically-sealable overwrap covering the multi-monodose container, the exerted force directed toward the one or more articulating joints of the multi-monodose container; evacuating at least a portion of air from around the multi-monodose container covered by the hermetically-sealable overwrap; and sealing the hermetically-sealable overwrap covering the multi-monodose container to hermetically seal the multi-monodose container therein. In addition to the foregoing, other method aspects are described in the claims, drawings, and text forming a part of the present disclosure.

The foregoing summary is illustrative only and is not intended to be in any way limiting. In addition to the illustrative aspects, embodiments, and features described above, further aspects, embodiments, and features will become apparent by reference to the drawings and the following detailed description.

BRIEF DESCRIPTION OF THE FIGURES

FIG. 11 illustrates aspects of a method of packaging a multi-monodose container such as depicted in FIG. 1.

FIG. 12 depicts aspects of a method of packaging a multi-monodose container such as shown in FIG. 1.

FIG. 14 shows aspects of a method of packaging a multi-monodose container such as illustrated in FIG. 13.

FIG. 18 illustrates aspects of a method of packaging a multi-monodose container such as depicted in FIG. 13.

FIG. 20 shows aspects of a method of packaging a multi-monodose container such as illustrated in FIG. 19.

FIG. 22A is a side view of an embodiment of a multi-monodose container in an elongated configuration.

FIG. 22B is a top-down view of an embodiment of a multi-monodose container in an elongated configuration.

FIG. 22C is a side view of an embodiment of a multi-monodose container in a folded configuration.

FIG. 22D is a top-down view of an embodiment of a multi-monodose container in an elongated configuration.

FIG. 22E illustrates overlap of the rectangular packing cross-sectional areas of the elongated and folded configurations of a multi-monodose container.

FIG. 24 shows aspects of a method of packaging a multi-monodose container such as illustrated in FIG. 19.

FIG. 25 illustrates aspects of a method of packaging a multi-monodose container such as shown in FIG. 19.

FIG. 29 shows aspects of a method of packaging a multi-monodose container such as illustrated in FIG. 28.

FIG. 30 illustrates aspects of a method of packaging a multi-monodose container such as depicted in FIG. 28.

FIG. 31 depicts aspects of a method of packaging a multi-monodose container such as shown in FIG. 28.

FIG. 32 shows aspects of a method of packaging a multi-monodose container such as illustrated in FIG. 28.

DETAILED DESCRIPTION

Figure 1:
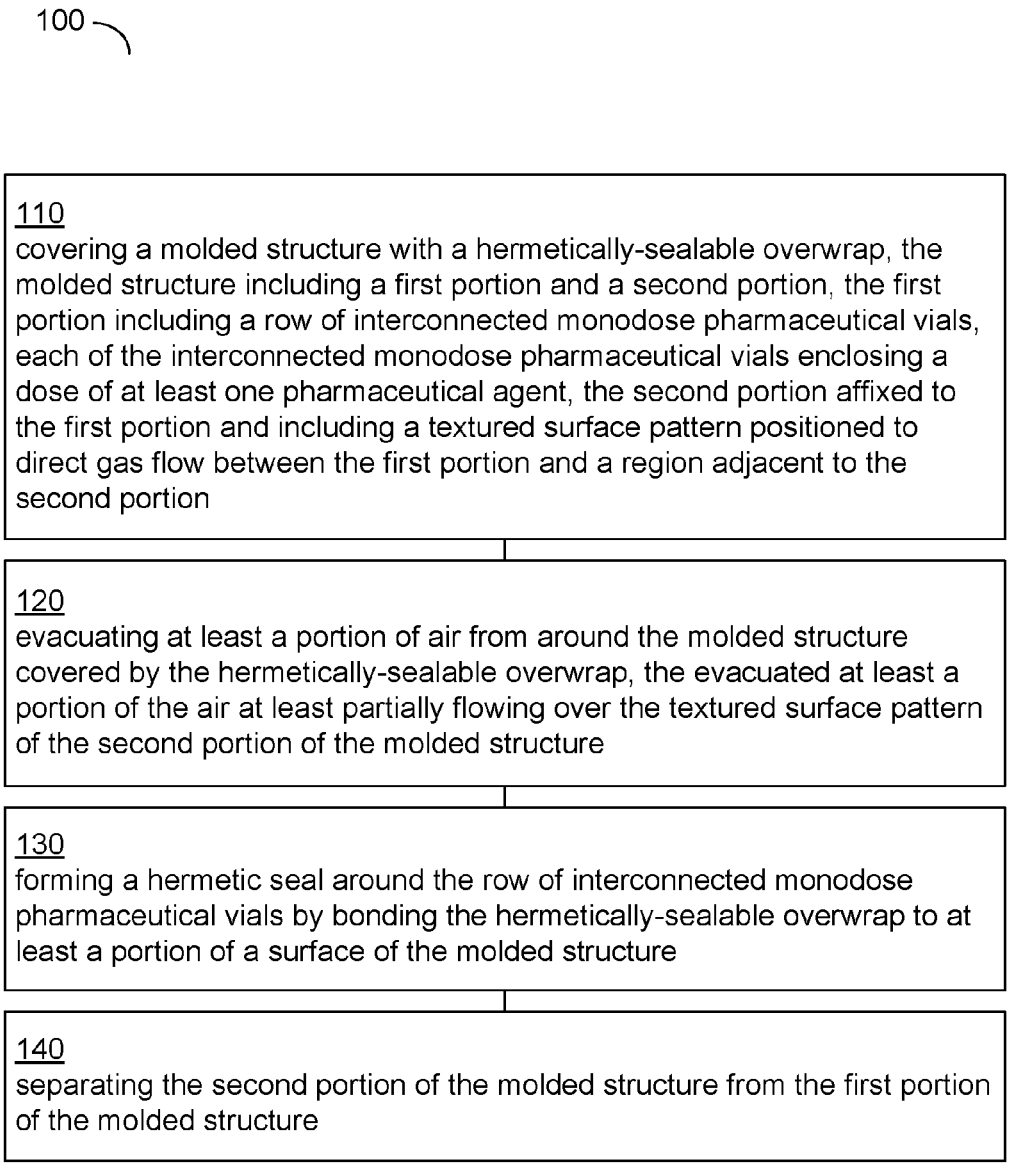
FIG. 1 is a block diagram showing a method of packaging a multi-monodose container.

In the following detailed description, reference is made to the accompanying drawings, which form a part hereof. In the drawings, similar symbols typically identify similar components, unless context dictates otherwise. The illustrative embodiments described in the detailed description, drawings, and claims are not meant to be limiting. Other embodiments may be utilized, and other changes may be made, without departing from the spirit or scope of the subject matter presented here.

Described herein are devices and methods for packaging multi-monodose containers. In an aspect, a multi-monodose container includes a molded structure including a row of interconnected monodose pharmaceutical vials and a textured surface pattern positioned to direct gas flow between a first portion of the molded structure and a region adjacent to a second portion of the molded structure. In an aspect, each of the monodose pharmaceutical vials in the row of interconnected monodose pharmaceutical vials is connected to at least one adjacent monodose pharmaceutical vial through one or more articulating joints. Each of the monodose pharmaceutical vials in the row of interconnected monodose pharmaceutical vials encloses a dose of at least one pharmaceutical agent, e.g., a vaccine or a therapeutic agent. The method of packaging the multi-monodose container includes hermetically-sealing the row of interconnected monodose containers in a hermetically-sealable overwrap. The textured surface pattern on the molded structure is configured to aid in drawing out or evacuating air and/or inert gas from the hermetically-sealable overwrap during the process of hermetically sealing the row of interconnected monodose pharmaceutical vials therein.

With reference to FIG. 1, shown is an embodiment of a method of packaging a multi-monodose container which can serve as a context for one or more methods and/or devices described herein. FIG. 1 shows a block diagram of a method 100 of packaging a multi-monodose container. Method 100 includes in block 110 covering a molded structure with a hermetically-sealable overwrap, the molded structure including a first portion and a second portion, the first portion including a row of interconnected monodose pharmaceutical vials, each of the interconnected monodose pharmaceutical vials enclosing a dose of at least one pharmaceutical agent, the second portion affixed to the first portion and including a textured surface pattern positioned to direct gas flow between the first portion and a region adjacent to the second portion. Method 100 includes in block 120 evacuating at least a portion of air from around the molded structure covered by the hermetically-sealable overwrap, the evacuated at least a portion of the air at least partially flowing over the textured surface pattern of the second portion of the molded structure. Method 100 includes in block 130 forming a hermetic seal around the row of interconnected monodose pharmaceutical vials by bonding the hermetically-sealable overwrap to at least a portion of a surface of the molded structure. Method 100 includes in block 140 separating the second portion of the molded structure from the first portion of the molded structure.

In an aspect, method 100 is performed with one or more pieces of machinery to package the multi-monodose container. In an aspect, method 100 is performed by one or more pieces of machinery acting in tandem to package the multi-monodose container. For example, the method can include use of machinery for covering the molded structure of the monodose pharmaceutical vial, evacuating at least a portion, forming a seal, and separating the first portion of the molded structure from the second portion of the molded structure. In an aspect, method 100 is performed automatically by one or more pieces of machinery. In an aspect, method 100 is performed in tandem with forming the multi-monodose container, e.g., in tandem with forming the molded structure, filling each of the interconnected monodose pharmaceutical vials with a dose of at least one pharmaceutical agent, and sealing the interconnected monodose pharmaceutical vials.

Method 100 of packaging a multi-monodose container includes covering a molded structure with a hermetically-sealable overwrap. In some embodiments, the method includes covering the entirety of the molded structure. For example, the method can include covering the molded structure with a hermetically-sealable pouch sized to accommodate the entirety of the molded structure. In some embodiments, the method includes covering at least a portion of the molded structure. For example, the method can include covering the entire first portion of the molded structure including the row of interconnected monodose pharmaceutical vials and at least a part of the second portion of the molded structure with the hermetically-sealable overwrap. For example, at least a part of the second portion of the molded structure may extend out beyond an opening or edge defined by the hermetically-sealable overwrap. In an aspect, covering the molded structure with a hermetically-sealable overwrap includes conveying at least one of the molded structure and the hermetically-sealable overwrap using conveying machinery. For example, the method can include moving the molded structure to be covered by the hermetically-sealable overwrap, moving the hermetically-sealable overwrap to cover the molded structure, or a combination thereof.

Figure 2:
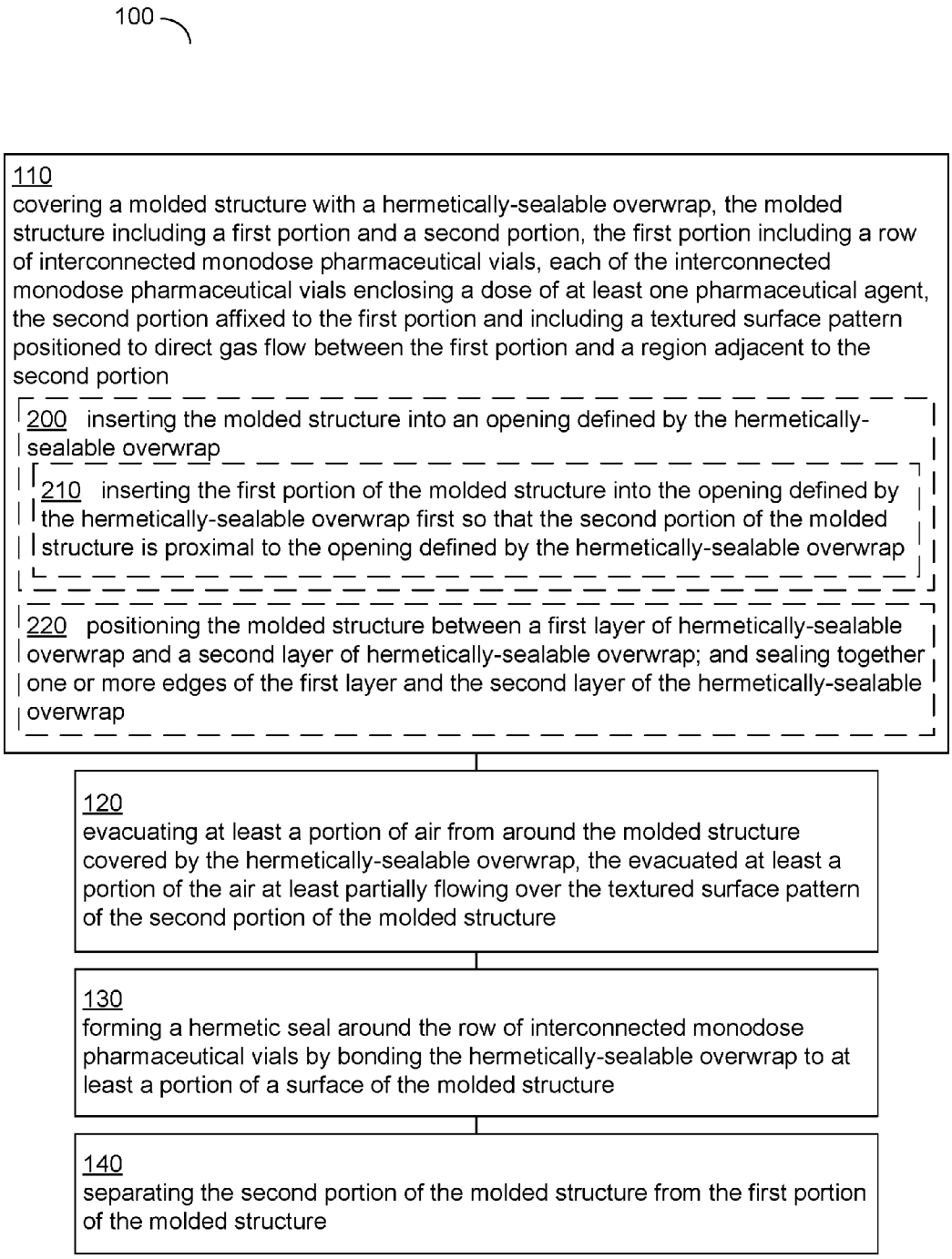
FIG. 2 shows aspects of a method of packaging a multi-monodose container such as illustrated in FIG. 1.

FIG. 2 shows a block diagram illustrating further aspects of a method 100 of packaging a multi-monodose container. In some embodiments, method 100 includes inserting the molded structure into an opening defined by the hermetically-sealable overwrap, as shown in block 200. For example, the method can include inserting the molded structure forming the multi-monodose container through an opening of a hermetically-sealable pouch, bag, or sleeve. In some embodiments, method 100 includes inserting the first portion of the molded structure into the opening defined by the hermetically-sealable overwrap first so that the second portion of the molded structure is proximal to the opening defined by the hermetically-sealable overwrap, as shown in block 210. For example, the molded structure can be inserted through an opening defined by the hermetically-sealable overwrap in a specific orientation such that the second portion of the molded structure including the textured surface pattern is closest to the opening through which air or inert gas will be injected and/or evacuated.

In an embodiment, method 100 of packaging a multi-monodose container includes positioning the molded structure between a first layer of hermetically-sealable overwrap and a second layer of hermetically-sealable overwrap; and sealing together one or more edges of the first layer and the second layer of the hermetically-sealable overwrap, as shown in block 220. For example, the method can include using horizontal flow machinery with a conveyor to position the multi-monodose container between a first and second layer of hermetically-sealable overwrap, e.g., roller sheets of hermetically-sealable overwrap. Machinery for covering a container with an overwrap is commercially available (from, e.g., Bosch Packaging Technology, Waiblingen, Germany).

Figure 3:
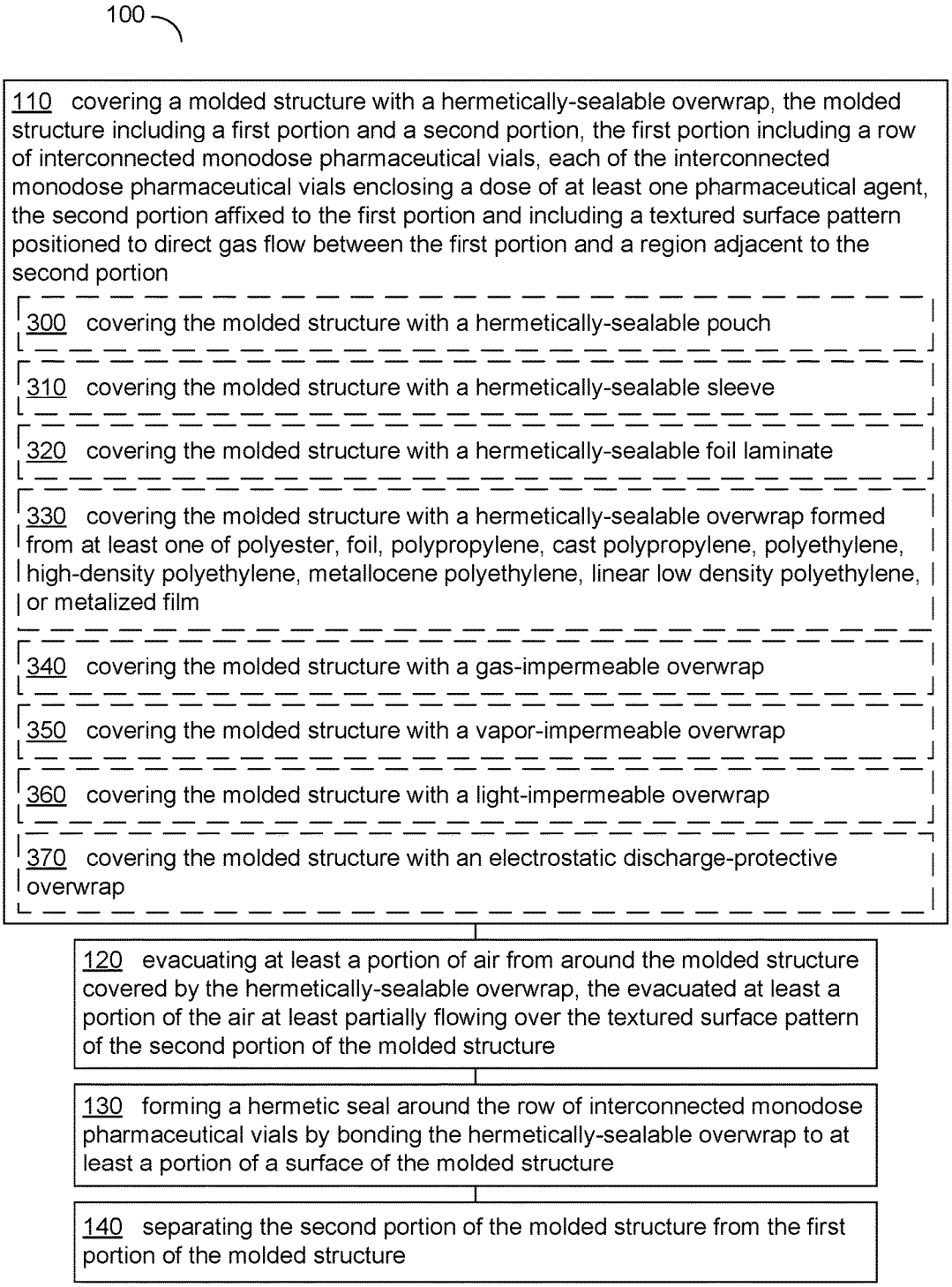
FIG. 3 illustrates aspects of a method of packaging a multi-monodose container such as depicted in FIG. 1.

FIG. 3 is a block diagram showing further aspects of a method of packaging a multi-monodose container. Method 100 of packaging a multi-monodose container includes covering a molded structure with a hermetically-sealable overwrap. In an aspect, method 100 includes covering the molded structure with a hermetically-sealable pouch, as shown in block 300. For example, the hermetically-sealable overwrap can include a medical-grade heat-sealable foil pouch (from, e.g., Bemis Healthcare Packaging, Oshkosk, Wis.; Oliver-Tolas, Healthcare Packaging, Grand Rapids, Mich.). In an aspect, method 100 includes covering the molded structure with a hermetically-sealable sleeve, as shown in block 310. For example, the hermetically-sealable overwrap can include a medical-grade heat-sealable overwrap in a tubular form (from, e.g., Bemis Healthcare Packaging, Oshkosk, Wis.).

In an aspect, a method 100 of packaging a multi-monodose container includes covering the molded structure with a hermetically-sealable foil laminate, as shown in block 320. For example, the method can include covering the molded structure with a hermetically-sealable polyester/foil/polyethylene laminate. Other non-limiting examples of foil laminates include polyester/foil/nylon/polyethylene laminates and coated paper/foil/polyethylene laminates. In an aspect, the method includes covering the molded structure with a hermetically-sealable metalized laminate. For example, the method can include covering the molded structure with a hermetically-sealable polymer film (e.g., polyethylene terephthalate (PET)) metalized or coated with a thin layer of aluminum, nickel, and/or chromium.

In an aspect, method 100 includes in block 330 covering the molded structure with a hermetically-sealable overwrap formed from at least one of polyester, foil, polypropylene, cast polypropylene, polyethylene, high-density polyethylene, metallocene polyethylene, linear low density polyethylene, or metalized film. In an aspect, method 100 includes covering the molded structure with a laminate including at least one of polyester, foil, polypropylene, cast polypropylene, polyethylene, high-density polyethylene, metallocene polyethylene, linear low density polyethylene, or metalized film. For example, the method can include covering the molded structure with a metalized polyester/polyethylene laminate.

In an aspect, method 100 of packaging a multi-monodose container includes covering the molded structure with a gas-impermeable overwrap, as shown in block 340. For example, the method can include covering the molded structure with an oxygen-impermeable overwrap configured to prevent oxygen from contacting the hermetically-sealed multi-monodose container. For example, the method can include covering the molded structure with an inert gas-impermeable overwrap configured to retain an inert gas environment (e.g., a nitrogen-rich environment) within the sealed overwrap.

In an aspect, method 100 of packaging a multi-monodose container includes covering the molded structure with a vapor-impermeable overwrap, as shown in block 350. For example, the method can include covering the molded structure of the multi-monodose container with a laminate configured to create a vapor or moisture barrier (e.g., a polyester/foil/polyethylene laminate, a polyester/metalized polyethylene laminate, or a coated paper/foil/polyethylene laminate).

In an aspect, method 100 of packaging a multi-monodose container includes covering the molded structure with a light-impermeable overwrap, as shown in block 360. For example, the method can include covering the molded structure of the multi-monodose container with a hermetically-sealable overwrap that is non-transparent and configured to create a light barrier (e.g., a foil laminate). In an aspect, the light-impermeable overwrap is impermeable to ultraviolet, visible light, and/or near infrared radiation.

In an aspect, method 100 of packaging a multi-monodose container includes covering the molded structure with an electrostatic discharge-protective overwrap, as shown in block 370. For example, the method can include covering the molded structure of the multi-monodose container with a hermetically-sealable overwrap with antistatic properties (e.g., a polyester/aluminum foil/antistatic low density polyethylene laminate).

Hermetically-sealable overwraps with moisture/vapor barrier, light barrier, gas barrier and/or electrostatic discharge barrier for use in the methods described herein in the form of bags, pouches, sleeves, or layers (e.g., sheets) are commercially available (from, e.g., Bemis Company, Inc., Oshkosh, Wis.; Pall Corporation, Port Washington, N.Y.).

In some embodiments, a multi-monodose container includes a molded structure including a first portion and a second portion, the first portion including a row of interconnected monodose pharmaceutical vials, each of the interconnected monodose pharmaceutical vials enclosing a dose of at least one pharmaceutical agent, and the second portion affixed to the first portion, the second portion including a textured surface pattern positioned to direct gas flow between the first portion and a region adjacent to the second portion.

In some embodiments, a multi-monodose container includes a molded structure including a first portion and a second portion, the first portion including a row of interconnected monodose pharmaceutical vials, each of the interconnected monodose pharmaceutical vials having an internal volume configured to hold a dose of at least one pharmaceutical agent; and the second portion affixed to the first portion, the second portion including a textured surface pattern positioned to direct gas flow between the first portion and a region adjacent to the second portion.

Figure 4:
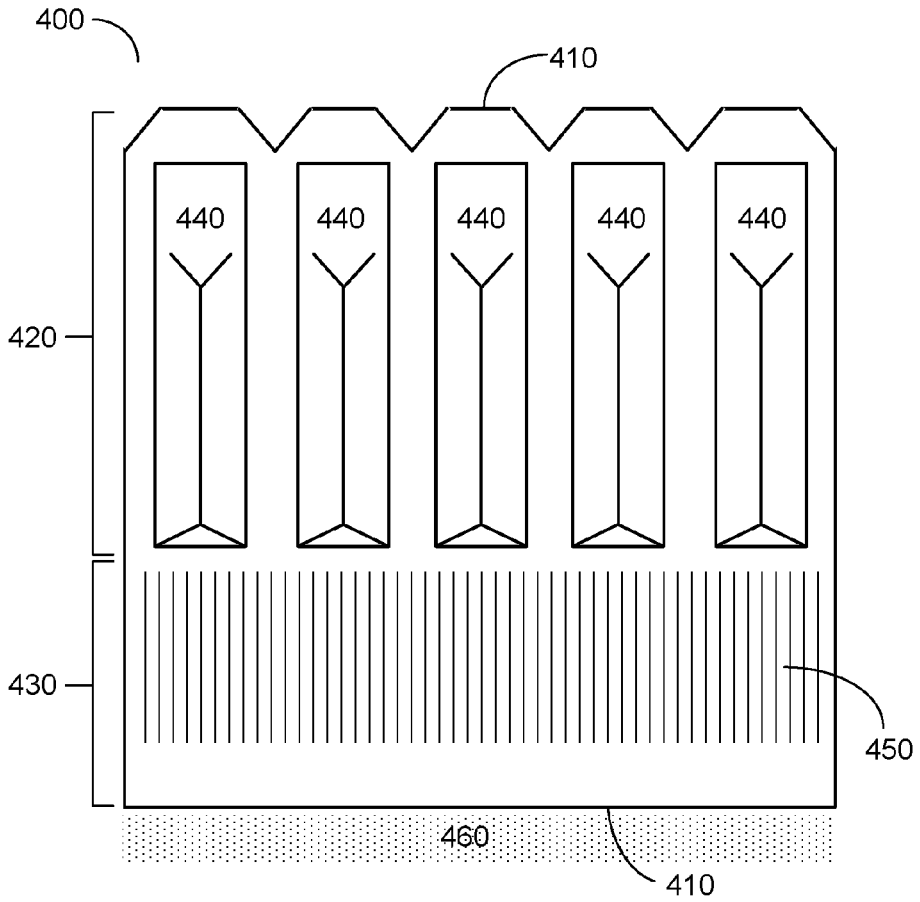
FIG. 4 is a schematic of an embodiment of a multi-monodose container including a molded structure with a row of interconnected monodose pharmaceutical vials and a textured surface pattern.

FIG. 4 shows a schematic of a non-limiting example of a multi-monodose container for use in a method of packaging a multi-monodose container such as described in FIG. 1. In this non-limiting example, multi-monodose container 400 includes a molded structure 410 including a first portion 420 and a second portion 430. First portion 420 includes a row of interconnected monodose pharmaceutical vials 440, each of which encloses a dose of at least one pharmaceutical agent. Second portion 430 is affixed to the first portion 420 and includes a textured surface pattern 450 (shown in this non-limiting example as a series of parallel lines) positioned to direct gas flow between the first portion 420 and a region 460 (stippled pattern) adjacent to the second portion 430. In this non-limiting example, the region 460 adjacent to the second portion 430 is space adjacent to an edge of the second portion 430. The textured surface pattern 450 on the molded structure 410 is configured to aid in drawing out or evacuating air and/or an inert gas during a process of hermetically sealing the multi-monodose container 400 in the hermetically-sealable overwrap.

In an aspect, the molded structure of the multi-monodose container such as described herein is formed using a molding manufacturing process. For example, the first portion of the molded structure including the row of interconnected monodose pharmaceutical vials and the second portion of the molded structure including the textured surface pattern can be formed by a blow molding manufacturing process. For example, the first portion of the molded structure including the row of interconnected monodose pharmaceutical vials and the second portion of the molded structure including the textured surface pattern can be formed by an injection molding manufacturing process. In an aspect, the molded structure including the first portion and the second portion is formed by a blow-fill-seal manufacturing process. For example, the first portion of the molded structure including the row of interconnected monodose pharmaceutical vials and the second portion of the molded structure including the textured surface pattern can be formed by a blow-fill-seal manufacturing process.

In an aspect, the molded structure including the first portion and the second portion is formed by a blow molding manufacturing process. See, e.g., U.S. Pat. No. 3,325,860 to Hansen titled "Molding and Sealing Machines," U.S. Pat. No. 3,936,264 to Cornett & Gaspar titled "Apparatus for Blow Molding a Container with Breachable Sealing Members," which is incorporated herein by reference. In an aspect, the blow molding manufacturing process includes at least the steps of melting a plastic resin, forming a hollow tube (parison) of molten plastic resin, clamping two halves of a mold around the hollow tube and holding it closed, expanding the parison into the mold cavity with compressed air by allowing the parison to take up the shape of mold cavity, and exhausting the air from the mold part and cooling the plastic resin. For example, pharmaceutical-grade plastic resin, e.g., polyethylene and/or polypropylene, can be heat extruded (vertically heat extruded) or injection molded to form a hanging vertical tube or hollow cylinder (parison). For example, granules of polyethylene and/or polypropylene can be fed into an extruder and melted at temperatures above 160 degrees centigrade. The extruded parison is enclosed by a two-part mold, sealing the lower end of the parison. The extruded parison is cut above the mold. The formed molded structure is allowed to cool and removed from the mold.

In an aspect, the molded structure including the first portion and the second portion is formed by a blow-fill-seal manufacturing process. For example, the multi-monodose container including the dose of at least one pharmaceutical agent can be formed by an aseptic process in which the molded structure is formed, filled with the at least one pharmaceutical agent, and sealed in an uninterrupted sequence of operations in a sterile environment. For example, the molded structure including the first portion and the second portion can be formed using a highly automated blow-fill-seal or form-fill-seal manufacturing process. For example, a multi-monodose container can be generated by 1) forming the molded structure including the first portion with the row of interconnected monodose pharmaceutical vials and the second portion with the textured surface pattern having flow-directing properties, 2) filling each of the interconnected monodose pharmaceutical vials with a dose of at least one pharmaceutical agent, and 3) sealing each of the interconnected monodose pharmaceutical vials to enclose the dose of the at least one pharmaceutical agent therein. For example, a multi-monodose container may be formed, filled with at least one pharmaceutical agent, and sealed using a process that includes at least the following steps: an aseptic solution including the at least one pharmaceutic agent is delivered to the blow-fill-seal or form-fill-seal machine through a bacteria-retaining filter; sterile filtered compressed air and granules of a plastic material (e.g., polyethylene, polypropylene or polyethylene/polypropylene co-polymers) are supplied to the machine; the plastic granules are extruded downwards under pressure (e.g., up to 350 bar) as a hot hollow moldable plastic parison; two halves of a mold defining the outer surfaces of the molded structure of the multi-monodose container are closed around the parison to seal the base while the top of the parison is cut free by a hot knife-edge; the plastics material is formed into the multi-monodose container by vacuum and/or sterile air pressure; each of the interconnected monodose pharmaceutical vials are immediately filled with a metered volume of the solution including the at least one pharmaceutical agent; once the required volume is filled into each of the interconnected monodose pharmaceutical vials, the filling unit is raised and each of the interconnected monodose pharmaceutical vials is sealed automatically; the mold opens, releasing a multi-monodose container formed, filled and sealed in one continuous, automatic cycle. Machinery for use in a blow-fill-seal and/or form-fill-seal manufacturing process is available from commercial sources (from, e.g., Rommelag USA, Inc., Evergreen, Colo.; Weiler Engineering Inc., Elgin, Ill.).

In an aspect, the molded structure including the first portion and the second portion is formed by an injection molding manufacturing process. For example, the first portion of the molded structure including the row of interconnected monodose pharmaceutical vials and the second portion of the molded structure including the textured surface pattern can be formed from a resin, e.g., a thermoplastic material, which is forced into an appropriately shaped mold by an injection ram or screw. Pressure is maintained until the thermoplastic material has hardened sufficiently for removal of the mold and release of the formed molded structure.

In an aspect, a multi-monodose container including the molded structure is formed using one or more molds. In an aspect, the one or more molds are designed for blow mold manufacturing. For example, the mold can include two female parts which when closed form a cavity defining the outer surface of the molded structure of the multi-monodose container. In an aspect, the one or more molds are designed for injection mold manufacturing. For example, the mold can include a cavity into which a plastic polymer or resin is forced under pressure, the mold defining both the outer surface and the inner surface of the monodose pharmaceutical vials comprising the multi-monodose container. In an aspect, each of the one or more molds is formed from stainless steel or aluminum and is precision-machined to provide a mold for the external features and/or internal features of the molded structure of the multi-monodose container. Other non-limiting materials for use in forming molds for blow molding and/or infusion molding include beryllium, copper, aluminum, steel, chromium, nickel, stainless steel, and alloys thereof.

In an aspect, the molded structure of the multi-monodose container including the first portion and the second portion is formed from a biocompatible material. For example, the molded structure can be formed from a material that is safe for use and compatible with the contents of the monodose pharmaceutical vials, e.g., a pharmaceutical agent in a dry or liquid form. For example, the biocompatible material, e.g., a biocompatible polymer or resin, is sufficiently inert as to prevent release or leaching of substances from the biocompatible material into the contents of the monodose pharmaceutical vials in quantities sufficient to affect the stability and/or safety of the pharmaceutical agent enclosed therein. For example, the biocompatible material is of a type that does not significantly absorb components of a dosage form, e.g., a pharmaceutical agent in a dry or liquid formulation, and/or does not allow the components of the pharmaceutical agent to migrate through the biocompatible material. Non-limiting examples of biocompatible material include polyvinyl chloride, fluoropolymers, polyurethane, polycarbonate, silicone, acrylic, polypropylene, low density polypropylene, high density polypropylene, nylon, sulfone resins, thermoplastic elastomers, and thermoplastic polyesters.

In an aspect, the molded structure including the first portion and the second portion is formed from at least one thermoplastic material. For example, the molded structure of the multi-monodose container including the first portion with the row of interconnected monodose pharmaceutical vials and the second portion with the textured surface pattern can be formed from a heat pliable or moldable plastic polymer material using blow molding or infusion molding manufacturing processes. Non-limiting examples of thermoplastic materials include ethylene-vinyl acetate, cyclic olefin copolymers, ionomer, fluorine-containing polymers, polyurethane, polyethylene terephthalate (PET), polyethylene terephthalate G (PETG), acrylics, cellulosics, poly(methyl methacrylate), acrylonitrile butadiene styrene, nylon, polylactic acid, polybenzimidazole, polycarbonate, polyether sulfone, polyetherether ketone, polyetherimide, polyethylene, polyphenylene oxide, polyphenylene sulfide, polypropylene, polystyrene, polyvinyl chloride, and polytetrafluoroethylene.

In an aspect, the at least one thermoplastic material includes a form of polyethylene. For example, the thermoplastic material can include a low density (LDPE) or branched form of polyethylene. For example, the thermoplastic material can include a high density (HDPE) or linear form of polyethylene. For example, the thermoplastic material can include a linear low density polyethylene (LLDPE), combining the clarity and density of LDPE and the toughness of HDPE.

In an aspect, the at least one thermoplastic material includes a form of polypropylene. For example, the thermoplastic material can include a highly crystalline form of polypropylene. For example, the thermoplastic material can include an isotactic form of polypropylene having organic groups on the same side of the polymer chain. For example, the thermoplastic material can include a higher impact form of polypropylene, e.g., syndiotactic with alternating organic groups above and below the polymer chain, or atactic with no regular sequence of organic side chains. In an aspect, polypropylene is modified with polyethylene or rubber to improve impact resistance, lower stiffness, and improve clarity.

In an aspect, the molded structure including the first portion and the second portion is formed from at least one biocompatible thermoplastic material. Non-limiting examples of biocompatible thermoplastic materials include polyvinyl chloride, fluoropolymers, polyurethane, polycarbonate, acrylic, polypropylene, low density polypropylene, high density polypropylene, nylon, and sulfone resins. Additional non-limiting examples of biocompatible thermoplastic materials include thermoplastic polyolefin elastomer (TEO), styrene ethylene butylene styrene (SEBS), thermoplastic vulcanizate (TPV), thermoplastic polyurethane (TPU), copolymer thermoplastics (COPE), and polyether-block-amid (PEBA).

In an aspect, the molded structure of the multi-monodose container is formed from glass using a blow molding or injection molding manufacturing process. For example, molten glass can be formed into the molded structure using either a press-and-blow process or a blow-and-blow process. In both processes, the molten glass is pressed or blown into a parison and then blown into a mold defining the outer surface of the molded structure. In an aspect, the molded structure is formed from borosilicate glass. For example, the molded structure can be formed from Type I borosilicate glass.

In an aspect, the molded structure of the multi-monodose container is formed from a transparent material. For example, the molded structure of the multi-monodose container can be formed from a transparent material to permit a user to visualize the tip of a needle, e.g., a syringe needle, in a monodose pharmaceutical vial comprising a part of the multi-monodose container. For example, the molded structure of the multi-monodose container can be formed from a transparent material using a blow molding or an infusion molding manufacturing processes. In some embodiments, the transparent material includes glass. For example, the transparent material can include Type I borosilicate glass. In some embodiments, the transparent material includes a form of transparent thermoplastic material. For example, the transparent material can include a copolymer of vinyl acetate and ethylene. For example, the transparent material can include a low density form of polyethylene. For example, the transparent material can include polyvinyl chloride and in particular, unplasticized polyvinyl chloride. For example, the transparent material can include a cyclic olefin copolymer. See, e.g., U.S. Pat. No. 6,951,898 to Hammond and Heukelbach titled "Cycloolefin Copolymer Resins Having Improved Optical Properties," which is incorporated herein by reference.

In an aspect, a molded structure of the multi-monodose container is formed from an opaque material. For example, the molded structure of the multi-monodose container including the first portion and the second portion can be formed from an opaque plastic, e.g., polypropylene PP. In an aspect, the molded structure of the multi-monodose container is formed from a tinted material. For example, the molded structure of the multi-monodose container including the first portion and the second portion can be formed from a tinted material, e.g., amber-colored glass or thermoplastic, which limits that amount of light or ultraviolet radiation that can pass through the monodose pharmaceutical vials. For example, the molded structure of the multi-monodose container including the first portion and the second portion can be formed from an extruded thermoplastic material that includes dyes or pigments configured to impart color, e.g., an amber color, to the monodose pharmaceutical vials.

In an aspect, one or more additives are included in the material forming the molded structure of the multi-monodose container. For example, the one or more additives can include lubricants, stabilizers, antioxidants, plasticizers, antistatic agents, or slip agents. In an aspect, the process of forming the molded structure of the multi-monodose container includes the addition of one or more of a lubricant, a stabilizer, an antioxidant, a plasticizer, an antistatic agent, a slip agent, or a combination thereof. For example, a lubricant, e.g., zinc stearate, may be used during the molding or extrusion process to facilitate flow of the molten thermoplastic on the metal surfaces of the mold. For example, one or more stabilizers (e.g., organometallic compounds, fatty acid salts, and inorganic oxides) may be added to the thermoplastic to retard or prevent degradation of the polymer by heat, light, and/or ultraviolet exposure during the manufacturing process as well as to improve the aging characteristics of the thermoplastic. For example, one or more anti-oxidants (e.g., aromatic amines, hindered phenolics, thioesters, and phosphites) to inhibit formation of free radicals may be added to the thermoplastic to retard oxidation-induced degradation of the thermoplastic. For example, one or more plasticizers (e.g., a phthalate, dioctyl phthalate) may be added to the thermoplastic to achieve softness, flexibility, and melt flow during processing. For example, one or more antistatic agents may be used to prevent the buildup of static charges on the plastic surfaces. For example, one or more slip agents (e.g., polyolefins) may be added to the thermoplastic material to reduce the coefficient of friction of the material. In an aspect, a surface treatment is applied to the outer surfaces of the multi-monodose container. For example, the surface treatment can include corona discharge or deposition of thin layers of other plastics to improve such properties as ink adherence, adherence to other films, heat sealability, or gas barrier.

Returning to FIG. 4, molded structure 410 of multi-monodose container 400 includes a first portion 420 and a second portion 430. The first portion 420 of molded structure 410 of multi-monodose container 400 includes a row of interconnected monodose pharmaceutical vials 440. In this non-limiting example, the row of interconnected monodose pharmaceutical vials 440 includes a row of five interconnected monodose pharmaceutical vials. In an aspect, the row of interconnected monodose pharmaceutical vials includes at least two interconnected monodose pharmaceutical vials. In an aspect, the row of interconnected monodose pharmaceutical vials includes three or more interconnected monodose pharmaceutical vials. In an aspect, the row of interconnected monodose pharmaceutical vials includes at least one of two, three, four, five, six, seven, eight, nine, or ten interconnected monodose pharmaceutical vials. In an aspect, the row of interconnected monodose pharmaceutical vials includes about 2 to about 30 interconnected monodose pharmaceutical vials. For example, the first portion of a molded structure can include a row of interconnected monodose pharmaceutical vials that includes 2 vials, 3 vials, 4 vials, 5 vials, 6 vials, 7 vials, 8 vials, 9 vials, 10 vials, 11 vials, 12 vials, 13 vials, 14 vials, 15 vials, 16 vials, 17 vials, 18 vials, 19 vials, 20 vials, 21 vials, 22 vials, 23 vials, 24 vials, 25 vials, 26 vials, 27 vials, 28 vials, 29 vials, or 30 vials. In some embodiments, the multi-monodose container includes more than 30 vials.

In an aspect, the first portion of the molded structure includes a row of 20 to 30 interconnected monodose pharmaceutical vials. For example, the first portion of a molded structure can include a row of 25 interconnected monodose pharmaceutical vials. In an aspect, the first portion of the molded structure includes a row of 20 to 30 interconnected monodose pharmaceutical vials configured to be split into groups of 3 to 10 interconnected monodose pharmaceutical vials. For example, the first portion of the molded structure includes a row of 20 to 30 interconnected monodose pharmaceutical vials configured to be split into groups of 3 vials, 4 vials, 5 vials, 6 vials, 7 vials, 8 vials, 9 vials, or 10 vials. For example, a multi-monodose container can include a strip of 25 interconnected monodose pharmaceutical vials that is configured to be split into groups of 5 vials.

In an aspect, each of the interconnected monodose pharmaceutical vials is polygonal in cross-section perpendicular to an axis formed by the first portion and the second portion of the molded structure. In an aspect, each of the interconnected monodose pharmaceutical vials is square, triangular, hexagonal, or polygonal in cross-section perpendicular to an axis formed by the first portion and the second portion of the molded structure.

Figure 5A:
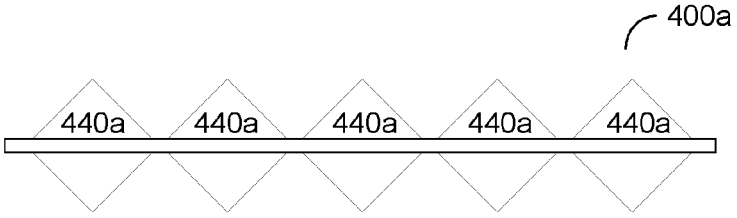
FIG. 5A is a schematic of a top-down view of a molded structure with a row of interconnected monodose pharmaceutical vials and a textured surface pattern.
Figure 5B:
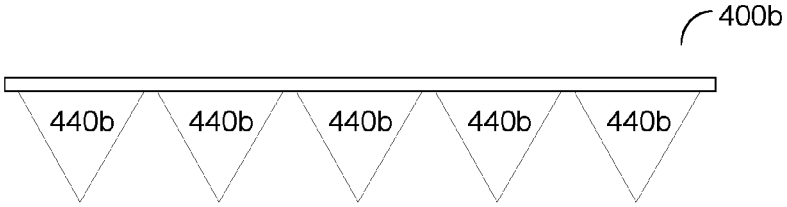
FIG. 5B is a schematic of a top-down view of a molded structure with a row of interconnected monodose pharmaceutical vials and a textured surface pattern.
Figure 5C:
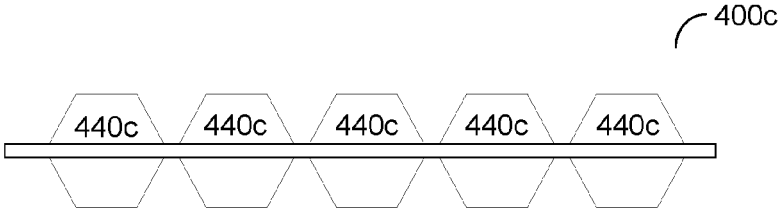
FIG. 5C is a schematic of a top-down view of a molded structure with a row of interconnected monodose pharmaceutical vials and a textured surface pattern.

FIGS. 5A-5C illustrate aspects of multi-monodose container 400 with a row of interconnected monodose pharmaceutical vials 440 having different cross-sectional shapes. FIG. 5A is a top-down view of multi-monodose container 400*a* including a row of interconnected monodose pharmaceutical vials 440*a*. In an aspect, each of the interconnected monodose pharmaceutical vials 440*a* is square in cross-section perpendicular to an axis formed by the first portion and the second portion of the molded structure. FIG. 5B is a top-down view of multi-monodose container 400*b* including a row of interconnected monodose pharmaceutical vials 440*b*. In an aspect, each of the interconnected monodose pharmaceutical vials 440*b* is triangular in cross-section perpendicular to an axis formed by the first portion and the second portion of the molded structure. FIG. 5C is a top-down view of multi-monodose container 400*c* including a row of interconnected monodose pharmaceutical vials 440*c*. In an aspect, each of the interconnected monodose pharmaceutical vials 440*c* is hexagonal in cross-section perpendicular to an axis formed by the first portion and the second portion of the molded structure. Multi-monodose containers 400*a*, 400*b*, and 400*c* having the different cross-sectional shapes include the structures shown in FIG. 4, i.e., a first portion including the row of interconnected monodose pharmaceutical vials and a second portion adjacent to the first portion and including a textured surface pattern positioned to direct gas flow between the first portion and a region adjacent to the second portion.

Each of the interconnected monodose pharmaceutical vials of the multi-monodose container encloses a dose of at least one pharmaceutical agent. In an aspect, the dose of the at least one pharmaceutical agent is formulated for parenteral or oral administration. In an aspect, the dose of the at least one pharmaceutical agent is in a liquid form. For example, the dose of the at least one pharmaceutical agent can be dissolved or suspended in a liquid formulation appropriate for oral or parenteral administration. In an aspect, the dose of the at least one pharmaceutical agent is in lyophilized form. For example, the dose of the at least one pharmaceutical agent can be in a lyophilized or dry form intended to be reconstituted with water, e.g., distilled water or water for injection, prior to administration to a subject. In an aspect, the at least one pharmaceutical agent is intended for administration to humans. In an aspect, the at least one pharmaceutical agent is intended for veterinary administration.

In an aspect, the dose of the at least one pharmaceutical agent includes a preventative agent, e.g., an agent capable of preventing a medical condition or infectious disease. In an aspect, the dose of the at least one pharmaceutical agent includes a dose of at least one vaccine. For example, the dose of the at least one pharmaceutical agent can include a dose of at least one vaccine capable of eliciting immunity against or preventing infection by one or more infectious agents. In an aspect, the dose of the at least one pharmaceutical agent includes a dose of at least one vaccine configured for immunization against one or more infectious agent, disease, or condition, non-limiting examples of which include anthrax, tuberculosis (BCG), cholera, Dengue fever, diphtheria, tetanus, pertussis, haemorrhagic fever, haemophilus b (Hib), hepatitis A, hepatitis B, human papillomavirus, influenza, Japanese encephalitis, malaria, measles, meningococcal meningitis, mumps, poliovirus, rubella, varicella virus, plague, Pneumococcus, rabies, Rift Valley fever, rotavirus, rabies, rubella, smallpox, tick-borne encephalitis, typhoid, yellow fever, and shingles (Zoster). In an aspect, the dose of the at least one pharmaceutical agent includes a dose of two or more vaccines. For example, the dose of the at least one pharmaceutical agent can include a dose of the DPT vaccine including vaccines against diphtheria, tetanus, and pertussis.

In an aspect, the dose of the at least one pharmaceutical agent includes a dose of at least one therapeutic agent. For example, the dose of the at least one pharmaceutical agent can include a drug or drugs capable of treating a medical condition. Non-limiting examples of therapeutic agents include immunoglobulins, antibiotics (e.g., penicillin, cefuroxime, ceftazidime), interferons (e.g., interferon alpha, beta, or gamma), peripheral vasodilators (e.g., alprostadil), anticoagulants (e.g., fondapainux), gonadotrophins (e.g., follitropin), anabolic hormones (e.g., somatropin), bone formation agents (e.g., teriparatide), HIV or other anti-viral drugs (e.g., enfuvirtide), contraceptives (e.g., medroxyprogesterone acetate), anti-inflammatory agents (e.g., etanercept, adalimumab), serotonin receptor antagonists (e.g., sumatriptan), GRH analogs (e.g., leuprolide), chemotherapies, insulin, hormones, anti-infectives, and the like.

In an aspect, the pharmaceutical agent includes an active ingredient. In an aspect, the active ingredient includes one or more vaccines. In an aspect, the active ingredient includes one or more therapeutic agents. In some embodiments, the pharmaceutical agent includes additional inactive ingredients, e.g., excipients, configured to preserve, stabilize, or otherwise protect the active ingredient in the pharmaceutical agent. Non-limiting examples of inactive ingredients or excipients include solvents or co-solvents, e.g., water or propylene glycol, buffers, anti-microbial preservatives, antioxidants, or wetting agents, e.g., polysorbates or poloxamers.

In an aspect, each of the interconnected monodose pharmaceutical vials includes an internal volume holding the dose of the at least one pharmaceutical agent. In an aspect, each of the interconnected monodose pharmaceutical vials has an internal volume configured to hold a dose of at least one pharmaceutical agent. In an aspect, the internal volume holding the dose of the at least one pharmaceutical agent is sufficient to hold a single-dose volume of a pharmaceutical agent and a minimal overfill volume of the pharmaceutical agent. In an aspect, the internal volume holding the dose of the at least one pharmaceutical agent is sufficient to hold a single-dose volume of a pharmaceutical agent, a minimal overfill volume of the pharmaceutical agent, and headspace above the pharmaceutical agent. For example, the internal volume of each of the interconnected monodose pharmaceutical vials comprising a multi-monodose container can be about 0.75 milliliter, a sufficient volume for a 0.5 milliliter single dose of a pharmaceutical agent, 0.1 milliliter of overfill, and 0.15 milliliter of headspace above the liquid pharmaceutical agent. In an aspect, the internal volume is about 0.2 milliliters to about 6.0 milliliters. For example, the internal volume of each of the interconnected monodose pharmaceutical vials of a multi-monodose container is 0.2 mL, 0.3 mL, 0.4 mL, 0.5 mL, 0.6 mL, 0.7 mL, 0.8 mL, 0.9 mL, 1.0 mL, 1.1 mL, 1.2 mL, 1.3 mL, 1.4 mL, 1.5 mL, 1.6 mL, 1.7 mL, 1.8 mL, 1.9 mL, 2.0 mL, 2.1 mL, 2.2 mL, 2.3 mL, 2.4 mL, 2.5 mL, 2.6 mL, 2.7 mL, 2.8 mL, 2.9 mL, 3.0 mL, 3.1 mL, 3.2 mL, 3.3 mL, 3.4 mL, 3.5 mL, 3.6 mL, 3.7 mL, 3.8 mL, 3.9 mL, 4.0 mL, 4.1 mL, 4.2 mL, 4.3 mL, 4.4 mL, 4.5 mL, 4.6 mL, 4.7 mL, 4.8 mL, 4.9 mL, 5.0 mL, 5.1 mL, 5.2 mL, 5.3 mL, 5.4 mL, 5.5 mL, 5.6 mL, 5.7 mL, 5.8 mL, 5.9 mL, or 6.0 mL.

In some embodiments, the internal volume holding the dose of the at least one pharmaceutical agent is greater than 6.0 milliliters. For example, the internal volume of each of the interconnected monodose pharmaceutical vials may be at least twice the volume of a single-dose volume of a pharmaceutical agent to accommodate two doses of the pharmaceutical agent. For example, the internal volume of each of the interconnected monodose pharmaceutical vials can be 10 milliliters and configured to hold two, 3 milliliter single-dose volumes of the pharmaceutical agent.

In an aspect, each of the interconnected monodose pharmaceutical vials has an internal volume configured to hold a single dose of at least one pharmaceutical agent. For example, the internal volume of each of the interconnected monodose pharmaceutical vials can be sized to accommodate a single-dose volume of at least one pharmaceutical agent. In an aspect, the single-dose volume of the at least one pharmaceutical agent can be referred to in terms of milliliters (mL) or cubic centimeters (cc). In an aspect, the single-dose volume includes a liquid or lyophilized formulation of at least one pharmaceutical agent configured for intramuscular, intradermal, subcutaneous, intravenous, or intraperitoneal injection. In an aspect, the single-dose volume includes a liquid or lyophilized formulation of at least one pharmaceutical agent configured for oral, nasal, ocular, urethral, anal, or vaginal administration. In an aspect, the single-dose volume includes a liquid or lyophilized formulation of at least one pharmaceutical agent configured for intraocular injection. In an aspect, the single-dose volume includes a liquid or lyophilized formulation of at least one pharmaceutical agent configured for injection into the central nervous system.

In an aspect, the single-dose volume of the at least one pharmaceutical agent is dependent upon the type of pharmaceutical agent. In an aspect, the single-dose volume of the at least one pharmaceutical agent is a clinically-determined effective or therapeutic dose for the at least one pharmaceutical agent. For example, recommended doses for common vaccines range from 0.05 mL for BCG (tuberculosis) vaccine to 1.0 mL for Hepatitis A vaccine. In an aspect, the single-dose volume of the at least one pharmaceutical agent is dependent upon the site of injection, e.g., intramuscular, subcutaneous, or intradermal. For example, a single-dose volume of an intramuscular injection of a liquid pharmaceutical may be as great as 5 mL. See, e.g., Hopkins & Arias (2013) "Large volume IM injections: A review of best practices," *Oncology Nurse Advisor* January/February, which is incorporated herein by reference. In an aspect, the single-dose volume of the at least one pharmaceutical agent is dependent upon the size of the individual who will be receiving the at least one pharmaceutical agent. For example, the single-dose volume may be dependent upon the size, e.g., weight, of the intended recipient, e.g., a child versus an adult. For example, a single-dose volume for a subcutaneous injection of a pharmaceutical agent may be 0.5 mL, 1 mL, or 2 mL depending upon the size of the child or adult. In an aspect, the single-dose volume of the pharmaceutical agent ranges from about 0.01 mL to about 5 mL. For example, in some embodiments, the single-dose volume of the pharmaceutical agent can be 0.01 mL, 0.02 mL, 0.05 mL, 0.075 mL, 0.1 mL, 0.15 mL, 0.2 mL, 0.25 mL, 0.3 mL, 0.35 mL, 0.4 mL, 0.45 mL, 0.5 mL, 0.55 mL, 0.6 mL, 0.65 mL, 0.7 mL, 0.75 mL, 0.8 mL, 0.85 mL, 0.9 mL, 1.0 mL, 1.25 mL, 1.5 mL, 1.75 mL, 2.0 mL, 2.25 mL, 2.5 mL, 2.75 mL, 3.0 mL, 3.25 mL, 3.5 mL, 3.75 mL, 4.0 mL, 4.25 mL, 4.5 mL, 4.75 mL, or 5.0 mL.

In an aspect, the internal volume of each of the interconnected monodose pharmaceutical vials is configured to hold two or more doses of at least one pharmaceutical agent. For example, each of the interconnected monodose pharmaceutical vials of a multi-monodose container can be configured to hold two or more single-dose volumes of at least one pharmaceutical agent.

In an aspect, each of the interconnected monodose pharmaceutical vials of a multi-monodose container includes a different pharmaceutical agent. For example, a multi-monodose container can be configured for the transport and storage of a specific number of individual doses of multiple pharmaceuticals intended for use for a single patient within a limited time period, such as a single medical clinic visit. For example, in some embodiments a multi-monodose container including six interconnected monodose pharmaceutical vials is configured for the storage and transport of a single dose each of HepB, RV, DTaP, HiB, PCV, and IPV vaccines, one in each of the vials, for administration to a child according to the routine vaccine schedule suggested for 2 month olds. For example in some embodiments a multi-monodose container including four interconnected monodose pharmaceutical vials is configured for the storage and transport of a single dose of each of the DTaP, IPV, MMR and VAR vaccines, one in each vial, for administration to a child according to the routine vaccine schedule suggested for 4-6 year olds. See "Advisory Committee on Immunization Practices (ACIP) Recommended Immunization Schedule for Persons Aged 0 through 18 years—United States, 2013" ACIP Childhood/Adolescent Work Group, *MMWR* 62: 1-8 (2013), which is incorporated herein by reference.

For example, in some embodiments a multi-monodose container including interconnected monodose pharmaceutical vials can be used to store multiple doses of immunoglobulin therapy that can be administered in series to a patient as directed by a medical professional. Several types of immunoglobulin therapy are available that are generally administered serially, in dose volumes relative to the body mass of a patient. Aliquot volumes of an immunoglobulin therapy can be stored in individual monodose pharmaceutical vials of a multi-monodose container for administration to patients, in a form to minimize waste of the immunoglobulin therapy as well as to minimize the potential of contamination of the immunoglobulin therapy in the vials. For example, in some embodiments a multi-monodose container including interconnected monodose pharmaceutical vials can be used to store multiple doses of injection-administered anti-viral therapy. For example, in some embodiments a multi-monodose container including interconnected monodose pharmaceutical vials can be used to store multiple doses of injection-administered antibiotic therapy. For example, in some embodiments a multi-monodose container including interconnected monodose pharmaceutical vials can be used to store doses of biologicals that include therapeutic proteins. For example, in some embodiments a multi-monodose container including interconnected monodose pharmaceutical vials can be used to store doses of biologicals that include antibodies, such as mono-clonal or poly-clonal antibodies. For example, in some embodiments a multi-monodose container including interconnected monodose pharmaceutical vials can be used to store multiple doses of an injection-administered therapy generally administered to a single patient in series, so that one multi-monodose container can include a standard series of injectable doses for a single individual patient to be administered in temporal series under the guidance of a medical professional. For example, in some embodiments a multi-monodose container including interconnected monodose pharmaceutical vials can be used to store doses of an injection-administered therapy that has multiple components that are administered separately, for example different antibiotics and/or antivirals that are administered to a single patient in need thereof.

In an aspect, the internal volume holding the dose of the at least one pharmaceutical agent includes a volume of head space above the dose of the at least one pharmaceutical agent. In an aspect, the internal volume holding the dose of the at least one pharmaceutical agent includes an inert gas-filled headspace. For example, the headspace above the dose of the at least one pharmaceutical agent in a liquid or lyophilized/solid form can be filled with an inert gas. In an aspect, the internal volume holding the dose of the at least one pharmaceutical agent includes a nitrogen-filled headspace. For example, each of the interconnected monodose pharmaceutical vials can be configured to hold nitrogen in the headspace above the dose of the at least one pharmaceutical agent. For example, each of the interconnected monodose pharmaceutical vials can be configured to hold carbon dioxide in the headspace above the dose of the at least one pharmaceutical agent. In an aspect, the internal volume holding the dose of the at least one pharmaceutical agent includes a noble gas-filled head space. For example, each of the interconnected monodose pharmaceutical vials can be configured to hold at least one of argon, neon, krypton, or xenon in the headspace above the dose of the at least one pharmaceutical agent. The process of forming, filling, and sealing the vials of the multi-monodose container may further include purging the atmospheric air/oxygen in the headspace above the dose of the at least one pharmaceutical agent prior to adding an inert gas.

In an aspect, each of the interconnected monodose pharmaceutical vials includes an access portion. In an aspect, the access portion includes an aperture defined by the walls of a monodose pharmaceutical vial. In an aspect, the access portion is contiguous with the internal volume of a monodose pharmaceutical vial. For example, the access portion can include an aperture or opening defined by the end of the walls forming a monodose pharmaceutical vial that allows access to the internal volume of the monodose pharmaceutical vial. For example, the access portion includes an opening in a monodose pharmaceutical vial for access to the dose of the at least one pharmaceutical agent enclosed therein. For example, the access portion is sufficiently large enough to accommodate passage of a needle, e.g., a syringe needle.

In an aspect, each of the interconnected monodose pharmaceutical vials includes a closure covering an access portion. In some embodiments, the closure includes a removable cap. In some embodiments, the removable cap is snapped or twisted off to reveal an access portion of the monodose pharmaceutical vial. In an aspect, the access portion is an opening or aperture defined by the walls of the monodose pharmaceutical vial. For example, the removable cap can be snapped or twisted off to reveal an opening or aperture through which the enclosed at least one pharmaceutical agent can be accessed. In an aspect, the closure includes a needle-penetrable closure. For example, the closure can include a needle-penetrable material through which a needle attached to a syringe is able to penetrate to access the internal volume of a monodose pharmaceutical vial. For example, the closure can include a removable cap that is snapped or twisted off to reveal a needle-penetrable material through which a needle attached to a syringe can access the internal volume of a monodose pharmaceutical vial.

In an aspect, each of the interconnected monodose pharmaceutical vials includes a needle-penetrable access portion. In an aspect, the needle-penetrable access portion is configured to allow passage of a needle into the internal volume of a monodose pharmaceutical vial through a needle-penetrable material forming at least a portion of the multi-monodose container. For example, the needle-penetrable access portion can include a needle-penetrable access portion of the thermoplastic material used to form the multi-monodose container. For example, the top of a blow-fill-sealed vial can include a needle-penetrable access portion. For example, the needle-penetrable access portion may include a sealed portion formed by fusing or heat sealing the walls at an open end of each of the monodose pharmaceutical vials to cover an access portion. For example, a sealed portion formed by fusing or heat sealing the walls at an open end of each of the monodose pharmaceutical vials may further be needle-penetrable to allow a needle to pass through the sealed portion to access the internal volume of the vial. In some embodiments, each of the interconnected monodose pharmaceutical vials forming the multi-monodose container can include a removable cap that once removed uncovers a needle-penetrable access portion.

In an aspect, the needle-penetrable access portion includes an additional part added to each of the interconnected monodose pharmaceutical vials. In an aspect, the needle-penetrable access portion includes an insert. For example, the needle-penetrable access portion can include an insert that is added to the blow-molded or injection-molded row of interconnected monodose pharmaceutical vials. In an aspect, the needle-penetrable access portion includes a rubber needle-penetrable access portion. For example, the closure can include a needle-penetrable rubber septum inserted into the access portion and held in place with an aluminum seal crimped around a tapered neck region of the vial. For example, the rubber needle-penetrable access portion is formed from bromobutyl or chlorobutyl synthetic rubber. In an aspect, the rubber needle-penetrable access portion is further protected with a plastic flip-off cap.

In an aspect, each of the interconnected monodose pharmaceutical vials includes a removable cap covering an access portion. In an aspect, each of the interconnected monodose pharmaceutical vials includes a shearable cap covering an access portion. For example, a shearable cap can be formed during the blow-fill-seal manufacturing process in such a way as to be readily shearable from the remainder of the monodose pharmaceutical vial upon use to reveal an access portion, e.g., a needle-accessible access portion. In an aspect, each of the interconnected monodose pharmaceutical vials includes a twistable cap covering an access portion. For example, a twistable cap can be formed during the blow-fill-seal manufacturing process in such a way as to be readily twistable from the remainder of the monodose pharmaceutical vial upon use to reveal an access portion, e.g., a needle-accessible access portion. In an aspect, the removable cap is formed from a second molding process after formation of the base of the row of interconnected monodose pharmaceutical vials. In an aspect, the removable cap is an insert added during the molding process. See, e.g., U.S. Pat. No. 3,993,223 to Welker & Brady titled "Dispensing Container;" U.S. Pat. No. 6,626,308 to Weiler titled "Hermetically Sealed Container with Self-Draining Closure," U.S. Pat. No. 4,319,701 to Cambio titled "Blow Molded Container Having an Insert Molded In Situ," all of which are incorporated herein by reference.

In an aspect, each of the interconnected monodose pharmaceutical vials includes an insert covering an access portion. For example, each of the interconnected monodose pharmaceutical vials can include a removable cap that is added to each of the interconnected monodose pharmaceutical vials. In an aspect, the insert is added to each of the interconnected monodose pharmaceutical vials during the molding process. See, e.g., U.S. Pat. No. 4,319,701 to Cambio titled "Blow Molded Container Having an Insert Molded In Situ," which is incorporated herein by reference. In an aspect, the insert includes at least in part another sterile component that is added to each of the interconnected monodose pharmaceutical vials after the molding process. For example, the insert can include a tip-type cap, a metal component, or a luer fitting. In an aspect, the insert is one of a co-molded tip-and-cap insert for generating a calibrated drop, a multi-entry rubber stopper insert, or a controlled-diameter injection-molded insert. In an aspect, the insert is a septum. For example, insertion technology can be used to incorporate a sterile tip and cap insert into each of the interconnected monodose pharmaceutical vials.

In an aspect, each of the interconnected monodose pharmaceutical vials includes a luer connector or fitting. For example, each of the interconnected monodose pharmaceutical vials can include a luer connector appropriately sized to mate with a syringe including a luer lock, allowing for the removal of the contents of the vial without the use of a syringe needle. See, e.g., U.S. Pat. No. 4,643,309 to Evers & Lakemedel titled "Filled Unit Dose Container," which is incorporated herein by reference.

Returning to FIG. 4, the second portion 430 of the molded structure 410 includes a textured surface pattern 450 positioned to direct gas flow between the first portion and a region adjacent to the second portion. For example, the second portion of the molded structure can include a textured surface pattern configured to aid in drawing out or evacuating air and/or an inert gas from the hermetically-sealable overwrap during the process of hermetically sealing the multi-monodose container therein. In an aspect, the textured surface pattern positioned to direct gas flow between the first portion and the region adjacent to the second portion comprises a debossed surface pattern positioned to direct gas flow between the first portion and the region adjacent to the second portion. For example, the textured surface pattern can include a series of valleys or canals on the surface of the second portion of the molded structure. In an aspect, the textured surface pattern positioned to direct gas flow between the first portion and the region adjacent to the second portion comprises an embossed surface pattern positioned to direct gas flow between the first portion and the region adjacent to the second portion. For example, the textured surface pattern can include a series of ridges on the surface of the second portion of the molded structure. In an aspect, debossing or embossing to form the textured surface pattern is performed after manufacture of the molded structure. For example, a debossed surface pattern, e.g., a series of valleys or canals, can be etched into the surface of the second portion of the molded structure. For example, an embossed surface pattern, e.g., a series of ridges, can be built up on the surface of the second portion of the molded structure. In an aspect, debossing or embossing to form the textured surface pattern is performed during the manufacturing process of the molded structure. For example, the debossed and/or embossed textured surface pattern can be incorporated into the molds used to form the molded structure. For example, the debossed and/or embossed textured surface pattern can be incorporated into molds used for blow mold manufacturing of the multi-monodose container. For example, the debossed and/or embossed textured surface pattern can be incorporated into molds used for injection molding multi-monodose container. For example, the debossed and/or embossed textured surface pattern can be incorporated into molds used for blow-fill-seal manufacturing of the multi-monodose container.

In an aspect, at least a portion of the textured surface pattern includes channels aligned parallel to the directed gas flow between the first portion and the region adjacent to the second portion. For example, the textured surface pattern can include a series of parallel lines embossed and/or debossed on the surface of the second portion of the molded structure. For example, the textured surface pattern can include a series of broken, e.g., hashed or dotted, lines embossed and/or debossed on the surface of the second portion of the molded structure. In an aspect, at least a portion of the textured surface pattern includes parallel channels debossed on the surface of the second portion of the molded structure, the parallel channels aligned with the flow of gas between the first portion of the molded structure and a region adjacent to the second portion, e.g., adjacent to an end edge of the second portion. In an aspect, at least a portion of the textured surface pattern includes parallel channels embossed on the surface of the second portion of the molded structure, the parallel channels aligned with the flow of gas between the first portion of the molded structure and a region adjacent to the second portion. In an aspect, at least a portion of the textured surface pattern includes channels positioned at an angle relative to the directed gas flow that converge or nearly converge so as to be parallel to the directed gas flow. Other textured surface patterns are contemplated, including but not limiting to, v-shaped patterns, serpentine patterns, hashed or dotted patterns.

Figure 6:
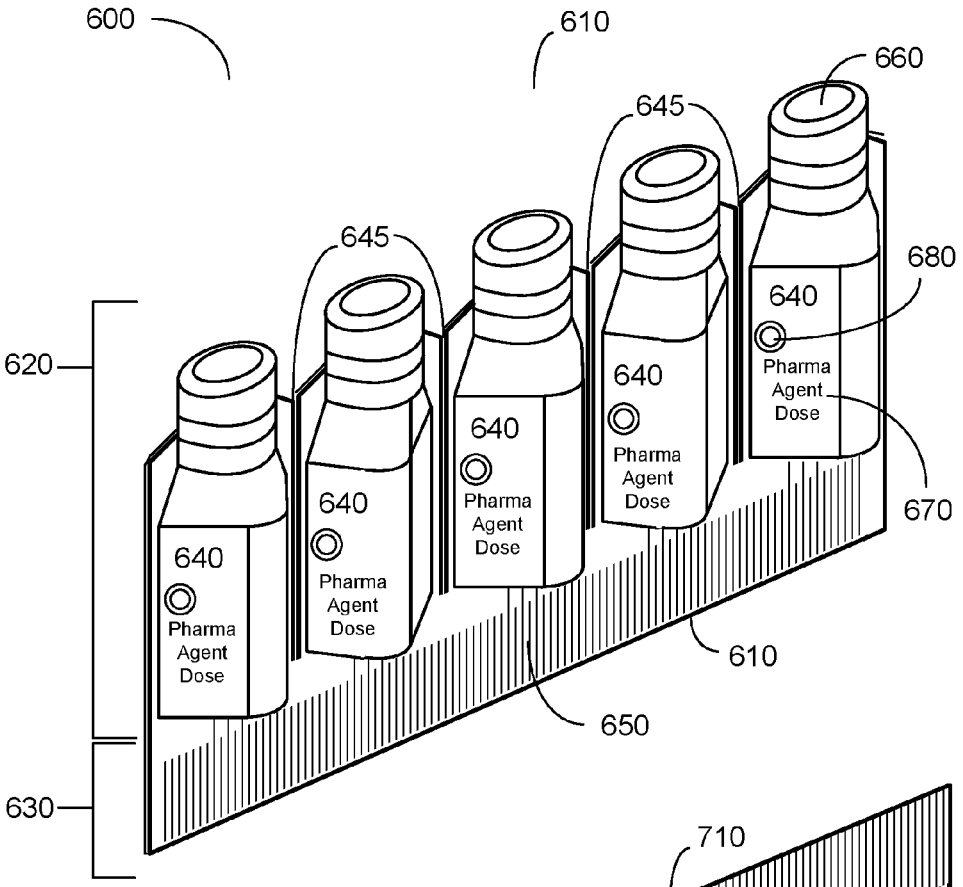
FIG. 6 is a schematic of an embodiment of a multi-monodose container including a molded structure with a row of interconnected monodose pharmaceutical vials and a textured surface pattern.

The second portion of the molded structure including the textures surface pattern is affixed to the first portion of the molded structure. In an aspect, the second portion is affixed to the first portion adjacent to a bottom portion of the row of interconnected monodose pharmaceutical vials. A non-limiting example is provided in FIG. 6. FIG. 6 shows a schematic of a multi-monodose container 600 including a molded structure 610 having a first portion 620 and a second portion 630. First portion 620 includes a row of interconnected monodose pharmaceutical vials 640. Second portion 630 includes a textured surface pattern 650. Second portion 630 is shown affixed to first portion 620 adjacent to the bottom of the row of interconnected monodose pharmaceutical vials 640. Each of the interconnected monodose-pharmaceutical vials 640 of the multi-monodose container 600 further includes a needle-penetrable access portion 660 through which an injection needle is capable of penetrating. Multi-monodose container 600 further includes at least one label 670 including at least one sensor 680. Label 670 includes information regarding the at least one pharmaceutical agent. The at least one sensor 680 includes at least one of a temperature sensor, a moisture sensor, a light sensor, or an oxygen sensor.

In some embodiments, the first portion 620 of the molded structure 610 includes a row of interconnected monodose pharmaceutical vials 640 connected through one or more articulating joints 645. In an aspect, at least one of the interconnected monodose pharmaceutical vials is attached through an articulating joint to at least one adjacent monodose pharmaceutical vial, the articulating joint sufficiently flexible to reversibly mate a planar outer surface of the at least one of the interconnected monodose pharmaceutical vials with a planar outer surface of the at least one adjacent monodose pharmaceutical vial. For example, a multi-monodose container can include a row of interconnected monodose pharmaceutical vials connected through one or more articulating joints, non-limiting aspects of which are described in greater detail in FIGS. 22A-22E. The one or more articulating joints are configured to allow the multi-monodose container to be folded into a more compact configuration for shipment and storage.

In some embodiments, the articulating joint is functional, i.e., bendable, only after separation of the second portion of the molded structure from the first portion of the molded structure. For example, in some embodiments, the articulating joint is only capable of reversibly mating a planar outer surface of a monodose pharmaceutical vial with a planar outer surface of an adjacent monodose pharmaceutical vial after the removal of the second portion of the molded structure. In some embodiments, the articulating joint is functional, i.e., bendable, in the intact molded structure. For example, the articulating joint can be positioned to run the length of the first portion and the second portion of the molded structure. For example, an articulating joint can be positioned between and run the length of each of the interconnected monodose pharmaceutical vials.

Figure 7:
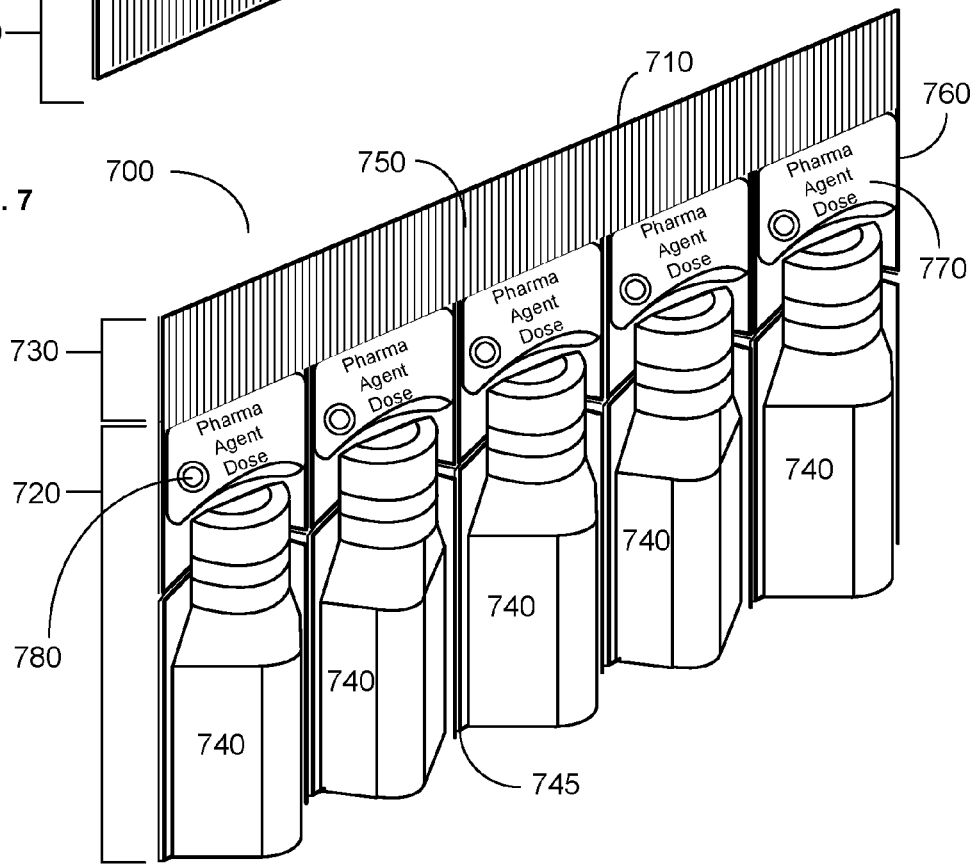
FIG. 7 is a schematic of an embodiment of a multi-monodose container including a molded structure with a row of interconnected monodose pharmaceutical vials and a textured surface pattern.

In an aspect, the second portion is affixed to the first portion adjacent to a top portion of the row of interconnected monodose pharmaceutical vials. A non-limiting example is provided in FIG. 7. FIG. 7 shows a schematic of a multi-monodose container 700 including a molded structure 710 having a first portion 720 and a second portion 730. First portion 720 includes a row of interconnected monodose pharmaceutical vials 740. In some embodiments, each of the interconnected monodose pharmaceutical vials 740 is connected through one or more articulating joints 745 to at least one adjacent monodose pharmaceutical vial 740. Second portion 730 includes a textured surface pattern 750. Second portion 730 is shown affixed to first portion 720 adjacent to the top of the row of interconnected monodose pharmaceutical vials 740. Multi-monodose container 700 further includes a closure 760, e.g., a twistable cap, designed to be removed to reveal an access portion for accessing an enclosed pharmaceutical agent with, e.g., an injection needle. Multi-monodose container 700 further includes a label 770 including at least one sensor 780. Label 770 includes information regarding the at least one pharmaceutical agent. The at least one sensor 780 includes at least one of a temperature sensor, a moisture sensor, a light sensor, or an oxygen sensor.

In an aspect, a multi-monodose container includes at least one label. In an aspect, the at least one label is associated with at least one surface of the molded structure of the multi-monodose container. In an aspect, the at least one label is attached to at least one surface of the molded structure of the multi-monodose container. In an aspect, the at least one label is associated with or attached to the first portion of the molded structure. In an aspect, the at least one label is associate with or attached to the second portion of the molded structure. In an aspect, a label is associated with or attached to each of the interconnected monodose pharmaceutical vials.

The label includes information regarding the at least one pharmaceutical agent contained within each of the interconnected monodose pharmaceutical vials forming the multi-monodose container. For example, the label can include the proprietary name of a pharmaceutical agent, the established name or proper name of a pharmaceutical agent, strength of a pharmaceutical agent, route(s) of administration, warnings (if any), cautionary statements (if any), net quantity, manufacturer name, expiration date, lot number, recommended storage conditions, recommended single dose volume (if multiple doses per vial), a bar code, a batch number, national drug code numbers, controlled substance schedule information (if applicable), radio frequency identification (RFID) tag, or combinations thereof. For a pharmaceutical agent in liquid form, the label may include the strength per total volume (e.g., 500 mg/10 mL) as well as the strength per milliliter (e.g., 50 mg/1 mL). For a pharmaceutical agent in powder form, the label may include the amount of pharmaceutical agent (e.g., in milligrams) per vial. The label may also include instructions for reconstituting a pharmaceutical agent that is in lyophilized or powder form and the strength of the pharmaceutical agent in the reconstituted volume. For additional information regarding container labels see, e.g., Guidance for Industry: Safety Considerations for Container Labels and Carton Labeling Design to Minimize Medication Errors," Food and Drug Administration, April 2013, which is incorporated herein by reference.

In an aspect, each of the interconnected monodose pharmaceutical vials includes a label. For example, each of the monodose pharmaceutical vials comprising the row of interconnected monodose pharmaceutical vials can have an individual label. In an aspect, a label is associated with at least one surface of each of the interconnected monodose pharmaceutical vials. In an aspect, the label is printed on an outer surface of each of the monodose pharmaceutical vials comprising the row of interconnected monodose pharmaceutical vials. For example, the label may be printed onto each of the monodose pharmaceutical vials using thermal transfer overprinting, laser marking system, continuous inkjet, or thermal inkjet. For example, the label can be printed on a portion of a removable cap associated with a monodose pharmaceutical vial.

In an aspect, a label is attached to at least one surface of each of the interconnected monodose pharmaceutical vials. For example, the label can be attached to one or more outer surfaces of each of the interconnected monodose pharmaceutical vials. For example, the label can be attached to a removable cap associated with each of the interconnected monodose pharmaceutical vials. In an aspect, the label is printed separately and includes an adhesive for adhering at least a portion of the label to at least one surface of the multi-monodose container. For example, labels can be printed separately and attached with an adhesive to the removable cap of each of the interconnected monodose pharmaceutical vials comprising the multi-monodose container. For example, the label can be printed separately onto a tag that includes a pressure sensitive adhesive. For example, the label can be printed separately onto a tag that is adhered to each of the interconnected monodose pharmaceutical vials comprising the multi-monodose container with a separate piece of pressure sensitive adhesive, e.g., a piece of clear adhesive tape.

In an aspect, a label including a wet glue adhesive or pressure sensitive adhesive is applied to the molded structure and/or each of the interconnected monodose pharmaceutical vials using a wet glue labeler or a pressure sensitive label applicator. In an aspect, the wet glue labeler includes a hot melt label applicator. For example, a hot melt label applicator can be used to apply a label with solid glue at room temperature which becomes liquid upon application of heat. In an aspect, the wet glue labeler includes a pre-gummed label applicator. For example, a pre-gummed label applicator can be used to apply wetted labels pre-coated with an adhesive.

In an aspect, the label includes an in-mold labeling technique that applies labels to the molded structure as it is being formed. For example, the at least one label can be applied during blow forming of the molded structure. For example, the at least one label can be applied during injection molding of the molded structure. In an aspect, the label is debossed on a surface of the molded structure. In an aspect, the label is embossed on a surface of the molded structure. In an aspect, at least one label is etched into a surface of the molded structure.

In an aspect, the multi-monodose container includes at least one label with at least one sensor. For example, the multi-monodose container can include a label with a sensor configured to detect or monitor an environmental exposure of the multi-monodose container. For example, the multi-monodose container can include a label with a sensor configured to detect or monitor an environment exposure to the multi-monodose container as a result of a breach in secondary packaging. In an aspect, the molded structure includes at least one label including at least one sensor. In an aspect, the first portion of the molded structure includes at least one label including at least one sensor. In an aspect, each of the interconnected monodose pharmaceutical vials includes a label including at least one of a temperature sensor, a moisture sensor, a light sensor, or an oxygen sensor. For example, each of the interconnected monodose pharmaceutical vials comprising a multi-monodose container can include a label with a sensor configured to detect or monitor exposure of each of the vials to an environmental condition, e.g., temperature, moisture, light, or oxygen. For example, the label can include at least one sensor configured to detect or monitor an environmental exposure as a result of a breach in secondary packaging, e.g., a vacuum sealed covering.

In an aspect, the label includes at least one temperature sensor. In an aspect, the temperature sensor is configured to monitor a temperature excursion, e.g., a transport or storage temperature that is outside a recommended range for a given pharmaceutical agent. For example, the temperature sensor can be configured to monitor whether or not the multi-monodose container and/or the individual monodose pharmaceutical vials and potentially heat-sensitive pharmaceutical agents stored therein are exposed to excessive heat during transport and/or storage. For example, the temperature sensor can include a chemical composition that gradually and/or irreversibly changes in color in response to changes in temperature exposure. In an aspect, the temperature sensor includes a substrate, e.g., a paper laminate, with an indicator dye that is configured to change color in response to changes in temperature. In an aspect, the change in color is irreversible. See, e.g., U.S. Pat. No. 5,085,802 to Jalinski titled "Time Temperature Indicator with Distinct End Point;" U.S. Pat. No. 5,254,473 to Patel titled "Solid State Device for Monitoring Integral Values of Time and Temperature of Storage of Perishables;" and U.S. Pat. No. 6,544,925 to Prusik et al. titled "Activatable Time-Temperature Indicator System," which are incorporated herein by reference. In an aspect, the temperature sensor is configured to monitor cumulative heat exposure. For example, the temperature sensor can include a HEATmarker® indicator (from Temptime Corporation, Morris Plains, N.J.) which gradually changes color in response to cumulative heat exposure. For example, the temperature sensor can include a Timestrip PLUS Duo for cumulative detection of temperature excursions above or below a specified threshold (from Timestrip, United Kingdom). In an aspect, the temperature sensor is configured to detect a threshold or limit temperature level. For example, the temperature sensor can include a LIMITmarker™ indicator (from Temptime Corporation, Morris Plains, N.J.) or a 3M™ MonitorMark™ Time Temperature Indicator (from 3M, St. Paul, Minn.) which irreversibly changes color if the label and the contents therein have been exposed to a potentially damaging threshold temperature. In an aspect, the temperature sensor is configured to monitor whether or not the multi-monodose container and/or its freeze-sensitive contents are exposed to inappropriate freezing temperatures during transport and/or storage. For example, the temperature sensor can include a FREEZEmarker® indicator (from Temptime Corporation, Morris Plains, N.J.) or a 3M™ Freeze Watch™ indicator (from 3M, St. Paul, Minn.) which irreversibly changes color in response to a freeze event. See, e.g., Kartoglu & Milstien (2014) "Tools and approached to ensure quality of vaccines throughout the cold chain," Expert Rev. Vaccines 13: 843-854, which is incorporated herein by reference. Other time-temperature indicators include VITSAB®, CheckPoint® (from Vitsab International, Sweden), Fresh-Check®

In an aspect, the label includes a vaccine vial monitor (VVM) to indicate the cumulative heat exposure of a vial of vaccine to determine whether the cumulative heat history of the product has exceeded a pre-set limit. In an aspect, the vaccine vial monitor includes at least one of a VVM30, a VVM14, a VVM7, or a VVM2 indicator depending upon the heat stability of the product. For example, a VVM30 label has a 30 day end point at 37° C. and greater than 4 years end point at 5° C. while a VVM2 label has a 2 day end point at 37° C. and a 225 day end point at 5° C. For more information regarding international specifications for vaccine vial monitors, see Vaccine Vial Monitor, PQS performance specification, World Health Organization, WHO/PQS/E06/IN05.2 issued on Jul. 26, 2011, which is incorporated herein by reference.

In an aspect, the label includes at least one moisture sensor. For example, the label can include a sensor configured to detect exposure to moisture as a result of a breach in secondary packaging covering/sealing a multi-monodose container. For example, the moisture sensor can include a colorimetric water detection label which changes color in response to exposure to moisture (e.g., 3M™ Ultrathin Water Contact Indicator from 3M Company, St. Paul, Minn.). Also see, e.g., U.S. Pat. No. 4,098,120 to Manske titled "Humidity Indicating Method and Device," which is incorporated herein by reference.

In an aspect, the label includes at least one light sensor. For example, the at least one sensor can include a light sensor configured to monitor whether the multi-monodose container and/or the individual monodose pharmaceutical vials comprising the multi-monodose container has been exposed to light. A light sensor may be used to detect a potential breach in the hermetically-sealed overwrap. For example, the light sensor can include a photoresistor, light-dependent resistor, or photocell associated with a radiofrequency identification (RFID) tag. For example, the light sensor can include a light harvesting photovoltaic module (from, e.g., ElectricFilm, LLC, Newburyport, Mass.).

In an aspect, the label includes at least one oxygen sensor. For example, the multi-monodose container can include at least one label with an oxygen sensor configured to detect a potential breach in the hermetically-sealed overwrap prior to use. In an aspect, the oxygen indicator is a luminescence-based oxygen indicator. For example, the oxygen sensor can include tris(4,7-diphenyl-1,10-phenanthroline) rutheniutn (II) perchlorate, i.e. [Ru(dpp)3](ClO4)2 encapsulated in a case-permeable material, e.g., silicone rubber. Luminescence associated with [Ru(dpp)3](ClO4)2 is quenched in the presence of oxygen. For example, the oxygen sensor can include O2xyDot™ oxygen sensors (from OxySense® Dallas, Tex.) attached to the label and/or the vial. In an aspect, the oxygen indicator is a colorimetric indicator configured to change color in response to exposure to oxygen. For example, the oxygen sensor can include a colorimetric redox dye-based indicator, e.g., Ageless Eye™ (from Mitsubishi Gas Company, Japan). In an aspect, the oxygen sensor includes a colorimetric light-activated, redox dye-based oxygen indicator. For example, the oxygen sensor can include a photoexcited dye that is "primed" with ultraviolet or visible light and further changes color in response to oxygen exposure. See, e.g., Mills (2005) "Oxygen indicators and intelligent inks for packaging food," Chem. Soc. Rev. 34:1003-1011, which is incorporated herein by reference. U.S. Pat. No. 8,707,766 to Harris et al. titled "Leak detection in vacuum bags," which is incorporated herein by reference. U.S. Pat. No. 8,501,100 to Fukui titled "Oxygen detection using metalloporphyrins," which is incorporated herein by reference.

Additional information regarding colorimetric packaging sensors is described in Kamal el Deen (2013) "The Intelligent Colorimetric Timer Indicator Systems to Develop Label Packaging Industry in Egypt" Int. Design J. 4:295-304.

In an aspect, the label includes electronics. In an aspect, the label includes XpressPDF temperature monitoring labels (from PakSense, Boise, Id.) which includes a built in USB connection point and generates a PDF data file containing complete time and temperature history. In an aspect, the label includes printed electronics. For example, the label includes a printed radiofrequency identification tag. For example, the label can include a printed temperature sensor using ThinFilm technology (from, e.g., Thin Film Electronics ASA, Oslo, Norway).

In an aspect, the label includes a smart radiofrequency identification (RFID) tag. For example, the RFID tag can be integrated with sensors, e.g., temperature and/or light sensors, for wireless monitoring of environmental conditions. See, e.g., Cho et al. (2005) "A 5.1-W UHF RFID Tag Chip integrated with Sensors for Wireless Environmental Monitoring," Proceedings of ESSCIRC, Grenoble, France, 2005, pp. 279-282, which is incorporated herein by reference.

Figure 8:
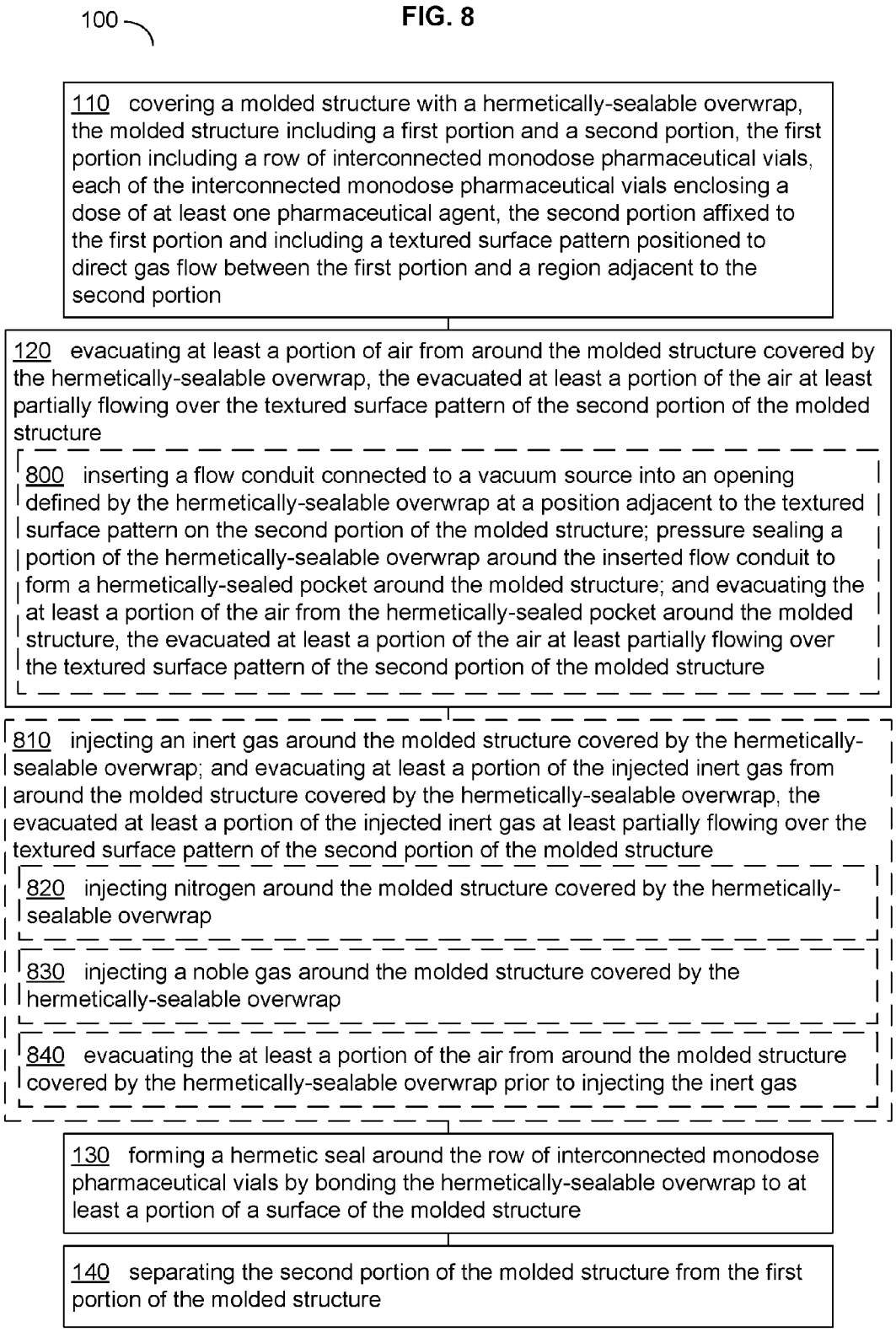
FIG. 8 depicts aspects of a method of packaging a multi-monodose container such as shown in FIG. 1.

FIG. 8 illustrates aspects of a method of packaging a multi-monodose container such as shown in FIG. 1. FIG. 8 is a block diagram showing aspects of method 100 of packaging a multi-monodose container. Method 100 of packaging a multi-monodose container includes in block 120 evacuating at least a portion of air from around the molded structure covered by the hermetically-sealable overwrap, the evacuated at least a portion of the air at least partially flowing over the textured surface pattern of the second portion of the molded structure. For example, the method includes reducing the overall volume of the packaged multi-monodose container by removing at least a portion of the air from within the hermetically-sealable overwrap prior to closure. In some embodiments, the method includes using a vacuum source to evacuate the at least a portion of the air around the multi-monodose container. In an aspect, method 100 of packaging a multi-monodose container includes in block 800 inserting a flow conduit connected to a vacuum source into an opening defined by the hermetically-sealable overwrap at a position adjacent to the textured surface pattern on the second portion of the molded structure; pressure sealing a portion of the hermetically-sealable overwrap around the inserted flow conduit to form a pocket around the molded structure; and evacuating the at least a portion of the air from the pocket around the molded structure, the evacuated at least a portion of the air at least partially flowing over the textured surface pattern of the second portion of the molded structure.

In an aspect, a method of packaging a multi-monodose container in a hermetically-sealable overwrap includes the use of an inert gas. For example, the method can include injecting an inert gas into the hermetically-sealable overwrap and around the multi-monodose container prior to sealing the multi-monodose container therein. In some embodiments, method 100 includes injecting an inert gas around the molded structure covered by the hermetically-sealable overwrap; and evacuating at least a portion of the injected inert gas from around the molded structure covered by the hermetically-sealable overwrap, the evacuated at least a portion of the injected inert gas at least partially flowing over the textured surface pattern of the second portion of the molded structure, as shown in block 810. For example, the method can include generating an oxygen-free and/or inert atmosphere surrounding the molded structure and the row of interconnected monodose pharmaceutical vials by injecting an inert gas into the hermetically-sealable overwrap covering the molded structure. In an aspect, method 100 includes injecting nitrogen around the molded structure covered by the hermetically-sealable overwrap, as shown in block 820. In an aspect, method 100 includes injecting a noble gas around the molded structure covered by the hermetically-sealable overwrap, as shown in block 820. For example, the method can include injecting at least one of argon, neon, krypton, or xenon into the hermetically-sealable overwrap.

In an embodiment, method 100 of packaging a multi-monodose container includes evacuating the at least a portion of the air from around the molded structure covered by the hermetically-sealable overwrap prior to injecting the inert gas, as shown in block 840. For example, the method can include sucking at least a portion of the air from around the molded structure covered by the hermetically-sealable overwrap prior to injecting the inert gas. For example, the method can include exchanging the air from around the molded structure covered by the hermetically-sealable overwrap with the inert gas. For example, the method can include purging or flushing the air from around the molded structure covered by the hermetically-sealable overwrap with the inert gas.

In some embodiments, the method includes using a vacuum source to vacuum seal the multi-monodose container in the presence of an inert gas. For example, a method of packaging a multi-monodose container can include inserting a flow conduit connected to a vacuum source into an opening defined by the hermetically-sealable overwrap at a position adjacent to the textured surface pattern on the second portion of the molded structure; pressure sealing a portion of the hermetically-sealable overwrap around the inserted flow conduit to form a pocket around the molded structure; and evacuating at least a portion of the injected inert gas from the pocket around the molded structure, the evacuated at least a portion of the injected inert gas at least partially flowing over the textured surface pattern on the second portion of the molded structure. In an embodiment, the flow conduit is used to evacuate at least a portion of the air, inject an inert gas, and evacuate at least a portion of the injected inert gas from around the molded structure covered by the hermetically-sealable overwrap prior to forming a hermetic seal around the row of interconnected monodose pharmaceutical vials. In an embodiment, a first flow conduit is used to evacuate the at least a portion of the air and/or injected inert gas and a second flow conduit is used to inject the inert gas.

Figure 9A:
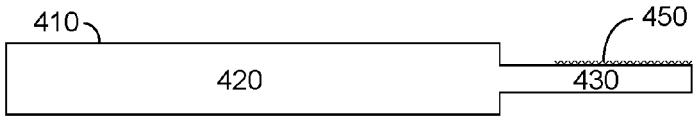
FIG. 9A shows a horizontal side view of an embodiment of a molded structure.
Figure 9B:
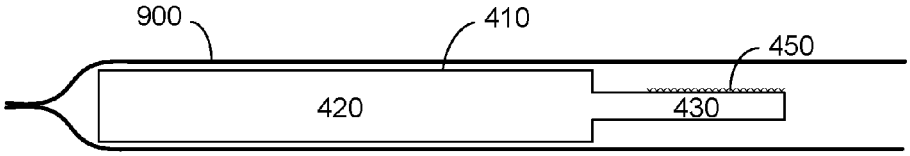
FIG. 9B shows a horizontal side view of an embodiment of a molded structure covered by a hermetically-sealable overwrap.
Figure 9C:
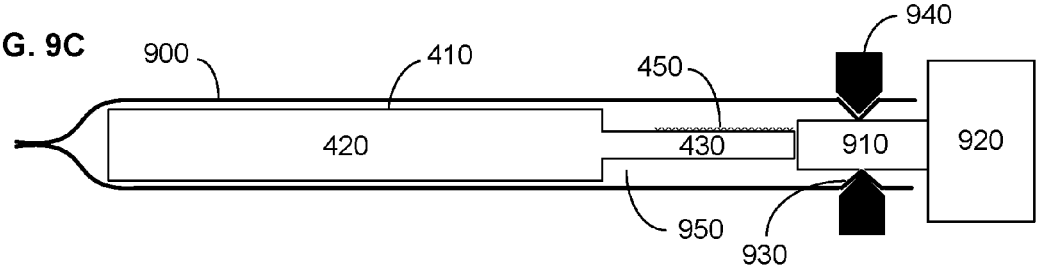
FIG. 9C shows a horizontal side view of an embodiment of a molded structure covered by a hermetically-sealable overwrap and a pressure seal.
Figure 9D:
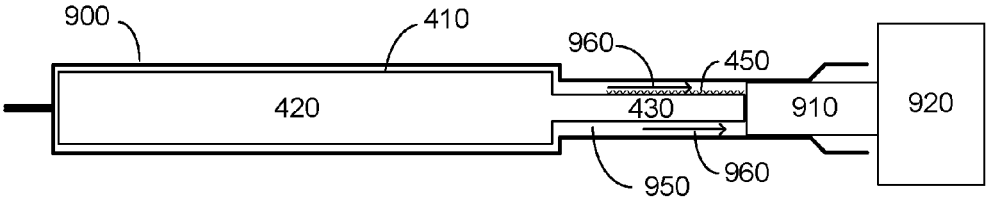
FIG. 9D shows a horizontal side view of an embodiment of a molded structure covered by a hermetically-sealable overwrap and evacuation of air.
Figure 9E:
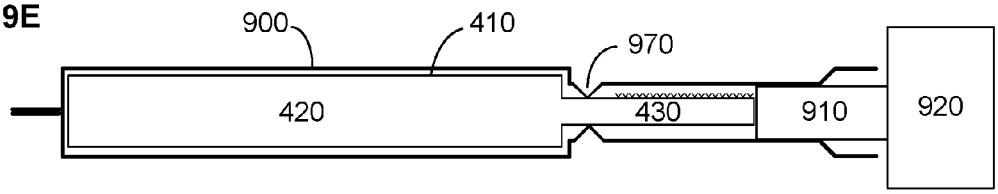
FIG. 9E shows a horizontal side view of an embodiment of a molded structure covered by a hermetically-sealable overwrap and forming a hermetic seal.
Figure 9F:
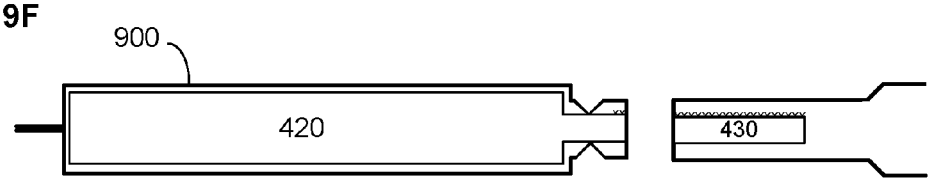
FIG. 9F shows a horizontal side view of an embodiment of a molded structure covered by a hermetically-sealable overwrap.

FIGS. 9A-9F illustrate further aspects of a method of packaging a multi-monodose container including a flow conduit. FIG. 9A is a schematic of a horizontal side-view of a molded structure 410 of a multi-monodose container. Molded structure 410 includes a first portion 420 including a row of interconnected monodose pharmaceutical vials and a second portion 430 including a textured surface pattern 450. In this non-limiting example, the textured surface pattern 450 is shown on one surface of the second portion 430, but it is contemplated that the textured surface pattern can be present on more than one surface of the second portion. FIGS. 9B-9F illustrate non-limiting steps in the packaging of the molded structure 410 of the multi-monodose container. FIG. 9B is a schematic of a horizontal side-view of molded structure 410 including a first portion 420, a second portion 430, and a textured surface pattern 450 covered by hermetically-sealable overwrap 900. In this non-limiting example, hermetically-sealable overwrap 900 is shown as a pouch covering molded structure 410, but a hermetically-sealable sleeve or hermetically-sealable top/bottom layers covering the molded structure are also contemplated. FIG. 9C is a schematic of a horizontal side-view of molded structure 410 including a first portion 420 and a second portion 430 covered by hermetically-sealable overwrap 900. Also shown is flow conduit 910 connected to vacuum source 920 and inserted into an opening defined by the hermetically-sealable overwrap 900 at a position adjacent to the textured surface pattern 450 of the second portion 430 of the molded structure 410. Sealer 940, e.g., a pressure sealer, is used to form a pressure seal 930 with a portion of the hermetically-sealable overwrap 900 and the inserted flow conduit 910 to form a hermetically-sealed pocket 950 around the molded structure 410. FIG. 9D is a schematic of a horizontal side-view of molded structure 410 including a first portion 420 and a second portion 430 covered by hermetically-sealable overwrap 900 and within the hermetically-sealed pocked 950. Also shown is air 960 being evacuated (arrows) from the hermetically-sealed pocket 950 through the flow conduit 910 connected to the vacuum source 920. The evacuated air 960 is shown at least partially flowing over the textured surface pattern 450 of the second portion 430 of the molded structure 410. FIG. 9E is a schematic of a horizontal side-view of molded structure 410 covered by hermetically-sealable overwrap 900. Also shown is a hermetical seal 970 formed around the row of interconnected monodose pharmaceutical vials associated with the first portion 420 of the molded structure 410. In this non-limiting example a portion of the hermetically-sealable overwrap 900 has been sealed/bonded to a surface of the second portion 430 of the molded structure while still connected to the flow conduit 910 and the vacuum source 920. FIG. 9F is a schematic of a horizontal side-view showing the separation of the second portion 430 of the molded structure from the first portion 420 of the molded structure. The first portion 420 including the row of interconnected monodose pharmaceutical vials is shown sealed within the hermetically-sealable overwrap 900.

Figure 10A:
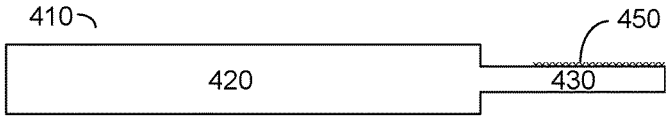
FIG. 10A shows a horizontal side view of an embodiment of a molded structure.
Figure 10B:
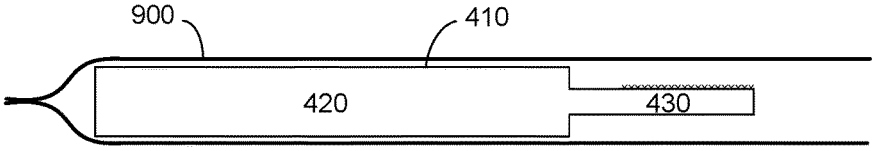
FIG. 10B shows a horizontal side view of an embodiment of a molded structure covered by a hermetically-sealable overwrap.
Figure 10C:
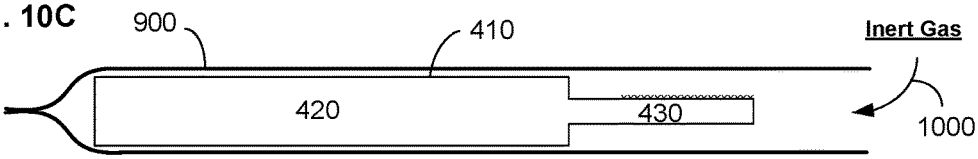
FIG. 10C shows a horizontal side view of an embodiment of a molded structure covered by a hermetically-sealable overwrap and injection of inert gas.
Figure 10D:
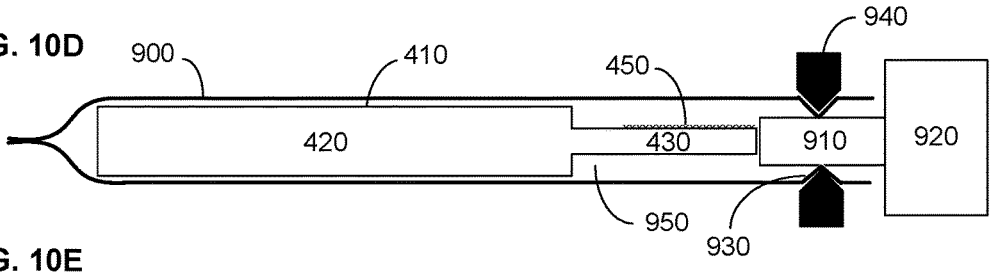
FIG. 10D shows a horizontal side view of an embodiment of a molded structure covered by a hermetically-sealable overwrap and a pressure seal.
Figure 10E:
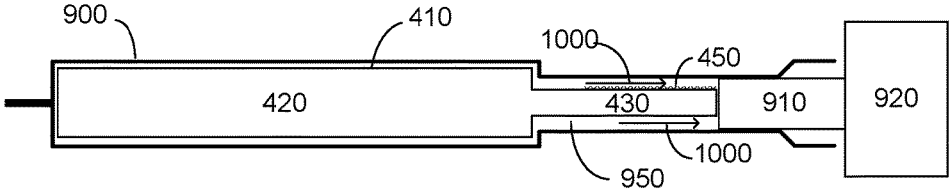
FIG. 10E shows a horizontal side view of an embodiment of a molded structure covered by a hermetically-sealable overwrap and evacuation of injected inert gas.
Figure 10F:
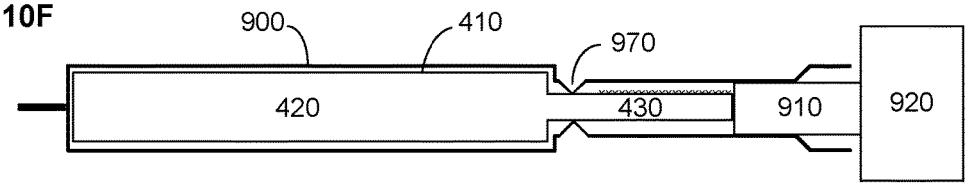
FIG. 10F shows a horizontal side view of an embodiment of a molded structure covered by a hermetically-sealable overwrap and forming a hermetic seal.
Figure 10G:
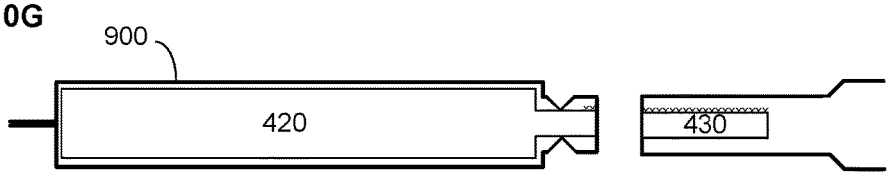
FIG. 10G shows a horizontal side view of an embodiment of a molded structure covered by a hermetically-sealable overwrap.

FIGS. 10A-10G illustrate further aspects of a method of packaging a multi-monodose container including a flow conduit. FIG. 10A is a schematic of a horizontal side-view of a molded structure 410 of a multi-monodose container. Molded structure 410 includes a first portion 420 including a row of interconnected monodose pharmaceutical vials and a second portion 430 including a textured surface pattern 450. In this non-limiting example, the textured surface pattern 450 is shown on one surface of the second portion 430, but it is contemplated that the textured surface pattern can be present on more than one surface of the second portion. FIGS. 10B-10G illustrate non-limiting steps in the packaging of the molded structure 410 of the multi-monodose container. FIG. 10B is a schematic of a horizontal side-view of molded structure 410 covered by hermetically-sealable overwrap 900. In this non-limiting example, hermetically-sealable overwrap 900 is shown as a pouch covering molded structure 410, but a hermetically-sealable sleeve or hermetically-sealable top/bottom layers covering the molded structure are also contemplated. FIG. 9C is a schematic of a horizontal side-view of molded structure 410 covered by hermetically-sealable overwrap 900 being injected with inert gas 1000. In an aspect, inert gas 1000 is nitrogen. In an aspect, inert gas 1000 is a noble gas, e.g., argon, neon, krypton, or xenon. In some embodiments, air surrounding the molded structure 410 has been evacuated from the hermetically-sealable overwrap 900 prior to injecting inert gas 1000. In some embodiments, air surrounding the molded structure 410 is purged or flushed from the hermetically-sealable overwrap 900 during the process of injecting inert gas 1000. FIG. 10D is a schematic of a horizontal side-view of molded structure 410 including a first portion 420 and a second portion 430 covered by hermetically-sealable overwrap 900. Also shown is flow conduit 910 connected to vacuum source 920 and inserted into an opening defined by the hermetically-sealable overwrap 900 at a position adjacent to the textured surface pattern 450 of the second portion 430 of the molded structure 410. Sealer 940, e.g., a pressure sealer, is used to form a pressure seal 930 with a portion of the hermetically-sealable overwrap 900 and the inserted flow conduit 910 to form a hermetically-sealed pocket 950 around the molded structure 410. FIG. 10E is a schematic of a horizontal side-view of molded structure 410 including a first portion 420 and a second portion 430 covered by hermetically-sealable overwrap 900 and within the hermetically-sealed pocked 950. Also shown is inert gas 1000 being evacuated (arrows) from the hermetically-sealed pocket 950 through the flow conduit 910 connected to the vacuum source 920. The evacuated inert gas 1000 is shown at least partially flowing over the textured surface pattern 450 of the second portion 430 of the molded structure 410. FIG. 10F is a schematic of a horizontal side-view of molded structure 410 covered by hermetically-sealable overwrap 900. Also shown is a hermetical seal 970 formed around the row of interconnected monodose pharmaceutical vials associated with the first portion 420 of the molded structure 410. In this non-limiting example a portion of the hermetically-sealable overwrap 900 has been sealed/bonded to a surface of the second portion 430 of the molded structure while still connected to the flow conduit 910 and the vacuum source 920. FIG. 10G is a schematic of a horizontal side-view showing the separation of the second portion 430 of the molded structure from the first portion 420 of the molded structure. The first portion 420 including the row of interconnected monodose pharmaceutical vials is shown sealed within the hermetically-sealable overwrap 900.

FIG. 11 illustrates further aspects of a method of packaging a multi-monodose container such as shown in FIG. 1. Method 100 includes forming a hermetic seal around the row of interconnected monodose pharmaceutical vials by bonding the hermetically-sealable overwrap to at least a portion of a surface of the molded structure, as shown in block 130. In an aspect, forming a hermetic seal includes heating-sealing, pressure-sealing, or chemically-sealing the hermetically-sealable overwrap. In an aspect, forming a hermetic seal includes at least one of folding, tucking, crimping, welding, fusing, soldering, heat sealing, blister sealing, or induction sealing.

In an aspect, forming a hermetic seal around the row of interconnected monodose pharmaceutical vials includes using a closing apparatus or sealing machine. In an aspect, the closing apparatus or sealing machine includes a heat-sealing machine, a blister sealing machine, or an induction sealing machine. In an aspect, the closing apparatus or sealing machine includes a band sealer, a hot sealer, a pinch style sealer, a glue sealer, or a rotary sealer. For example, the closing apparatus or sealing machine can include a heat sealing that uses heat to seal an overwrap, e.g., a plastic overwrap. For example, the closing apparatus or sealing machine can include a blister sealing machine which seals a filled plastic blister to a piece of coated carton-board by the application of heat. For example, the closing apparatus or sealing machine can include an induction sealing machine which seals a foil laminate to a container using an electromagnetic field. Other non-limiting examples of a closing apparatus or sealing machines include a folding machine, a tuck closing machine, a crimp closing machine, a weld sealing machine, a fusion sealing machine, a solder sealing machine, a rigid container sealing machine, or a bag or sack sealing machine. For example, the closing apparatus or sealing machine can include a bag sealing machine that uses an application of heat to seal an open edge of a hermetically-sealable pouch.

In an aspect, forming the hermetic seal around the row of interconnected monodose pharmaceutical vials includes using a closing apparatus or a sealing machine in the presence of a closing material. In an aspect, the closing material can include at least one of an adhesive, pressure sensitive tape, or gummed tape. In an aspect, a closing apparatus or sealing machine includes a glue sealing machine, a gummed tape sealing machine, or a tape sealing machine.

In an aspect, forming a hermetic seal around the row of interconnected monodose pharmaceutical vials comprises forming a gas-impermeable seal around the row of interconnected monodose pharmaceutical vials, as shown in block 1100. For example, the method can include heat-sealing a gas-impermeable overwrap to at least a portion of the surface of the molded structure to form a gas-impermeable seal around the row of interconnected monodose pharmaceutical vials. In an aspect, forming a hermetic seal around the row of interconnected monodose pharmaceutical vials comprises forming a vapor-impermeable seal around the row of interconnected monodose pharmaceutical vials, as shown in block 1110. For example, the method can include heat-sealing a vapor-impermeable overwrap to at least a portion of the surface of the molded structure to form a vapor barrier around the row of interconnected monodose pharmaceutical vials. In an aspect, forming a hermetic seal around the row of interconnected monodose pharmaceutical vials comprises forming a light-impermeable seal around the row of interconnected monodose pharmaceutical vials, as shown in block 1120. For example, the method can include heat-sealing a light-impermeable overwrap to at least a portion of the surface of the molded structure to form a light-impermeable seal around the row of interconnected monodose pharmaceutical vials. In an aspect, forming a hermetic seal around the row of interconnected monodose pharmaceutical vials comprises forming an electrostatic discharge-protective seal around the row of interconnected monodose pharmaceutical vials, as shown in block 1130. For example, the method can include heat-sealing an electrostatic discharge-protective overwrap to at least a portion of the surface of the molded structure to form an electrostatic discharge-protective barrier around the row of interconnected monodose pharmaceutical vials.

In an aspect, forming a hermetic seal around the row of interconnected monodose pharmaceutical vials comprises forming the hermetic seal around the row of interconnected monodose pharmaceutical vials under balanced or near-balanced pressure, as shown in block 1140. In an aspect, the method includes forming the hermetic seal around the row of interconnected monodose pharmaceutical vials at or near the pressure within the sealed monodose pharmaceutical vials. In an aspect, forming a hermetic seal around the row of interconnected monodose pharmaceutical vials comprises forming the hermetic seal around the row of interconnected monodose pharmaceutical vials under positive pressure, as shown in block 1150. For example, the method can include forming the hermetic seal around the row of interconnected monodose pharmaceutical vials at a pressure above that in the sealed monodose pharmaceutical vials.

FIG. 12 illustrates aspects of a method of packaging a multi-monodose container such as shown in FIG. 1. Method 100 includes bonding the hermetically-sealable overwrap to at least a portion of a surface of the molded structure, as shown in block 130. For example, the method includes physically bonding/sealing the hermetically-sealable overwrap, e.g., a foil/laminate, to the surface of the molded structure, e.g., a thermoplastic molded structure. In an aspect, bonding the hermetically-sealable overwrap to the at least a portion of the surface of the molded structure includes bonding the hermetically-sealable overwrap to a surface of the first portion of the molded structure proximal to the second portion of the molded structure, as shown in block 1200. For example, the method can include bonding a hermetically-sealable laminate overwrap to a portion of the molded structure proximal to the base of the row of interconnected monodose pharmaceutical vials. For example, the method can include bonding the hermetically-sealable overwrap at a point on the molded structure that will be associated with the first portion and the row of interconnected monodose pharmaceutical vials when the second portion is cut off. In an aspect, bonding the hermetically-sealable overwrap to the at least a portion of the surface of the molded structure includes bonding the hermetically-sealable overwrap to a surface of the first portion of the molded structure between each of the interconnected monodose pharmaceutical vials, as shown in block 1210. For example, the method can include bonding the hermetically-sealable overwrap along the surface of the molded structure between and around each of the monodose pharmaceutical vials to generate individually wrapped/sealed monodose pharmaceutical vials.

In an aspect, bonding the hermetically-sealable overwrap to the at least a portion of the surface of the molded structure includes applying heat to bond the hermetically-sealable overwrap to the at least a portion of the surface of the molded structure, as shown in block 1220. For example, bonding the hermetically-sealable overwrap to the at least a portion of the surface of the molded structure can include applying heat to melt the hermetically-sealable overwrap to the molded structure or vice versa. In an aspect, bonding the hermetically-sealable overwrap to the at least a portion of the surface of the molded structure includes applying pressure to bond the hermetically-sealable overwrap to the at least a portion of the surface of the molded structure, as shown in block 1230. In an aspect, bonding the hermetically-sealable overwrap to the at least a portion of the surface of the molded structure includes chemically-bonding the hermetically-sealable overwrap to the at least a portion of the surface of the molded structure, as shown in block 1240. For example, bonding the hermetically-sealable overwrap to the at least a portion of the surface of the molded structure can include the use of an adhesive or glue. For example, bonding the hermetically-sealable overwrap to the at least a portion of the surface of the molded structure can include use a chemical, e.g., a solvent, that "melts" the hermetically-sealable overwrap to the molded structure or vice versa.

In an embodiment, a method 100 of packaging a multi-monodose container includes at least partially perforating the hermetically-sealable overwrap to add a frangible portion to the hermetically-sealable overwrap between each of the interconnected monodose pharmaceutical vials, as shown in block 1250. For example, the method can include adding a frangible portion between each of the monodose pharmaceutical vials to allow for individual monodose pharmaceutical vials to be separated from the row of interconnected monodose pharmaceutical vials and opened without compromising the hermetic seal of the other monodose pharmaceutical vials in the row. In an aspect, the perforating of the hermetically-sealable overwrap can overlap with or align with a frangible perforation pattern associated with the molded structure, e.g., between each of the monodose pharmaceutical vials.

In an embodiment, method 100 of packaging a multi-monodose container includes applying at least one label having at least one sensor to an external surface of the hermetically-sealable overwrap, as shown in block 1260. For example, the method can include applying a label having information regarding the enclosed at least one pharmaceutical agent and at least one sensor to monitor an environment (s) encountered by the packaged multi-monodose container during transport and storage. In an aspect, the method includes applying at least one label having a temperature sensor to an external surface of the hermetically-sealable overwrap. Non-limiting aspects of labels and environmental sensors have been described above herein.

Method 100 of packaging a multi-monodose container includes separating the second portion of the molded structure from the first portion of the molded structure, as shown in block 140. For example, the method can include removing a tab including the textured surface pattern that constitutes the second portion of the molded structure. For example, the method can include removing a tab including the textured surface pattern from a region above or below the row of interconnected monodose pharmaceutical vials. See, e.g., FIGS. 6 and 7. In an aspect, separating the second portion from the first portion includes cutting the second portion from the first portion using a knife, saw, or other sharp blade. In an aspect, separating the second portion from the first portion includes cutting the second portion from the first portion using a hot wire or blade. For example, separating the second portion from the first portion can be facilitated by passing a hot wire or blade into the biocompatible thermoplastic material comprising the molded structure between the first portion and the second portion. In an aspect, separating the second portion from the first portion includes using a water jet. In an aspect, separating the second portion from first portion includes using a laser. In an aspect, the molded structure is formed with a frangible portion between the first portion and the second portion of the molded structure to facilitate ease of separation.

Figure 13:
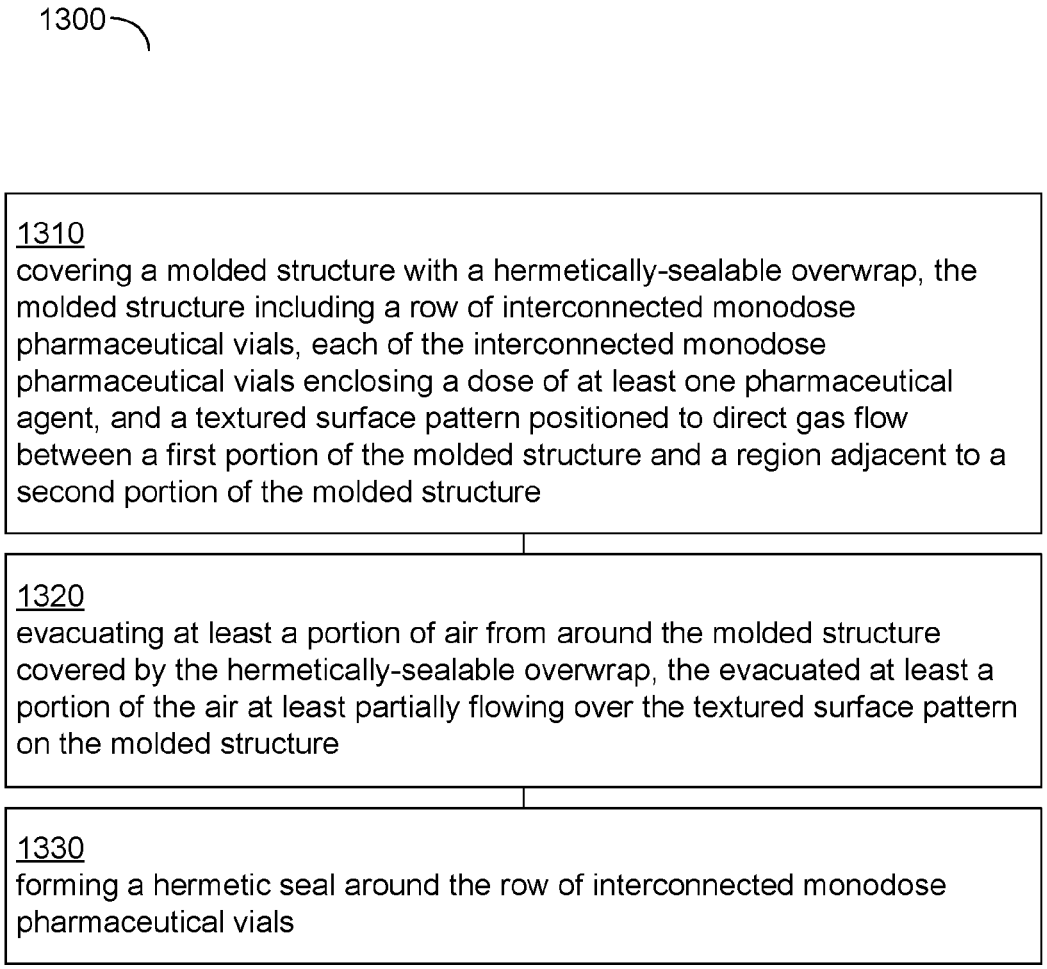
FIG. 13 is a block diagram showing a method of packaging a multi-monodose container.

FIG. 13 shows a block diagram of a method 1300 of packaging a multi-monodose container. Method 1300 includes in block 1310 covering a molded structure with a hermetically-sealable overwrap, the molded structure including a row of interconnected monodose pharmaceutical vials, each of the interconnected monodose pharmaceutical vials enclosing a dose of at least one pharmaceutical agent, and a textured surface pattern positioned to direct gas flow between a first portion of the molded structure and a region adjacent to a second portion of the molded structure. Method 1300 includes in block 1320 evacuating at least a portion of air from around the molded structure covered by the hermetically-sealable overwrap, the evacuated at least a portion of the air at least partially flowing over the textured surface pattern on the molded structure. Method 1300 includes in block 1330 forming a hermetic seal around the row of interconnected monodose pharmaceutical vials.

Method 1300 includes covering a molded structure with a hermetically-sealable overwrap. In some embodiments, the method includes covering the entirety of the molded structure. For example, the method can include covering the molded structure with a hermetically-sealable pouch sized to accommodate the entirety of the molded structure. In some embodiments, the method includes covering at least a portion of the molded structure. For example, at least a portion of the molded structure may extend out beyond an opening or edge of the hermetically-sealable overwrap.

FIG. 14 shows a block diagram illustrating further aspects of a method 1300 of packaging a multi-monodose container. In some embodiments, method 1300 includes in block 1400 inserting the molded structure into an opening defined by the hermetically-sealable overwrap. For example, the method of packaging a multi-monodose container can include inserting the molded structure forming the multi-monodose container through an opening of a hermetically-sealable pouch or bag. For example, the method of packaging a multi-monodose container can include inserting the molded structure forming the multi-monodose container through an opening at either end of a hermetically-sealable sleeve. In an embodiment, method 1300 includes in block 1410 positioning the molded structure between a first layer of hermetically-sealable overwrap and a second layer of hermetically-sealable overwrap; and sealing together one or more edges of the first layer and the second layer of the hermetically-sealable overwrap. For example, the method can include conveying the multi-monodose container between two layers of hermetically-sealable overwrap. In an aspect, method 1300 includes in block 1420 covering the molded structure with a hermetically-sealable pouch. In an aspect, method 1300 includes in block 1430 covering the molded structure with a hermetically-sealable sleeve. Non-limiting aspects of covering a molded structure with a hermetically-sealable overwrap have been described above herein.

In an aspect, a method 1300 of packaging a multi-monodose container includes in block 1440 covering the molded structure with a hermetically-sealable foil laminate. For example, the method can include covering the molded structure in a polyester/foil/polyethylene laminate. Other non-limiting aspects of foil laminates have been described above herein. In an aspect, the method includes covering the molded structure with a hermetically-sealable overwrap formed from at least one of polyester, foil, polypropylene, cast polypropylene, polyethylene, high-density polyethylene, metallocene polyethylene, linear low density polyethylene, or metalized film. In an aspect, method 1300 includes in block 1450 covering the molded structure with a gas-impermeable overwrap. In an aspect, method 1300 includes in block 1460 covering the molded structure with a vapor-impermeable overwrap. In an aspect, method 1300 includes in block 1470 covering the molded structure with a light-impermeable overwrap. In an aspect, method 1300 includes in block 1480 covering the molded structure with an electrostatic discharge-protective overwrap. Non-limiting aspects of gas-impermeable, vapor-impermeable, light-impermeable, and/or electrostatic discharge protective hermetically-sealable overwraps have been described above herein.

Figure 15:
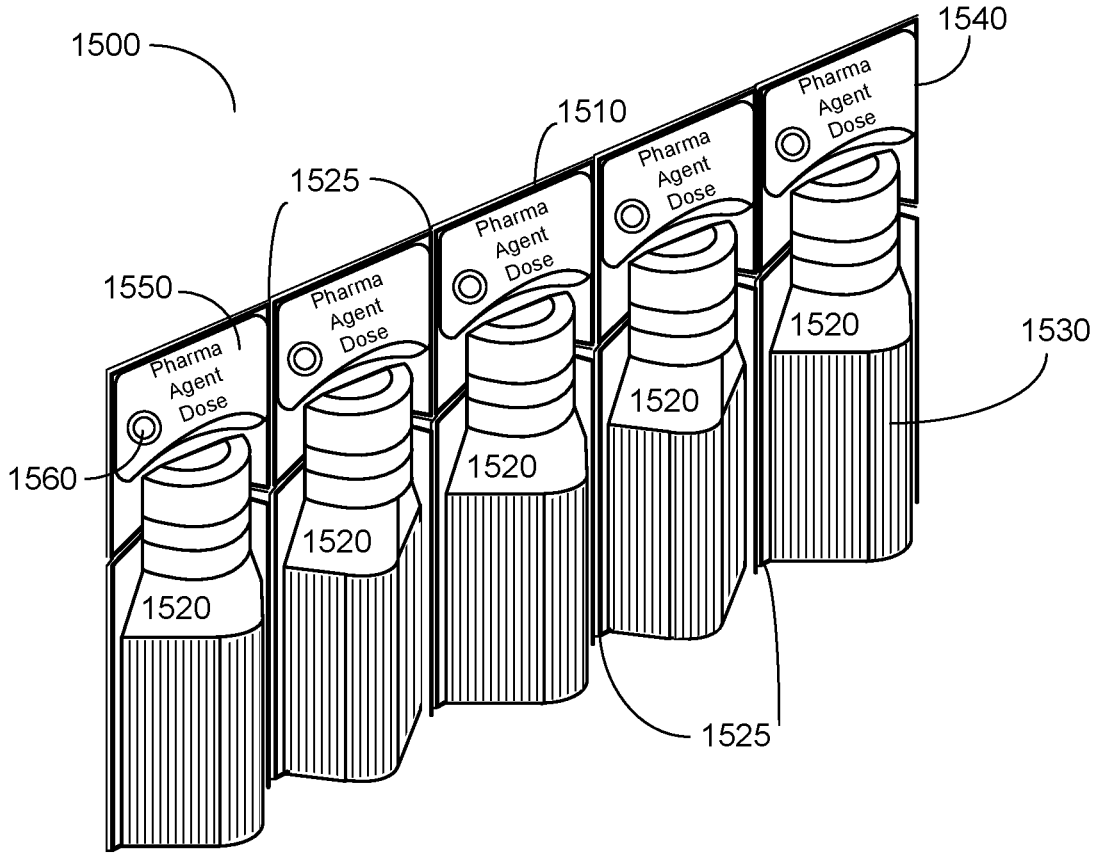
FIG. 15 is a schematic of an embodiment of a multi-monodose container including a molded structure with a row of interconnected monodose pharmaceutical vials and a textured surface pattern.

Method 1300 of packaging a multi-monodose container includes covering a molded structure with a hermetically-sealable overwrap. The molded structure of the multi-monodose container includes a row of interconnected monodose pharmaceutical vials enclosing a dose of at least one pharmaceutical agent and a textured surface pattern positioned to direct gas flow between a first portion of the molded structure and a region adjacent to a second portion of the molded structure. FIG. 15 illustrates aspects of a molded structure. FIG. 15 is a schematic drawing of multi-monodose container 1500 including a molded structure 1510 including a row of interconnected monodose pharmaceutical vials 1520, each of the interconnected monodose pharmaceutical vials 1520 enclosing a dose of at least one pharmaceutical agent, and a textured surface pattern 1530 positioned to direct gas flow between a first portion of the molded structure 1510 and a region adjacent to a second portion of the molded structure 1510.

In an aspect, the molded structure 1510 including the row of interconnected monodose pharmaceutical vials 1520 and the textured surface pattern 1530 is formed by a blow-fill-seal manufacturing process. In an aspect, molded structure 1510 including the row of interconnected monodose pharmaceutical vials 1520 and the textured surface pattern 1530 is formed by a blow molding manufacturing process. In an aspect, molded structure 1510 including the row of interconnected monodose pharmaceutical vials 1520 and the textured surface pattern 1530 is formed by an injection molding manufacturing process. In an aspect, molded structure 1510 including the row of interconnected monodose pharmaceutical vials 1520 and the textured surface pattern 1530 is formed from at least one biocompatible material. In an aspect, molded structure 1510 including the row of interconnected monodose pharmaceutical vials 1520 and the textured surface pattern 1530 is formed from at least one thermoplastic material. In an aspect, molded structure 1510 including the row of interconnected monodose pharmaceutical vials 1520 and the textured surface pattern 1530 is formed from at least one biocompatible thermoplastic material. Non-limiting aspects of forming a molded structure from biocompatible, thermoplastic, and biocompatible thermoplastic materials have been described above herein.

In an aspect, the row of interconnected monodose pharmaceutical vials 1520 includes two or more interconnected monodose pharmaceutical vials. In an aspect, the row of interconnected monodose pharmaceutical vials 1520 includes 2 to 30 interconnected monodose pharmaceutical vials. For example, the row of interconnected monodose pharmaceutical vials can include 2 vials, 3 vials, 4 vials, 5 vials, 6 vials, 7 vials, 8 vials, 9 vials, 10 vials, 11 vials, 12 vials, 13 vials 14 vials, 15 vials, 16 vials, 17 vials, 18 vials, 19 vials, 20 vials, 21 vials, 22 vials, 23 vials, 24 vials, 25 vials, 26 vials, 27 vials 28 vials, 29 vials, or 30 vials. In an aspect, each of the interconnected monodose pharmaceutical vials 1520 is square, triangular, hexagonal, or polygonal in horizontal cross-section, non-limiting examples of which are shown in FIGS. 5A-5C.

In an aspect, each of the interconnected monodose pharmaceutical vials 1520 encloses a dose of at least one pharmaceutical agent. In an aspect, the dose of the at least one pharmaceutical agent is formulated for at least one of oral or parenteral administration. In an aspect, the dose of the at least one pharmaceutical agent includes a dose of at least one vaccine. In an aspect, the dose of the at least one pharmaceutical agent includes a dose of at least one therapeutic agent. In an aspect, the dose of the at least one pharmaceutical agent is in a liquid form. In an aspect, the dose of the at least one pharmaceutical agent is in a lyophilized form. Non-limiting examples of vaccines and therapeutic agents have been described above herein.

In an aspect, each of the interconnected monodose pharmaceutical vials 1520 includes an internal volume holding the dose of the at least one pharmaceutical agent. In an aspect, the internal volume of each of the monodose pharmaceutical vials 1520 is about 0.2 milliliters to about 6.0 milliliters. For example, the internal volume of each of the monodose pharmaceutical vials is 0.2 mL, 0.3 mL, 0.4 mL, 0.5 mL, 0.6 mL, 0.7 mL, 0.8 mL, 0.9 mL, 1.0 mL, 1.1 mL, 1.2 mL, 1.3 mL, 1.4 mL, 1.5 mL, 1.6 mL, 1.7 mL, 1.8 mL, 1.9 mL, 2.0 mL, 2.1 mL, 2.2 mL, 2.3 mL, 2.4 mL, 2.5 mL, 2.6 mL, 2.7 mL, 2.8 mL, 2.9 mL, 3.0 mL, 3.1 mL, 3.2 mL, 3.3 mL, 3.4 mL, 3.5 mL, 3.6 mL, 3.7 mL, 3.8 mL, 3.9 mL, 4.0 mL, 4.1 mL, 4.2 mL, 4.3 mL, 4.4 mL, 4.5 mL, 4.6 mL, 4.7 mL, 4.8 mL, 4.9 mL, 5.0 mL, 5.1 mL, 5.2 mL, 5.3 mL, 5.4 mL, 5.5 mL, 5.6 mL, 5.7 mL, 5.8 mL, 5.9 mL, or 6.0 mL.

In an aspect, the internal volume holding the dose of the at least one pharmaceutical agent includes an inert gas-filled head space. For example, the head space above a dose of at least one pharmaceutical agent in a liquid or lyophilized form may include an inert gas, e.g., nitrogen or a noble gas.

In an aspect, each of the interconnected monodose pharmaceutical vials 1520 includes a closure 1540 covering an access portion. In an aspect, the access portion is an opening or aperture defined by the walls of the monodose pharmaceutical vial. In some embodiments, the closure includes a removable cap. In some embodiments, the removable cap is snapped or twisted off to reveal an access portion of the monodose pharmaceutical vial. For example, the removable cap can be snapped or twisted off to reveal an opening or aperture through which the enclosed at least one pharmaceutical agent can be accessed. In an aspect, the closure includes a needle-penetrable closure. For example, the closure can include a needle-penetrable material through which a needle attached to a syringe is able to penetrate to access the internal volume of a monodose pharmaceutical vial. For example, the closure can include a removable cap that is snapped or twisted off to reveal a needle-penetrable material through which a needle attached to a syringe can access the internal volume of a monodose pharmaceutical vial.

In an aspect, each of the interconnected monodose pharmaceutical vials 1520 includes a needle-penetrable access portion. In an aspect, the needle-penetrable access portion is configured to allow passage of a needle into the internal volume of a monodose pharmaceutical vial through a needle-penetrable material forming at least a portion of the multi-monodose container. For example, the needle-penetrable access portion can include a needle-penetrable access portion of the thermoplastic material used to form the multi-monodose container. For example, the top of a blow-fill-sealed vial can include a needle-penetrable access portion. For example, the needle-penetrable access portion may include a sealed portion formed by fusing or heat sealing the walls at an open end of each of the monodose pharmaceutical vials to cover an access portion. For example, a sealed portion formed by fusing or heat sealing the walls at an open end of each of the monodose pharmaceutical vials may further be needle-penetrable to allow a needle to pass through the sealed portion to access the internal volume of the vial. In some embodiments, each of the interconnected monodose pharmaceutical vials forming the multi-monodose container can include a removable cap that once removed uncovers a needle-penetrable access portion. In an aspect, the needle-penetrable access portion includes an insert. For example, the needle-penetrable access portion can include an insert that is added to the blow-molded or injection-molded row of interconnected monodose pharmaceutical vials. In an aspect, the needle-penetrable access portion includes a rubber needle-penetrable access portion. For example, the needle-penetrable access portion can include a rubber septum inserted into an access portion and held in place with an aluminum seal crimped around a tapered neck region of the vial. In an aspect, the rubber needle-penetrable access portion is further protected with a plastic flip-off cap.

In an aspect, at least one of the monodose pharmaceutical vials 1520 is attached through an articulating joint 1525 to at least one adjacent monodose pharmaceutical vial 1520, the articulating joint 1525 sufficiently flexible to reversibly mate a planar outer surface of the at least one of the monodose pharmaceutical vials 1520 with a planar outer surface of the at least one adjacent monodose pharmaceutical vial 1520. See, e.g., FIGS. 22A-22E for a non-limiting example.

The molded structure 1510 of the multi-monodose container 1500 includes a textured surface pattern 1530. In an aspect, at least a portion of the textured surface pattern 1530 includes channels aligned parallel to the directed gas flow between the first portion of the molded structure and the region adjacent to the second portion of the molded structure. In an aspect, the textured surface pattern 1530 is on an outer surface of at least one of the interconnected monodose pharmaceutical vials 1520 as shown in FIG. 15. In an aspect, the textured surface pattern is on a surface of the molded structure adjacent to the row of interconnected monodose pharmaceutical vials. In an aspect, the textured surface pattern is on a tab portion adjacent to a top portion of the row of interconnected monodose pharmaceutical vials, as exemplified in FIG. 7. In an aspect, the textured surface pattern is on a tab portion adjacent to a bottom portion of the row of interconnected monodose pharmaceutical vials, as exemplified in FIG. 6. In some embodiments, the tab portion including the textured surface pattern and adjacent to either the top or the bottom of the row of interconnected monodose pharmaceutical vials is separated from the remaining part of the molded structure during the packaging process.

In an aspect, the textured surface pattern 1530 positioned to direct gas flow between the first portion of the molded structure 1510 and the region adjacent to the second portion of the molded structure 1510 comprises a debossed surface pattern positioned to direct gas flow between the first portion of the molded structure and the region adjacent to the second portion of the molded structure 1510. In an aspect, the textured surface pattern 1530 positioned to direct gas flow between the first portion of the molded structure 1510 and the region adjacent to the second portion of the molded structure 1510 comprises an embossed surface pattern positioned to direct gas flow between the first portion of the molded structure and the region adjacent to the second portion of the molded structure 1510. Non-limiting aspects of debossing and embossing have been described above herein.

In an aspect, the molded structure 1510 includes at least one label 1550 including at least one sensor 1560. In an aspect, each of the interconnected monodose pharmaceutical vials 1520 includes a label 1550 including at least one of a temperature sensor, a moisture sensor, a light sensor, or an oxygen sensor. Non-limiting aspects of labels and sensor associated with labels have been described above herein.

Figure 16:
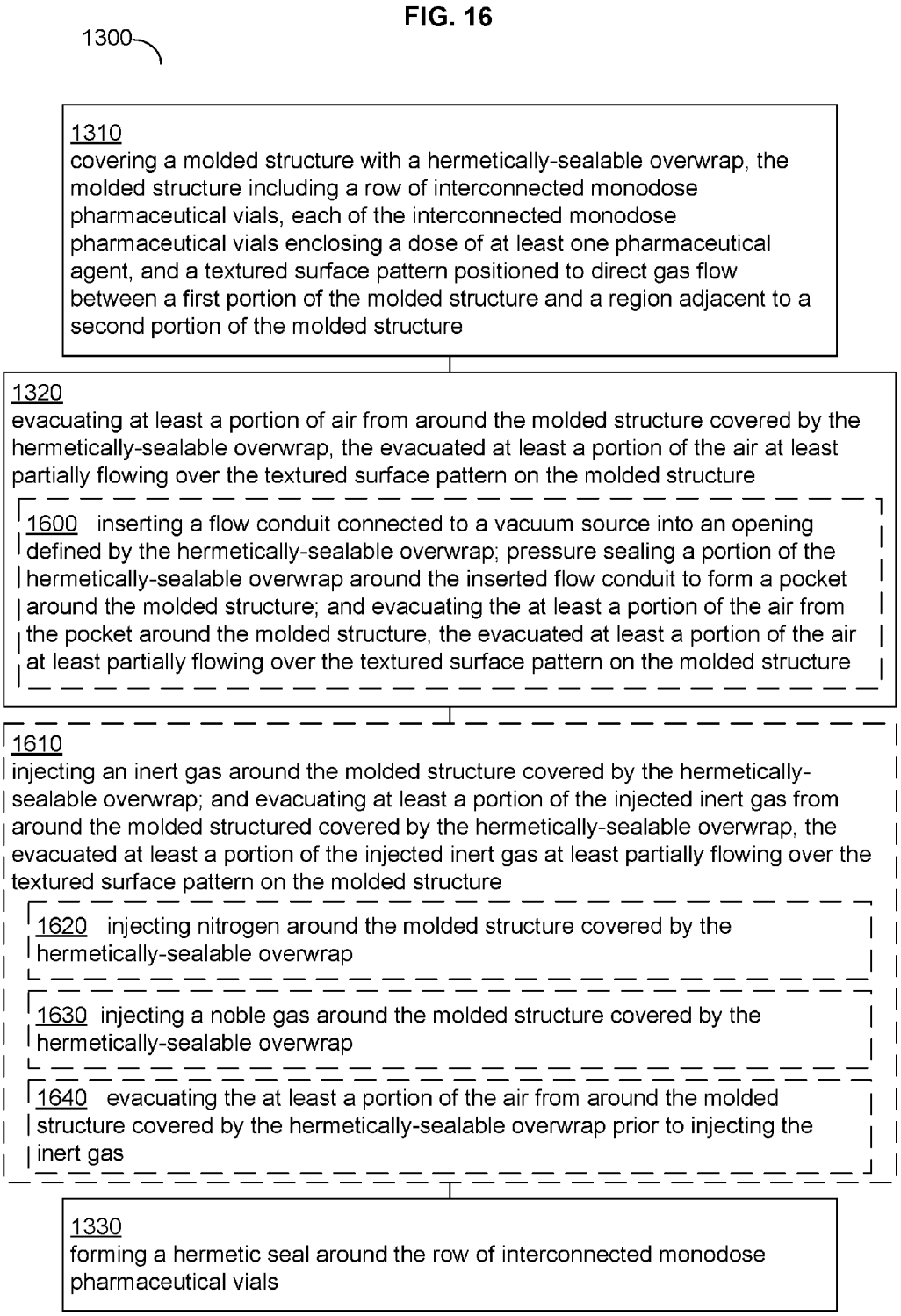
FIG. 16 shows aspects of a method of packaging a multi-monodose container such as illustrated in FIG. 13.

FIG. 16 is a block diagram illustrating aspects of a method of packaging a multi-monodose container such as shown in FIG. 13. Method 1300 of packaging a multi-monodose container includes in block 1320 evacuating at least a portion of air from around the molded structure covered by the hermetically-sealable overwrap, the evacuated at least a portion of the air at least partially flowing over the textured surface pattern on the molded structure. For example, the method includes reducing the overall volume of the packaged multi-monodose container by removing at least a portion of the air from within the hermetically-sealable overwrap prior to closure. In some embodiments, the method includes using a vacuum source to evacuate the at least a portion of the air around the multi-monodose container. In an aspect, method 1300 of packaging a multi-monodose container includes in block 1600 inserting a flow conduit connected to a vacuum source into an opening defined by the hermetically-sealable overwrap; pressure sealing a portion of the hermetically-sealable overwrap around the inserted flow conduit to form a pocket around the molded structure; and evacuating the at least a portion of the air from the pocket around the molded structure, the evacuated at least a portion of the air at least partially flowing over the textured surface pattern on the molded structure.

In an aspect, a method of packaging a multi-monodose container in a hermetically-sealable overwrap includes the use of an inert gas. For example, the method can include injecting an inert gas into the hermetically-sealable overwrap and around the multi-monodose container prior to sealing the multi-monodose container therein. In some embodiments, method 1300 includes injecting an inert gas around the molded structure covered by the hermetically-sealable overwrap; and evacuating at least a portion of the injected inert gas from around the molded structure covered by the hermetically-sealable overwrap, the evacuated at least a portion of the injected inert gas at least partially flowing over the textured surface pattern on the molded structure, as shown in block 1610. For example, the method can include generating an oxygen-free and/or inert atmosphere surrounding the molded structure and the row of interconnected monodose pharmaceutical vials by injecting an inert gas into the hermetically-sealable overwrap covering the molded structure. In an aspect, method 1300 includes injecting nitrogen around the molded structure covered by the hermetically-sealable overwrap, as shown in block 1620. In an aspect, method 1300 includes injecting a noble gas around the molded structure covered by the hermetically-sealable overwrap, as shown in block 1630. For example, the method can include injecting at least one of argon, neon, krypton, or xenon into the hermetically-sealable overwrap.

In an embodiment, method 1300 of packaging a multi-monodose container includes evacuating the at least a portion of the air from around the molded structure covered by the hermetically-sealable overwrap prior to injecting the inert gas, as shown in block 1640. For example, the method can include sucking at least a portion of the air from around the molded structure covered by the hermetically-sealable overwrap prior to injecting the inert gas. For example, the method can include exchanging the air from around the molded structure covered by the hermetically-sealable overwrap with the inert gas. For example, the method can include purging or flushing the air from around the molded structure covered by the hermetically-sealable overwrap with the inert gas.

In some embodiments, the method includes using a vacuum source to vacuum seal the multi-monodose container in the presence of an inert gas. For example, a method of packaging a multi-monodose container can include inserting a flow conduit connected to a vacuum source into an opening defined by the hermetically-sealable overwrap at a position adjacent to the textured surface pattern on the second portion of the molded structure; pressure sealing a portion of the hermetically-sealable overwrap around the inserted flow conduit to form a pocket around the molded structure; and evacuating at least a portion of the injected inert gas from the pocket around the molded structure, the evacuated at least a portion of the injected inert gas at least partially flowing over the textured surface pattern on the molded structure. In an embodiment, the flow conduit is used to evacuate at least a portion of the air, inject an inert gas, and evacuate at least a portion of the injected inert gas from around the molded structure covered by the hermetically-sealable overwrap prior to forming a hermetic seal around the row of interconnected monodose pharmaceutical vials. In an embodiment, a first flow conduit is used to evacuate the at least a portion of the air and/or injected inert gas and a second flow conduit is used to inject the inert gas.

Figure 17:
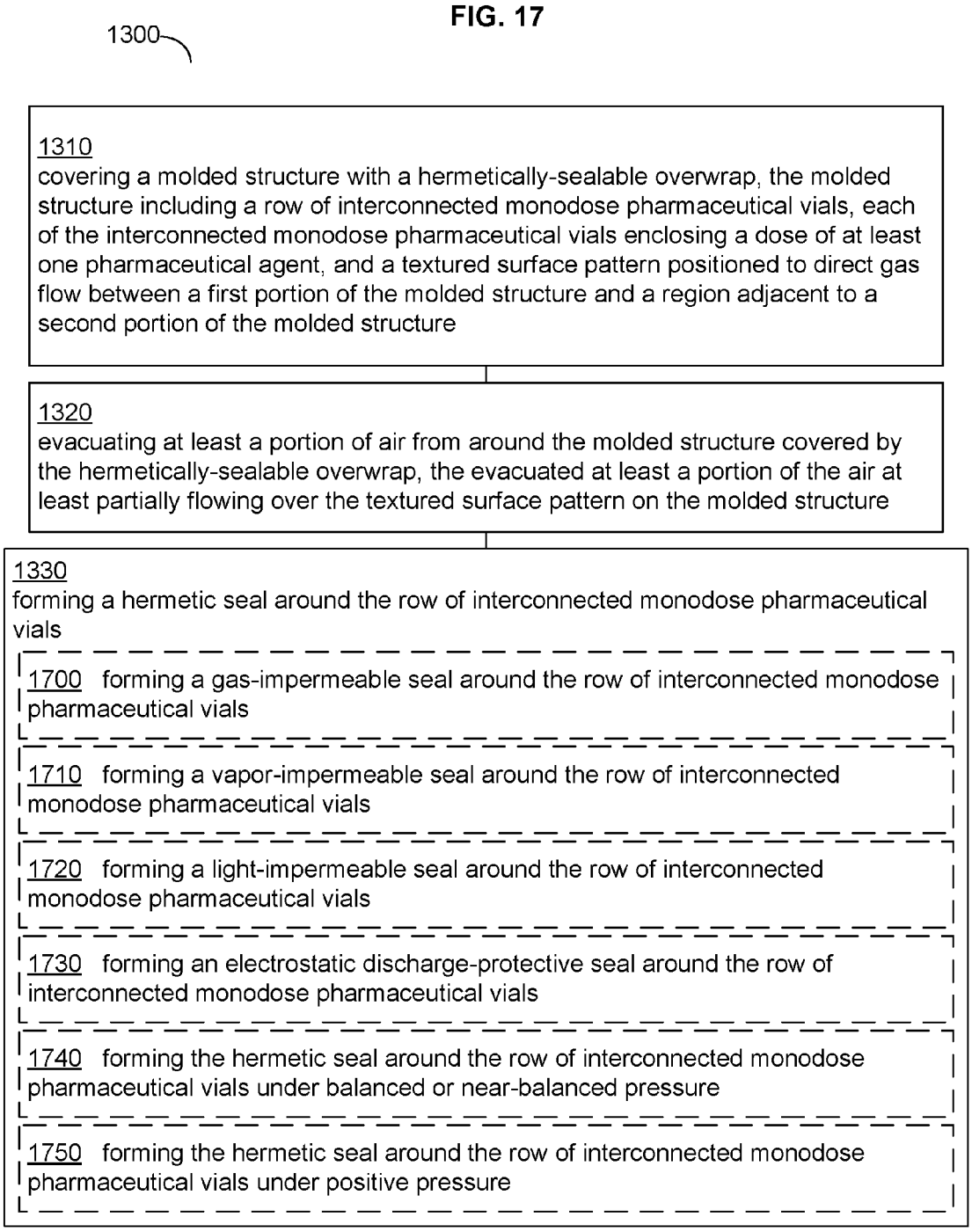
FIG. 17 illustrates aspects of a method of packaging a multi-monodose container such as depicted in FIG. 13.

FIG. 17 is a block diagram illustrating aspects of a method of packaging a multi-monodose container such as shown in FIG. 13. Method 1300 includes in block 1330 forming a hermetic seal around the row of interconnected monodose pharmaceutical vials. In an aspect, forming a hermetical seal around the row of interconnected monodose pharmaceutical vials comprises in block 1700 forming a gas-impermeable seal around the row of interconnected monodose pharmaceutical vials. In an aspect, forming a hermetical seal around the row of interconnected monodose pharmaceutical vials comprises in block 1710 forming a vapor-impermeable seal around the row of interconnected monodose pharmaceutical vials. In an aspect, forming a hermetical seal around the row of interconnected monodose pharmaceutical vials includes in block 1720 forming a light-impermeable seal around the row of interconnected monodose pharmaceutical vials. In an aspect, forming a hermetical seal around the row of interconnected monodose pharmaceutical vials comprises in block 1730 forming an electrostatic discharge-protective seal around the row of interconnected monodose pharmaceutical vials. In an aspect, forming a hermetical seal around the row of interconnected monodose pharmaceutical vials comprises in block 1740 forming the hermetical seal around the row of interconnected monodose pharmaceutical vials under balanced or near-balanced pressure. In an aspect, forming a hermetical seal around the row of interconnected monodose pharmaceutical vials comprises in block 1750 forming the hermetical seal around the row of interconnected monodose pharmaceutical vials under positive pressure.

FIG. 18 is a block diagram illustrating aspects of a method of packaging a multi-monodose container such as shown in FIG. 13. Method 1300 further includes in block 1330 forming a hermetic seal around the row of interconnected monodose pharmaceutical vials. In an aspect, forming the hermetic seal around the row of interconnected monodose pharmaceutical vials comprises in block 1800 forming a hermetic seal around the entirety of the molded structure including the row of interconnected monodose pharmaceutical vials. In an aspect, forming the hermetic seal around the row of interconnected monodose pharmaceutical vials comprises in block 1810 bonding at least a portion of the hermetically-sealable overwrap to at least a portion of a surface of the molded structure. In an aspect, forming the hermetic seal around the row of interconnected monodose pharmaceutical vials comprises in block 1820 bonding at least a portion of the hermetically-sealable overwrap to at least a portion of a surface of the molded structure around and between each of the interconnected monodose pharmaceutical vials. In an aspect, forming the hermetic seal around the row of interconnected monodose pharmaceutical vials comprises in block 1830 applying heat to the hermetically-sealable overwrap to form the hermetic seal around the row of interconnected monodose pharmaceutical vials. In an aspect, forming the hermetic seal around the row of interconnected monodose pharmaceutical vials comprises in block 1840 applying pressure to the hermetically-sealable overwrap to form the hermetic seal around the row of interconnected monodose pharmaceutical vials. In an aspect, forming the hermetic seal around the row of interconnected monodose pharmaceutical vials comprises in block 1850 chemically-bonding the hermetically-sealable overwrap to form the hermetic seal around the row of interconnected monodose pharmaceutical vials.

In an aspect, method 1300 includes in block 1860 separating the first portion of the molded structure from the second portion of the molded structure. In an aspect, the method includes separating the hermetically-sealed row of interconnected monodose pharmaceutical vials from a tab including the textured surface pattern. For example, the method can include separating the hermetically-sealed row of interconnected monodose pharmaceutical vials from a tab located at either the top or the bottom of the molded structure, the tab including the textured surface pattern.

In an aspect, method 1300 includes in block 1870 at least partially perforating the hermetically-sealable overwrap to add a frangible portion to the hermetically-sealable overwrap between each of the monodose pharmaceutical vials in the row of interconnected monodose pharmaceutical vials.

In an aspect, method 1300 includes in block 1880 applying at least one label having at least one sensor to an external surface of the hermetically-sealable overwrap. For example, the method can include applying at least one label including information regarding the identity and use of a pharmaceutical agent as well as a temperature sensor to monitor temperature conditions during transport and storage of the packaged multi-monodose container. Non-limiting aspects of labeling with sensors have been described above herein.

Figure 19:
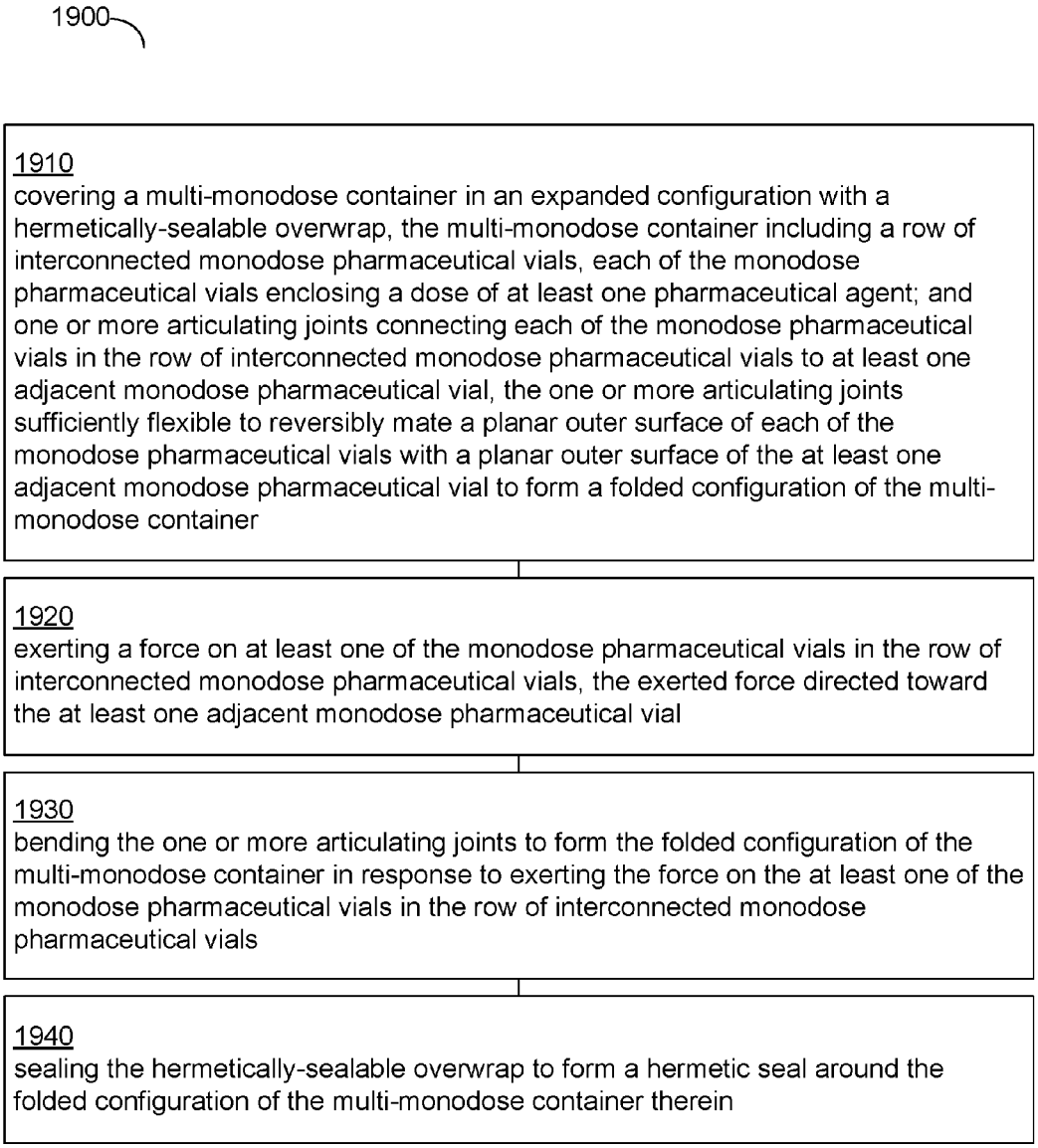
FIG. 19 is a block diagram showing a method of packaging a multi-monodose container.

FIG. 19 illustrates a method of packaging a foldable container. FIG. 19 is a block diagram illustrating method 1900 of packaging a foldable container. Method 1900 includes in block 1910 covering a multi-monodose container in an expanded configuration with a hermetically-sealable overwrap, the multi-monodose container including a row of interconnected monodose pharmaceutical vials, each of the monodose pharmaceutical vials enclosing a dose of at least one pharmaceutical agent; and one or more articulating joints connecting each of the monodose pharmaceutical vials in the row of interconnected monodose pharmaceutical vials to at least one adjacent monodose pharmaceutical vial, the one or more articulating joints sufficiently flexible to reversibly mate a planar outer surface of each of the monodose pharmaceutical vials with a planar outer surface of the at least one adjacent monodose pharmaceutical vial to form a folded configuration of the multi-monodose container. Method 1900 includes in block 1920 exerting a force on at least one of the monodose pharmaceutical vials in the row of interconnected monodose pharmaceutical vials, the exerted force directed toward the at least one adjacent monodose pharmaceutical vial. Method 1900 includes in block 1930 bending the one or more articulating joints to form the folded configuration of the multi-monodose container in response to exerting the force on the at least one of the monodose pharmaceutical vials in the row of interconnected monodose pharmaceutical vials. Method 1900 includes in block 1940 sealing the hermetically-sealable overwrap to form a hermetic seal around the folded configuration of the multi-monodose container therein.

FIG. 20 is a block diagram illustrating further aspects of a method 1900 of packaging a foldable container. Method 1900 includes covering a multi-monodose container with a hermetically-sealable overwrap 1910. In an aspect, covering a multi-monodose container in an expanded configuration with a hermetically-sealable overwrap includes in block 2000 inserting the multi-monodose container in an expanded configuration through an opening defined by the hermetically-sealable overwrap. For example, the multi-monodose container in an expanded configuration can be inserted into a hermetically-sealable overwrap by at least one of moving the multi-monodose container in the expanded configuration into the hermetically-sealable overwrap (e.g., a hermetically-sealable pouch), moving the hermetically-sealable overwrap over the multi-monodose container in the expanded configuration, or a combination thereof. In an aspect, covering a multi-monodose container in an expanded configuration with a hermetically-sealable overwrap includes in block 2010 positioning the multi-monodose container in an expanded configuration between a first layer of hermetically-sealable overwrap and a second layer of hermetically-sealable overwrap; and sealing together one or more edges of the first layer and the second layer of the hermetically-sealable overwrap. For example, the multi-monodose container in an expanded configuration can be moved between two spooling sheets of hermetically-sealable overwrap, e.g., foil laminate, and sealed on at least one edge to at least partially enclose the multi-monodose container therein. In an aspect, covering a multi-monodose container in an expanded configuration with a hermetically-sealable overwrap includes in block 2020 covering the multi-monodose container in an expanded configuration with a hermetically-sealable pouch. In an aspect, covering a multi-monodose container in an expanded configuration with a hermetically-sealable overwrap includes in block 2030 covering the multi-monodose container in an expanded configuration with a hermetically-sealable sleeve.

Figure 21:
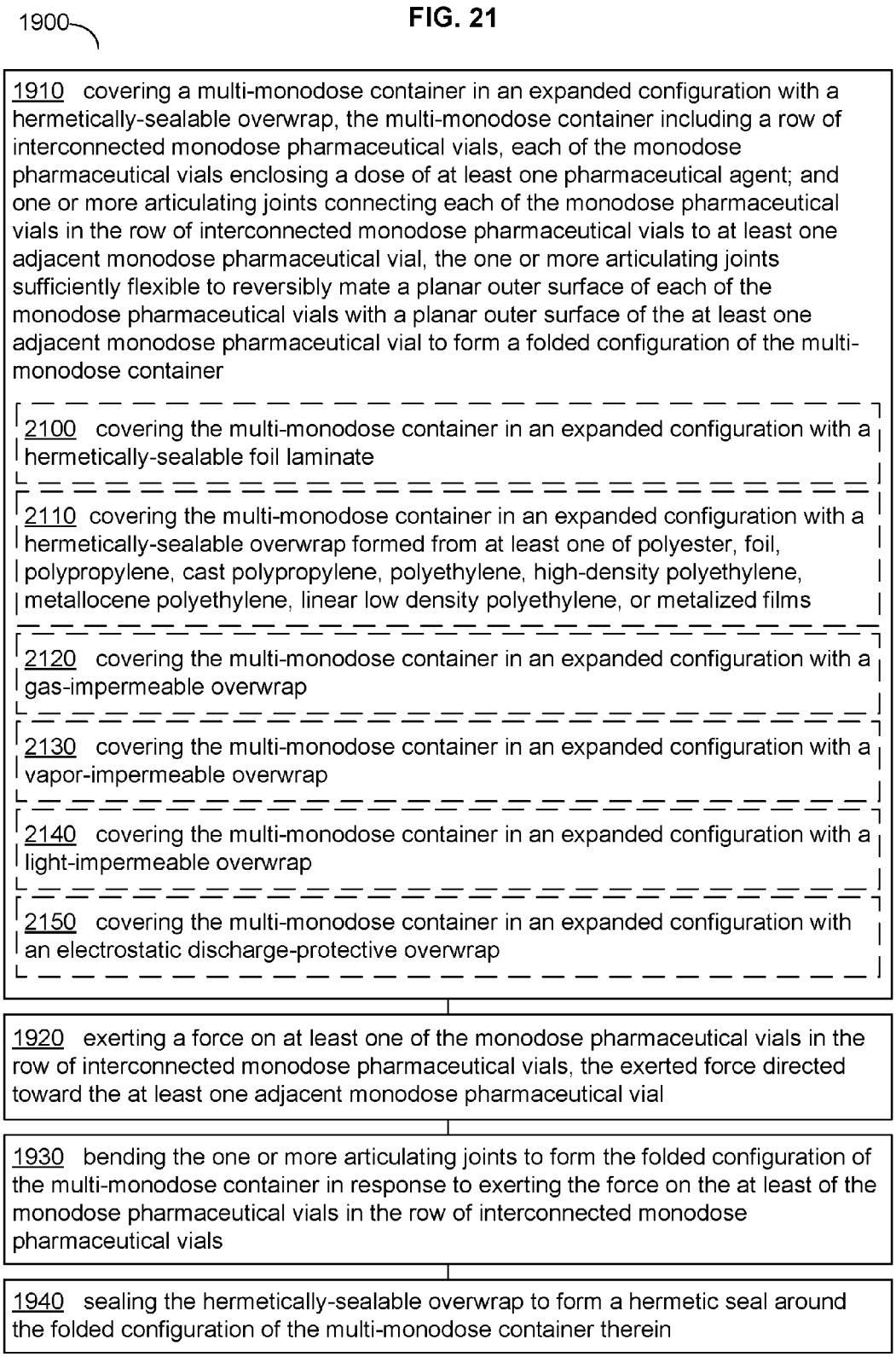
FIG. 21 illustrates aspects of a method of packaging a multi-monodose container such as depicted in FIG. 19.

FIG. 21 is a block diagram illustrating further aspects of a method of packaging a foldable container 1900. In an aspect, covering the multi-monodose container in an expanded configuration includes in block 2100 covering the multi-monodose container in an expanded configuration with a hermetically-sealable foil laminate. In an aspect, covering the multi-monodose container in an expanded configuration includes in block 2110 covering the multi-monodose container in an expanded configuration with a hermetically-sealable overwrap formed from at least one of polyester, foil, polypropylene, cast polypropylene, polyethylene, high-density polyethylene, metallocene polyethylene, linear low density polyethylene, or metalized film. In an aspect, covering the multi-monodose container in an expanded configuration includes in block 2120 covering the multi-monodose container in an expanded configuration with a gas-impermeable overwrap. In an aspect, covering the multi-monodose container in an expanded configuration includes in block 2130 covering the multi-monodose container in an expanded configuration with a vapor-impermeable overwrap. In an aspect, covering the multi-monodose container in an expanded configuration includes in block 2140 covering the multi-monodose container in an expanded configuration with a light-impermeable overwrap. In an aspect, covering the multi-monodose container in an expanded configuration includes in block 2150 covering the multi-monodose container in an expanded configuration with an electrostatic discharge-protective overwrap. Non-limiting aspects of covering a multi-monodose container with a hermetically-sealable overwrap have been described above herein and are applicable to covering a multi-monodose container in an expanded configuration with a hermetically-sealable overwrap.

FIGS. 22A-22E illustrate aspects of a multi-monodose container including a row of interconnected monodose pharmaceutical vials connected to one another through one or more articulating joints. FIG. 22A is a schematic of a multi-monodose container 2200 in an expanded configuration. Multi-monodose container 2200 includes a row 2210 of interconnected monodose pharmaceutical vials 2220. Multi-monodose container 2200 further includes one or more articulating joints 2230 connecting each of the monodose pharmaceutical vials 2220 in the row 2210 of interconnected monodose pharmaceutical vials 2220 to at least one adjacent monodose pharmaceutical vial 2220. Each of the monodose pharmaceutical vials 2220 further includes a closure 2240 and a label 2250 including a sensor 2260.

FIG. 22B is a schematic showing a top-down view of multi-monodose container 2200 in an expanded configuration. In this view, each of the monodose pharmaceutical vials 2220 in the row 2210 of interconnected monodose pharmaceutical vials is connected at an edge to an adjacent monodose pharmaceutical vial 2220 through an articulating joint 2230. Multi-monodose container 2200 in an expanded configuration has a first rectangular packing cross-sectional area 2270 (dotted line).

In some embodiments, a multi-monodose container includes one or more articulating joints. In an aspect, the one or more articulating joints are cleavable. For example, an articulating joint connecting a monodose pharmaceutical vial to an adjacent monodose pharmaceutical vial can be cleavable, allowing for separation of the two monodose pharmaceutical vials. In an aspect, the articulating joint is at least one of tearable, ripable, rendable, breakable, fragmentable, or separable. For example, an articulating joint connecting a monodose pharmaceutical vial to an adjacent monodose pharmaceutical vial can be at least one of tearable, ripable, rendable, breakable, fragmentable, or separable. In an aspect, a subset of articulating joints connecting monodose pharmaceutical vials in a multi-monodose container is cleavable. For example, the subset of cleavable articulating joints may be used to separate a large multi-monodose container, e.g., with 25 monodose pharmaceutical vials, into smaller multi-monodose containers, e.g., with 5 monodose pharmaceutical vials. In an aspect, all of the articulating joins connecting the monodose pharmaceutical vials in a multi-monodose container are cleavable. For example, cleavable articulating joints may be used to detach or separate each of the monodose pharmaceutical vials from the other monodose pharmaceutical vials of the multi-monodose container.

In an aspect, the multi-monodose container 2200 is formed by a blow molding manufacturing process. In an aspect, the multi-monodose container 2200 is formed by a blow-fill-seal manufacturing process. In an aspect, the multi-monodose container 2200 is formed by an injection molded process. Non-limiting aspects of manufacturing a multi-monodose container by molded processes have been described above herein.

In an aspect, the articulating joint 2230 is formed with the monodose pharmaceutical vials as a single entity, e.g., from a single mold. In an aspect, the articulating joint 2230 is formed separately and subsequently attached to the monodose pharmaceutical vials. For example, one or more articulating joints for use in connecting a row of glass vials can be formed from a flexible plastic resin subsequently attached to the glass vials. In an aspect, the one or more articulating joint 2230 are formed from a first material and monodose pharmaceutical vials 2220 are formed from a second material. For example, the articulating joint may be formed from a flexible plastic material while the monodose pharmaceutical vials are formed from a more rigid plastic material. For example, the articulating joint may be formed from a flexible plastic material while the monodose pharmaceutical vials are formed from glass.

In an aspect, the multi-monodose container 2200 is formed from at least one biocompatible material. In an aspect, the multi-monodose container 2200 is formed from at least one thermoplastic material. In an aspect, the multi-monodose container 2200 is formed from at least one biocompatible thermoplastic material. Non-limiting examples of biocompatible, thermoplastic, and biocompatible thermoplastic materials for use in forming a multi-monodose container have been described above herein.

In an aspect, the row 2210 of interconnected monodose pharmaceutic vials 2220 comprises a row of two or more interconnected monodose pharmaceutical vials. In the non-limiting example of FIG. 22A, multi-monodose container 2200 includes five interconnected monodose pharmaceutical vials 2220. In an aspect, the row of interconnected monodose pharmaceutical vials includes three or more interconnected monodose pharmaceutical vials. In an aspect, the row of interconnected monodose pharmaceutical vials includes at least one of two, three, four, five, six, seven, eight, nine, or ten interconnected monodose pharmaceutical vials. In an aspect, the row of interconnected monodose pharmaceutical vials includes about 2 to about 30 interconnected monodose pharmaceutical vials. For example, the a row of interconnected monodose pharmaceutical vials can include 2 vials, 3 vials, 4 vials, 5 vials, 6 vials, 7 vials, 8 vials, 9 vials, 10 vials, 11 vials, 12 vials, 13 vials, 14 vials, 15 vials, 16 vials, 17 vials, 18 vials, 19 vials, 20 vials, 21 vials, 22 vials, 23 vials, 24 vials, 25 vials, 26 vials, 27 vials, 28 vials, 29 vials, or 30 vials. In some embodiments, the multi-monodose container includes more than 30 monodose pharmaceutical vials.

In an aspect, the multi-monodose container includes a row of 20 to 30 interconnected monodose pharmaceutical vials. For example, the multi-monodose container can include a row of 25 interconnected monodose pharmaceutical vials. For example, a mold for use in either blow molding or injection molding can include molds for 25 individual monodose pharmaceutical vials interconnected through articulating joints. For example, a multi-monodose container including 25 interconnected monodose pharmaceutical vials can be manufactured, filled with appropriate pharmaceutical agent, sealed, and packaged in the folded configuration for ease of distribution. In an aspect, the multi-monodose container includes a row of 20 to 30 interconnected monodose pharmaceutical vials configured to be split into groups of 3 to 10 interconnected monodose pharmaceutical vials. For example, the multi-monodose container includes a row of 20 to 30 interconnected monodose pharmaceutical vials configured to be split into groups of 3 vials, 4 vials, 5 vials, 6 vials, 7 vials, 8 vials, 9 vials, or 10 vials. For example, a multi-monodose container can include a strip of 25 vials that is configured to be split into groups of 5 vials. In this way, large strips of interconnected monodose pharmaceutical vials can be manufactured, filled with pharmaceutical agent, sealed, and subsequently separated into smaller units for packaging and distribution.

In an aspect, each of the interconnected monodose pharmaceutical vials is polygonal in horizontal cross-section. In the non-limiting example of FIG. 22B, interconnected monodose pharmaceutical vials 2220 are rectangular in horizontal cross-section. In an aspect, each of the interconnected monodose pharmaceutical vials is square, triangular, hexagonal, or polygonal in horizontal cross-section. Non-limiting examples of different cross-sectional shapes of monodose pharmaceutical vials in a row of interconnected monodose pharmaceutical vials is shown in FIGS. 5A-5C.

Each of the monodose pharmaceutical vials 2220 encloses a dose of at least one pharmaceutical agent. In an aspect, the dose of the at least one pharmaceutical agent includes a dose of at least one vaccine. In an aspect, the dose of the at least one pharmaceutical agent includes a dose of at least therapeutic agent. Non-limiting examples of vaccines and therapeutic agents have been described above herein. In an aspect, the dose of the at least one pharmaceutical agent is in a liquid form. For example, the dose of the at least one pharmaceutical agent, e.g., a vaccine, is solubilized and/or suspended in a liquid medium, e.g., water for injection. In an aspect, the dose of the at least one pharmaceutical agent is in a lyophilized form. For example, the dose of the at least one pharmaceutical agent, e.g., a vaccine, has been prepared in a lyophilized form intended for reconstitution with a liquid medium, e.g., water for injection, prior to administration to a subject.

In an aspect, each of the monodose pharmaceutical vials 2220 in the row 2210 of monodose pharmaceutical vials 2220 includes an internal volume holding the dose of the at least one pharmaceutical agent. In an aspect, the internal volume is about 0.2 ml to about 6.0 ml. For example, the internal volume of each of the monodose pharmaceutical vials is about 0.2 mL, 0.3 mL, 0.4 mL, 0.5 mL, 0.6 mL, 0.7 mL, 0.8 mL, 0.9 mL, 1.0 mL, 1.1 mL, 1.2 mL, 1.3 mL, 1.4 mL, 1.5 mL, 1.6 mL, 1.7 mL, 1.8 mL, 1.9 mL, 2.0 mL, 2.1 mL, 2.2 mL, 2.3 mL, 2.4 mL, 2.5 mL, 2.6 mL, 2.7 mL, 2.8 mL, 2.9 mL, 3.0 mL, 3.1 mL, 3.2 mL, 3.3 mL, 3.4 mL, 3.5 mL, 3.6 mL, 3.7 mL, 3.8 mL, 3.9 mL, 4.0 mL, 4.1 mL, 4.2 mL, 4.3 mL, 4.4 mL, 4.5 mL, 4.6 mL, 4.7 mL, 4.8 mL, 4.9 mL, 5.0 mL, 5.1 mL, 5.2 mL, 5.3 mL, 5.4 mL, 5.5 mL, 5.6 mL, 5.7 mL, 5.8 mL, 5.9 mL, or 6.0 mL. In some embodiments, the internal volume of each monodose pharmaceutical vial is greater than 6.0 ml.

In an aspect, the internal volume holding the dose of the at least one pharmaceutical agent includes an inert gas-filled headspace. For example, the headspace above the dose of the at least one pharmaceutical agent can include nitrogen or a noble gas, e.g., argon, xenon, neon, or krypton.

In aspect, each of the monodose pharmaceutical vials 2220 in the row 2210 of interconnected monodose pharmaceutical vials 2220 includes a closure 2240. In an aspect, closure 2240 includes a twist or snap-off closure. In aspect, each of the monodose pharmaceutical vials 2220 in the row 2210 of interconnected monodose pharmaceutical vials 2220 includes a needle-penetrable access portion. Non-limiting aspects of closures and/or needle-penetrable access portions for monodose pharmaceutical vials of a multi-monodose container have been described above herein.

In an aspect, the articulating joint 2230 is frangible. For example, the one or more articulating joints may be accompanied by a frangible portion, e.g., perforations in the molded material, which allows the monodose pharmaceutical vials to be separated from one another.

In an aspect, multi-monodose container 2200 is configured to form an expanded configuration (as shown in FIGS. 22A and 22B) and a folded configuration. FIGS. 22C and 22D illustrate multi-monodose container 2200 in a folded configuration. FIG. 22C is a side view showing multi-monodose container 2200 in a folded configuration. In this configuration, the articulating joints 2230 have been bent to reversibly mate a planar outer surface of each of the monodose pharmaceutical vials 2220 in the row 2210 of interconnected monodose pharmaceutical vials 2220 with a planar outer surface of at least one adjacent monodose pharmaceutical vial 2220. FIG. 22D is a top-down view of multi-monodose container 2200 in a folded configuration. The row 2210 of interconnected monodose pharmaceutical vials 2220 have been folded along the articulating joints 2230 to form the folded configuration. Multi-monodose container 2200 in a folded configuration has a second rectangular packing cross-sectional area 2280 (dotted line).

In an aspect, the expanded configuration of the multi-monodose container 2200 has a first rectangular packing cross-sectional area 2270 and the folded configuration of multi-monodose container 2200 has a second rectangular packing cross-sectional area 2280. FIG. 22E illustrates a juxtaposition of the first rectangular packing cross-sectional area 2270 of the multi-monodose container 2200 in an expanded configuration and the second rectangular packing cross-sectional area 2280 of the multi-monodose container 2200 in a folded configuration. The second rectangular packing cross-sectional area 2280 is smaller than the first rectangular packing cross-sectional area 2270.

Further non-limiting aspects of multi-monodose containers with articulating joints are described in U.S. patent application Ser. No. 14/736,542 titled "Multi-Monodose Containers," which is incorporated herein by reference.

In an aspect, the multi-monodose container includes at least one label including at least one sensor. Returning to FIG. 22A, each of the monodose pharmaceutical vials 2220 includes at least one label 2250 including at least one sensor 2260. In an aspect, each of the monodose pharmaceutical vials 2220 includes at least one label 2250 including at least one of a temperature sensor, a moisture sensor, a light sensor, or an oxygen sensor. Non-limiting aspects of labels and environmental sensors for use with labels have been described above herein.

Figure 23:
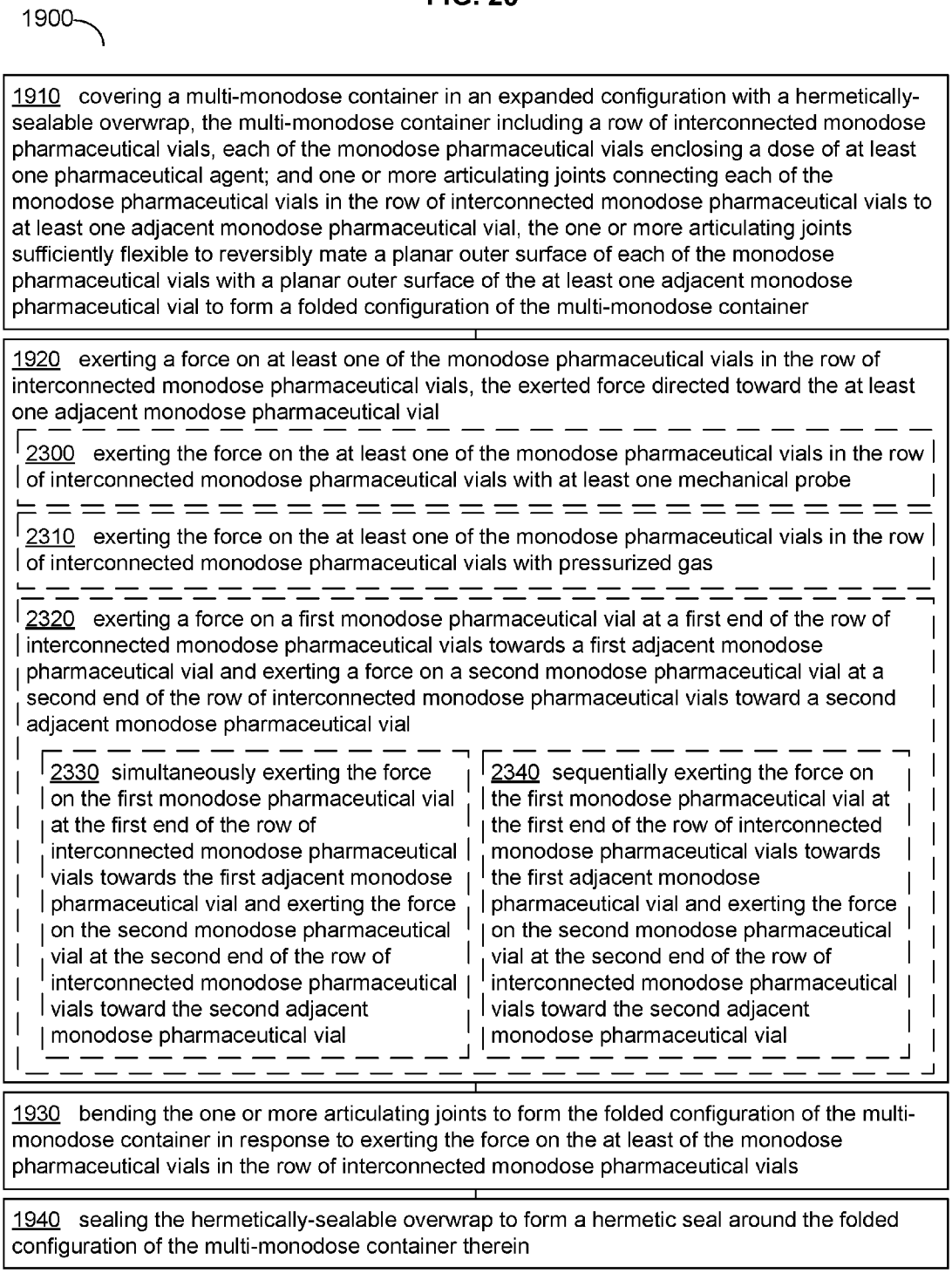
FIG. 23 depicts aspects of a method of packaging a multi-monodose container such as shown in FIG. 19.

FIG. 23 is a block diagram illustrating aspects of method 1900 of packaging a foldable container. Method 1900 includes covering a multi-monodose container in an expanded configuration with a hermetically-sealable overwrap, as shown in block 1910. Method 1900 further includes exerting a force on at least one of the monodose pharmaceutical vials in the row of interconnected monodose pharmaceutical vials, the exerted force directed toward the at least one adjacent monodose pharmaceutical vial, as shown in block 1920. In an aspect, method 1900 includes exerting the force on the at least one of the monodose pharmaceutical vials in the row of interconnected monodose pharmaceutical vials with at least one mechanical probe, as shown in block 2300. For example, the method can include exerting the force with one or more pistons configured to contact and push on at least one end of the row of interconnected monodose pharmaceutical vials. In an aspect, method 1900 includes exerting the force on the at least one of the monodose pharmaceutical vials in the row of interconnected monodose pharmaceutical vials with pressurized gas, as shown in block 2310. For example, the method can include exerting the force with pressurized gas from one or more nozzles directed at least one end of the row of interconnected monodose pharmaceutical vials.

In an aspect, method 1900 includes in block 2320 exerting a force on a first monodose pharmaceutical vial at a first end of the row of interconnected monodose pharmaceutical vials towards a first adjacent monodose pharmaceutical vial and exerting a force on a second monodose pharmaceutical vial at a second end of the row of interconnected monodose pharmaceutical vials toward a second adjacent monodose pharmaceutical vial. For example, the method can include exerting a force with one or more pistons at both ends of the row of interconnected monodose pharmaceutical vials. For example, the method can include exerting a force with pressurized gas at both ends of the row of interconnected monodose pharmaceutical vials. In an aspect, method 1900 includes in block 2330 simultaneously exerting the force on the first monodose pharmaceutical vial at the first end of the row of interconnected monodose pharmaceutical vials towards the first adjacent monodose pharmaceutical vial and exerting the force on the second monodose pharmaceutical vial at the second end of the row of interconnected monodose pharmaceutical vials toward the second adjacent monodose pharmaceutical vial. For example, the method can include exerting the force simultaneously on both ends of the row of interconnected monodose pharmaceutical vials. In an aspect, method 1900 includes in block 2340 sequentially exerting the force on the first monodose pharmaceutical vial at the first end of the row of interconnected monodose pharmaceutical vials towards the first adjacent monodose pharmaceutical vial and exerting the force on the second monodose pharmaceutical vial at the second end of the row of interconnected monodose pharmaceutical vials toward the second adjacent monodose pharmaceutical vial. For example, the method can include exerting the force sequentially on one end and then the other end of the row of interconnected monodose pharmaceutical vials.

FIG. 24 is a block diagram illustrating further aspects of method 1900 of packaging a foldable container. In some embodiments, method 1900 includes evacuating at least a portion of air from around the folded configuration of the multi-monodose container covered by the hermetically-sealable overwrap, as shown in block 2400. For example, the method can include sucking at least a portion of the air out from around the multi-monodose container prior to sealing the hermetically-sealable overwrap. In an aspect, method 1900 includes in block 2410 inserting a flow conduit connected to a vacuum source into an opening defined by the hermetically-sealable overwrap, pressure sealing a portion of the hermetically-sealable overwrap around the inserted flow conduit to form a pocket around the folded configuration of the multi-monodose container, and evacuating the at least a portion of the air from the pocket around the folded configuration of the multi-monodose container.

In some embodiments, method 1900 includes injecting an inert gas around the folded configuration of the multi-monodose container covered by the hermetically-sealable overwrap; and evacuating at least a portion of the injected inert gas from around the folded configuration of the multi-monodose container covered by the hermetically-sealable overwrap, as shown in block 2420. For example, the method can include generating an inert and/or oxygen free atmosphere around the row of interconnected monodose pharmaceutical vials by injecting an inert gas around the folded configuration of the multi-monodose container covered by the hermetically-sealable overwrap. In an aspect, injecting the inert gas around the folded configuration of the multi-monodose container covered by the hermetically-sealable overwrap includes in block 2430 injecting nitrogen around the folded configuration of the multi-monodose container covered by the hermetically-sealable overwrap. In an aspect, injecting the inert gas around the folded configuration of the multi-monodose container covered by the hermetically-sealable overwrap includes in block 2440 injecting a noble gas around the folded configuration of the multi-monodose container covered by the hermetically-sealable overwrap. For example, the method can include injecting at least one of argon, neon, krypton, or xenon into the hermetically-sealable overwrap around the folded configuration of the multi-monodose container. In an aspect, evacuating the injected inert gas from around the folded configuration of the multi-monodose container covered by the hermetically-sealable overwrap includes in block 2450 inserting a flow conduit connected to a vacuum source into an opening defined by the hermetically-sealable overwrap; pressure sealing a portion of the hermetically-sealable overwrap around the inserted flow conduit to form a pocket around the folded configuration of the multi-monodose container; and evacuating the at least a portion of the injected inert gas from the pocket around the folded configuration of the multi-monodose container.

In an embodiment, method 1900 of packaging a foldable container includes evacuating at least a portion of air from around the folded configuration of the multi-monodose container covered by the hermetically-sealable overwrap prior to injecting the inert gas around the folded configuration of the multi-monodose container, as shown in block 2460. In an aspect, evacuating at least a portion of the air from around the folded configuration of the multi-monodose container includes sucking at least a portion of the air from around the folded configuration of the multi-monodose container covered by the hermetically-sealable overwrap prior to injecting the inert gas. In an aspect, evacuating at least a portion of the air from around the folded configuration of the multi-monodose container covered by the hermetically-sealable overwrap includes exchanging the air for the inert gas. In an aspect, evacuating at least a portion of the air from around the folded configuration of the multi-monodose container covered by the hermetically-sealable overwrap includes purging or flushing the air from around the folded configuration of the multi-monodose container. In an embodiment, a flow conduit is used to evacuate air from around the folded configuration of the multi-monodose container covered by the hermetically-sealable overwrap, inject an inert gas around the folded configuration of the multi-monodose container, and evacuate at least a portion of the injected inert gas from around the folded configuration of the multi-monodose container covered by the hermetically-sealable overwrap prior to forming a hermetic seal around the folded configuration of the multi-monodose container. In an embodiment, a first flow conduit is used to inject an inert gas and a second flow conduit is used to evacuate at least a portion of the injected inert gas.

FIG. 25 is a block diagram illustrating further aspects of method 1900 of packaging a folding container. Method 1900 includes in block 1940 sealing the hermetically-sealable overwrap to form a hermetic seal around the folded configuration of the multi-monodose container therein. In an aspect, method 1900 includes in block 2500 heat-sealing the hermetically-sealable overwrap to form the hermetic seal around the folded configuration of the multi-monodose container therein. In an aspect, method 1900 includes in block 2510 pressure-sealing the hermetically-sealable overwrap to form the hermetic seal around the folded configuration of the multi-monodose container therein. In an aspect, method 1900 includes in block 2520 chemically-sealing the hermetically-sealable overwrap to form the hermetic seal around the folded configuration of the multi-monodose container therein. In an aspect, sealing the hermetically-sealable overwrap includes heating-sealing, pressure-sealing, or chemically-sealing the hermetically-sealable. In an aspect, sealing includes at least one of folding, tucking, crimping, welding, fusing, soldering, heat sealing, blister sealing, or induction sealing.

In an aspect, method 1900 includes sealing the hermetically-sealable overwrap to form a gas-impermeable seal around the folded configuration of the multi-monodose container therein. In an aspect, method 1900 includes sealing the hermetically-sealable overwrap to form a vapor-impermeable seal around the folded configuration of the multi-monodose container therein. In an aspect, method 1900 includes sealing the hermetically-sealable overwrap to form a light-impermeable seal around the folded configuration of the multi-monodose container therein. In an aspect, method 1900 includes sealing the hermetically-sealable overwrap to form an electrostatic discharge-protective seal around the folded configuration of the multi-monodose container therein.

In an aspect, method 1900 includes in block 2530 sealing at least a portion of the hermetically-sealable overwrap to form a pouch around the folded configuration of the multi-monodose container; injecting an inert gas into the formed pouch around the folded configuration of the multi-monodose container; evacuating at least a portion of the injected inert gas from the formed pouch around the folded configuration of the multi-monodose container; and sealing the formed pouch to form a hermetic seal around the folded configuration of the multi-monodose container therein.

In an aspect, method 1900 includes in block 2540 attaching at least one label to an outer surface of the hermetically-sealable overwrap, the at least one label include at least one sensor. In an aspect, method 1900 includes in block 2550 attaching at least one label to an outer surface of the hermetically-sealable overwrap, the at least one label include at least one temperature sensor. Non-limiting aspects of labels and associated environmental sensors have been described above herein.

Figure 26A:
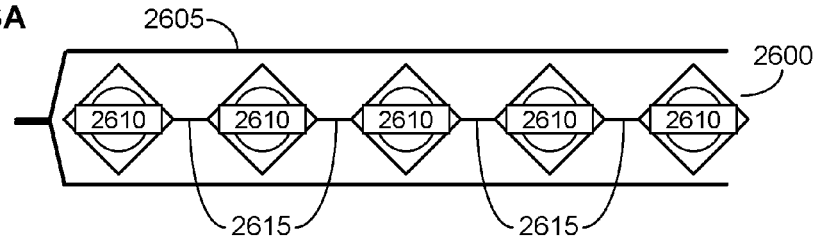
FIG. 26A illustrates aspects of a method of packaging a foldable multi-monodose container.
Figure 26B:
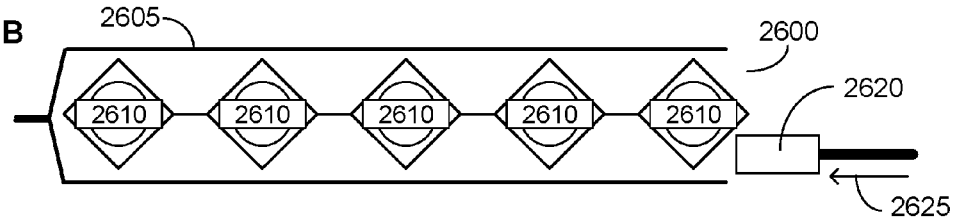
FIG. 26B depicts aspects of a method of packaging a foldable multi-monodose container.
Figure 26C:
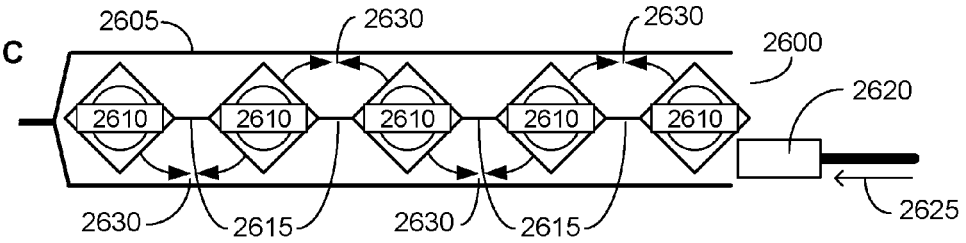
FIG. 26C shows aspects of a method of packaging a foldable multi-monodose container.
Figure 26D:
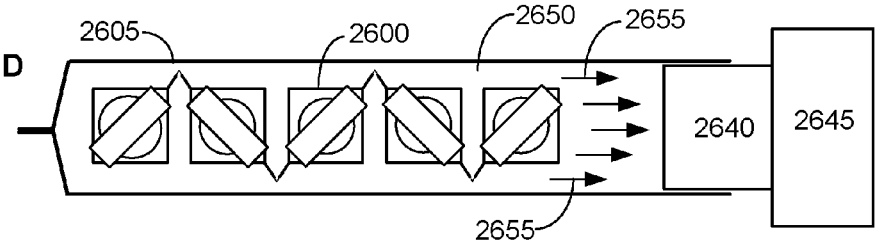
FIG. 26D illustrates aspects of a method of packaging a foldable multi-monodose container.
Figure 26E:
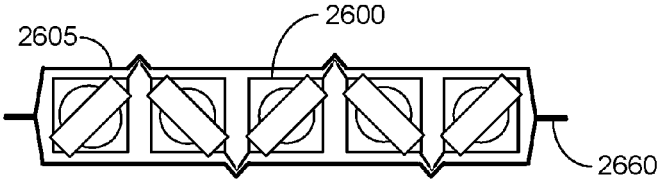
FIG. 26E shows aspects of a method of packaging a foldable multi-monodose container.

FIGS. 26A-26E illustrate further aspects of a method of packaging a folding container such as shown in FIG. 19. FIG. 26A is a top-down view of a multi-monodose container 2600 in an elongated configuration covered by a hermetically-sealable overwrap 2605. Multi-monodose container 2600 includes a row of interconnected monodose pharmaceutical vials 2610. Each of the monodose pharmaceutical vials 2610 is connected to at least one adjacent monodose pharmaceutical vial 2610 through articulating joints 2615. Articulating joints 2615 are sufficiently flexible to reversibly mate a planar outer surface of each of the monodose pharmaceutical vials 2610 with a planar outer surface of at least one adjacent monodose pharmaceutical vial 2610 to form a folded configuration of the multi-monodose container 2600. FIG. 26B shows a top-down view multi-monodose container 2600 in an elongated configuration covered by hermetically-sealable overwrap 2605. A force 2625 is shown being exerted on a first monodose pharmaceutical vial 2610 in the row of interconnected monodose pharmaceutical vials 2610 of multi-monodose container 2600. In this non-limiting example, the force 2625 is being exerted by a mechanical probe 2620. In an aspect, the mechanical probe 2620 is a piston-like device that pushes the first monodose pharmaceutical vial towards an adjacent monodose pharmaceutical vial to initiate a folding chain reaction. FIG. 26C shows a top-down view of multi-monodose container 2600 in an elongated configuration covered by hermetically-sealable overwrap 2605. Articulating joints 2615 are shown bending (arrows 2630) in response to the force 2625 exerted by the mechanical probe 2620. As the articulating joints 2615 bend the planar outer surfaces of neighboring monodose pharmaceutical vials 2610 will reversibly mated to form the folded configuration of the multi-monodose container. FIG. 26D shows a top-down view of multi-monodose container 2600 in a folded configuration covered by hermetically-sealable overwrap 2605. In this non-limiting example, a flow conduit 2640 connected to a vacuum source 2645 is shown inserted into an opening defined by the hermetically-sealable overwrap 2605. In an aspect, a portion of the hermetically-sealable overwrap 2605 is pressure sealed around the inserted flow conduit 2640 to form a pocket 2650 around the folded configuration of the multi-monodose container 2600. Also shown is air 2655 being evacuated from the pocket 2650 around the folded configuration of the multi-monodose container 2600 by vacuum source 2645. FIG. 26E shows a top-down view of multi-monodose container 2600 in a folded configuration covered by hermetically-sealable overwrap 2605. A seal 2660 has been formed with the hermetically-sealable overwrap 2605 to hermetically seal the folded configuration of the multi-monodose container 2600 therein.

Figure 27A:
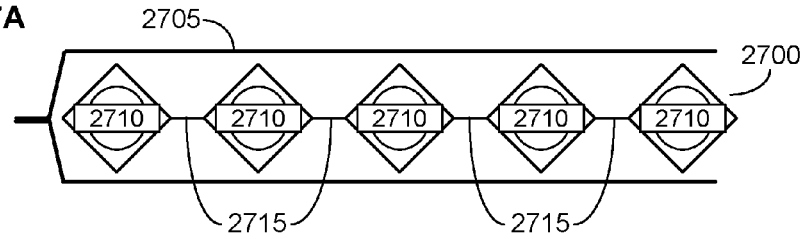
FIG. 27A depicts aspects of a method of packaging a foldable multi-monodose container.
Figure 27B:
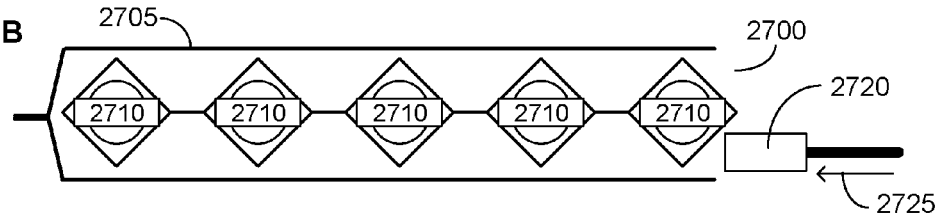
FIG. 27B shows aspects of a method of packaging a foldable multi-monodose container.
Figure 27C:
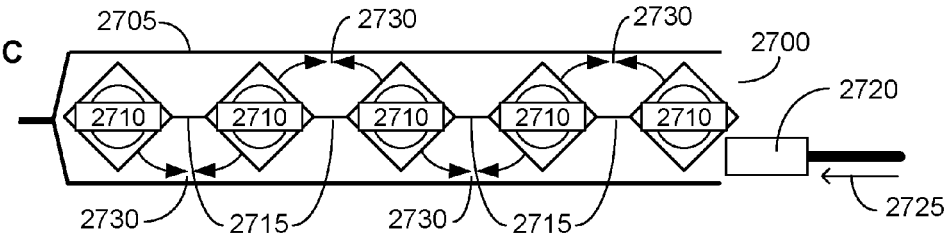
FIG. 27C illustrates aspects of a method of packaging a foldable multi-monodose container.
Figure 27D:
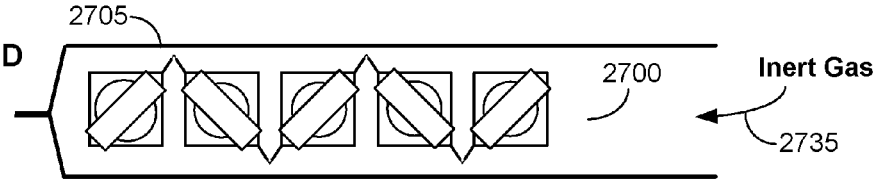
FIG. 27D depicts aspects of a method of packaging a foldable multi-monodose container.
Figure 27E:
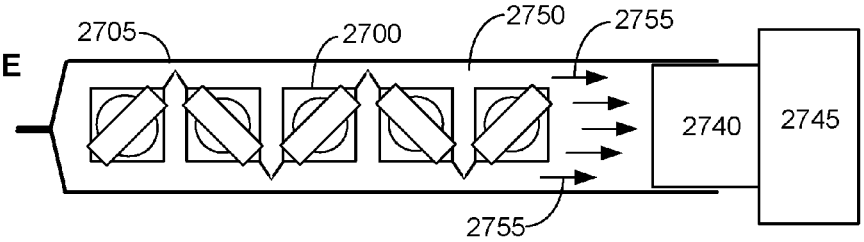
FIG. 27E shows aspects of a method of packaging a foldable multi-monodose container.
Figure 27F:
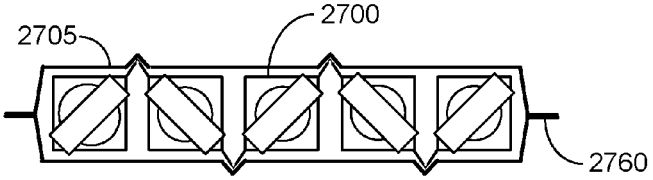
FIG. 27F illustrates aspects of a method of packaging a foldable multi-monodose container

FIGS. 27A-27E illustrate further aspects of a method of packaging a folding container such as shown in FIG. 19. FIG. 27A is a top-down view of a multi-monodose container 2700 in an elongated configuration covered by a hermetically-sealable overwrap 2705. Multi-monodose container 2700 includes a row of interconnected monodose pharmaceutical vials 2710. Each of the monodose pharmaceutical vials 2710 is connected to at least one adjacent monodose pharmaceutical vial 2710 through articulating joints 2715. Articulating joints 2715 are sufficiently flexible to reversibly mate a planar outer surface of each of the monodose pharmaceutical vials 2710 with a planar outer surface of at least one adjacent monodose pharmaceutical vial 2710 to form a folded configuration of the multi-monodose container 2700. FIG. 27B shows a top-down view multi-monodose container 2700 in an elongated configuration covered by hermetically-sealable overwrap 2705. A force 2725 is shown being exerted on a first monodose pharmaceutical vial 2710 in the row of interconnected monodose pharmaceutical vials 2710 of multi-monodose container 2700. In this non-limiting example, the force 2725 is being exerted by a mechanical probe 2720. In an aspect, the mechanical probe 2720 is a piston-like device that pushes the first monodose pharmaceutical vial towards an adjacent monodose pharmaceutical vial to initiate a folding chain reaction. FIG. 27C shows a top-down view of multi-monodose container 2700 in an elongated configuration covered by hermetically-sealable overwrap 2705. Articulating joints 2715 are shown bending (arrows 2730) in response to the force 2725 exerted by the mechanical probe 2720. As the articulating joints 2715 bend the planar outer surfaces of neighboring monodose pharmaceutical vials 2710 will reversibly mated to form the folded configuration of the multi-monodose container. FIG. 27D shows a top-down view of multi-monodose container 2700 in a folded configuration covered by hermetically-sealable overwrap 2705. An inert gas is shown being injected 2735 (arrow) into the hermetically-sealable overwrap 2705 and around the multi-monodose container 2700 in the folded configuration. FIG. 27E shows a top-down view of multi-monodose container 2700 in a folded configuration covered by hermetically-sealable overwrap 2705. In this non-limiting example, a flow conduit 2740 connected to a vacuum source 2745 is shown inserted into an opening defined by the hermetically-sealable overwrap 2705. In an aspect, a portion of the hermetically-sealable overwrap 2705 is pressure sealed around the inserted flow conduit 2740 to form a pocket 2750 around the folded configuration of the multi-monodose container 2700. Also shown is the injected inert gas being evacuated 2755 (arrows) from the pocket 2750 around the folded configuration of the multi-monodose container 2700 by vacuum source 2745. FIG. 27F shows a top-down view of multi-monodose container 2700 in a folded configuration covered by hermetically-sealable overwrap 2705. A seal 2760 has been formed with the hermetically-sealable overwrap 2705 to hermetically seal the folded configuration of the multi-monodose container 2700 therein.

Figure 28:
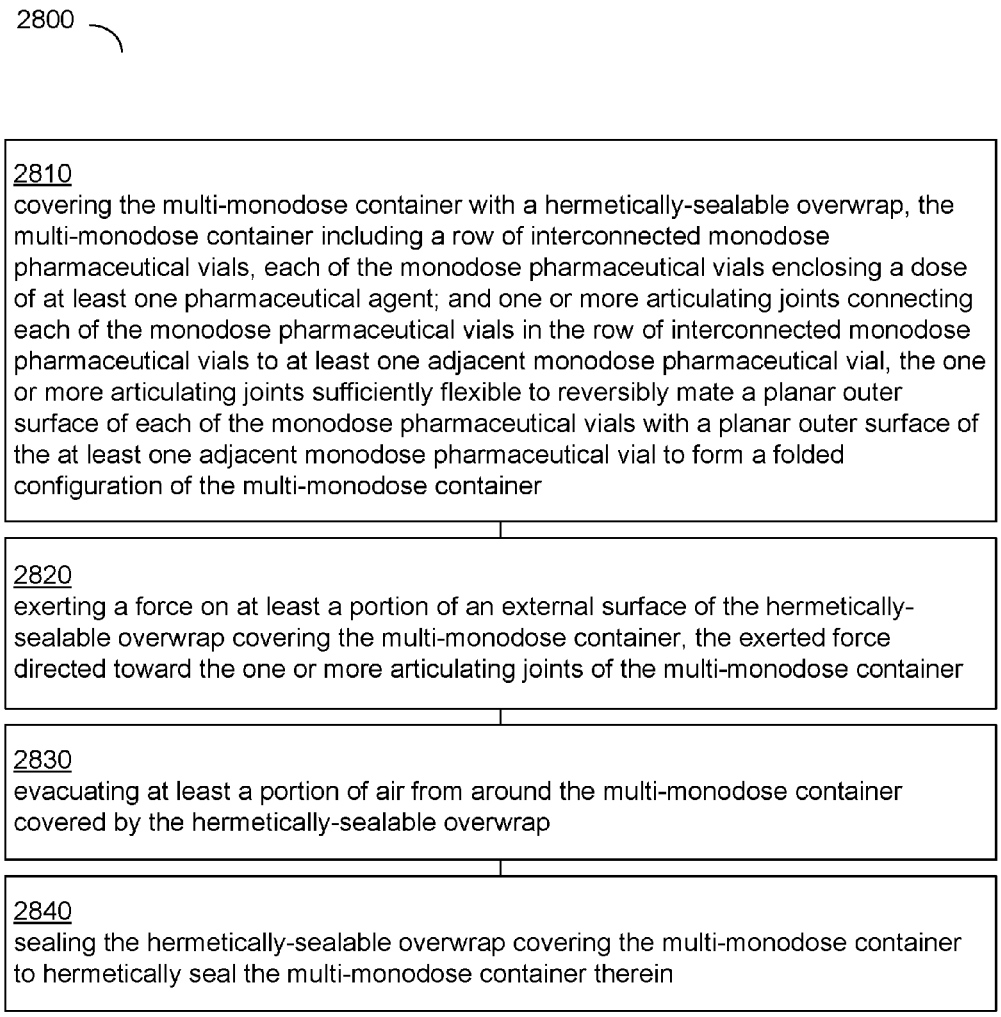
FIG. 28 is a block diagram showing a method of packaging a multi-monodose container.

FIG. 28 is a block diagram showing a method 2800 of packaging a multi-monodose container. Method 2800 includes in block 2810 covering the multi-monodose container with a hermetically-sealable overwrap, the multi-monodose container including a row of interconnected monodose pharmaceutical vials, each of the monodose pharmaceutical vials enclosing a dose of at least one pharmaceutical agent; and one or more articulating joints connecting each of the monodose pharmaceutical vials in the row of interconnected monodose pharmaceutical vials to at least one adjacent monodose pharmaceutical vial, the one or more articulating joints sufficiently flexible to reversibly mate a planar outer surface of each of the monodose pharmaceutical vials with a planar outer surface of the at least one adjacent monodose pharmaceutical vial to form a folded configuration of the multi-monodose container. Method 2800 includes in block 2820 exerting a force on at least a portion of an external surface of the hermetically-sealable overwrap covering the multi-monodose container, the exerted force directed toward the one or more articulating joints of the multi-monodose container. Method 2800 includes in block 2830 evacuating at least a portion of air from around the multi-monodose container covered by the hermetically-sealable. Method 2800 includes in block 2840 sealing the hermetically-sealable overwrap covering the multi-monodose container to hermetically seal the multi-monodose container therein.

FIG. 29 is a block diagram illustrating further aspects of method 2800 of packaging a multi-monodose container. Method 2800 includes covering the multi-monodose container with a hermetically-sealable overwrap as shown in block 2810. In an aspect, covering the multi-monodose container with the hermetically-sealable overwrap includes in block 2900 inserting the multi-monodose container through an opening defined by the hermetically-sealable overwrap. In an aspect covering the multi-monodose container with the hermetically-sealable overwrap includes in block 2910 positioning the multi-monodose container between a first layer of hermetically-sealable overwrap and a second layer of hermetically-sealable overwrap; and sealing together one or more edges of the first layer and the second layer of the hermetically-sealable overwrap. In an aspect covering the multi-monodose container with the hermetically-sealable overwrap includes in block 2920 covering the multi-monodose container with a hermetically-sealable pouch. In an aspect covering the multi-monodose container with the hermetically-sealable overwrap includes in block 2930 covering the multi-monodose container with a hermetically-sealable sleeve. In an aspect covering the multi-monodose container with the hermetically-sealable overwrap includes in block 2940 covering the multi-monodose container with a hermetically-sealable foil laminate. In an aspect covering the multi-monodose container with the hermetically-sealable overwrap includes covering the multi-monodose container with a hermetically-sealable overwrap formed from at least one of polyester, foil, polypropylene, cast polypropylene, polyethylene, high-density polyethylene, metallocene polyethylene, linear low density polyethylene, or metalized films. In an aspect, covering the multi-monodose container with the hermetically-sealable overwrap includes in block 2950 covering the multi-monodose container with a gas-impermeable overwrap. In an aspect, covering the multi-monodose container with the hermetically-sealable overwrap includes in block 2960 covering the multi-monodose container with a vapor-impermeable overwrap. In an aspect, covering the multi-monodose container with the hermetically-sealable overwrap includes in block 2970 covering the multi-monodose container with a light-impermeable overwrap. In an aspect, covering the multi-monodose container with the hermetically-sealable overwrap includes in block 2980 covering the multi-monodose container with an electrostatic discharge-protective overwrap. Non-limiting aspects of covering a multi-monodose container with hermetically-sealable overwrap have been described above herein.

FIG. 30 is a block diagram illustrating further aspects of a method 2800 of packaging a multi-monodose container. Method 2800 includes exerting a force on at least a portion of an external surface of the hermetically-sealable overwrap covering the multi-monodose container, as shown in block 2820. The exerted force is directed toward the one or more articulating joints of the multi-monodose containers. In an aspect, exerting the force on the at least a portion of the external surface of the hermetically-sealable overwrap covering the multi-monodose container includes in block 3000 exerting the force on the at least a portion of the external surface of the hermetically-sealable overwrap covering the multi-monodose container with one or more mechanical probes. For example, the method can include using one or more mechanical probes to push the hermetically-sealable overwrap into close proximity to one or more underlying articulating joints of the multi-monodose container. In an aspect, exerting the force on the at least a portion of the external surface of the hermetically-sealable overwrap covering the multi-monodose container includes in block 3010 exerting the force on the at least a portion of the external surface of the hermetically-sealable overwrap covering the multi-monodose container with pressurized gas. For example, the method can include using pressurized gas emitted from one or more high pressure nozzles to push the hermetically-sealable overwrap into close proximity to one or more underlying articulating joints of the multi-monodose container.

Method 2800 includes in block 2830 evacuating at least a portion of air from around the multi-monodose container covered by the hermetically-sealable overwrap. For example, the method can include sucking out at least a portion of the air from around the multi-monodose container prior to sealing the multi-monodose container in the hermetically-sealable overwrap. In some embodiments, evacuating the at least a portion of the air from around the multi-monodose container covered by the hermetically-sealable overwrap includes in block 3020 inserting a flow conduit connected to a vacuum source into an opening defined by the hermetically-sealable overwrap covering the multi-monodose container; pressure sealing a portion of the hermetically-sealable overwrap around the inserted flow conduit to form a pocket around the multi-monodose container; and evacuating the at least a portion of the air from the pocket around the multi-monodose container. In an aspect, the method includes evacuating the at least a portion of air while simultaneously exerting the force on the at least a portion of the external surface of the hermetically-sealable overwrap covering the multi-monodose container.

In some embodiments, method 2800 includes injecting an inert gas around the multi-monodose container covered by the hermetically-sealable overwrap; and evacuating at least a portion of the injected inert gas from around the multi-monodose container covered by the hermetically-sealable overwrap, as shown in block 3030. In an aspect, injecting the inert gas around the multi-monodose container covered by the hermetically-sealable overwrap includes in block 3040 injecting nitrogen around the multi-monodose container covered by the hermetically-sealable overwrap. In an aspect, injecting the inert gas around the multi-monodose container covered by the hermetically-sealable overwrap includes in block 3050 injecting a noble gas around the multi-monodose container covered by the hermetically-sealable overwrap. For example, the method can include injecting at least one of argon, neon, xenon, or krypton around the multi-monodose container covered by the hermetically-sealable overwrap.

In some embodiments, method 2800 of packaging a multi-monodose container includes evacuating the at least a portion of the air from around the multi-monodose container covered by the hermetically-sealable overwrap prior to injecting an inert gas around the multi-monodose container, as shown in block 3060. For example, the method can include sucking out the air, exchanging the air with the inert gas, and/or purging or flushing the air with the inert gas.

Method 2800 includes evacuating at least a portion of the injected inert gas from around the multi-monodose container covered by the hermetically-sealable overwrap, as shown in block 3030. For example, the method can include evacuating at least a portion of the injected inert gas from the hermetically-sealable overwrap while under vacuum. In an aspect, evacuating the at least a portion of the injected inert gas from around the multi-monodose container covered by the hermetically-sealable overwrap includes inserting a flow conduit connected to a vacuum source into an opening defined by the hermetically-sealable overwrap covering the multi-monodose container; pressure sealing a portion of the hermetically-sealable overwrap around the inserted flow conduit to form a pocket around the multi-monodose container; and evacuating the at least a portion of the injected inert gas from the pocket around the multi-monodose container. In an aspect, the method includes evacuating at least a portion of the injected inert gas while simultaneously exerting the force on the at least a portion of the external surface of the hermetically-sealable overwrap covering the multi-monodose container.

FIG. 31 is a block diagram illustrating further aspects of method 2800 of packaging a multi-monodose container. Method 2800 includes sealing the hermetically-sealable overwrap covering the multi-monodose container to hermetically-seal the multi-monodose container therein, as shown in block 2840. In an aspect, method 2800 includes in block 3100 sealing a first layer of hermetically-sealable overwrap to a second layer of hermetically-sealable overwrap to hermetically seal the multi-monodose container therein. In an aspect, method 2800 includes in block 3110 bonding at least a portion of the hermetically-sealable overwrap covering the multi-monodose container to at least a portion of a surface of the multi-monodose container to hermetically seal the multi-monodose container therein. In an aspect, bonding at least a portion of the hermetically-sealable overwrap includes in block 3120 bonding at least a portion of the hermetically-sealable overwrap covering the multi-monodose container to at least a portion of a surface of the multi-monodose container associated with the one or more articulating joints to hermetically seal the multi-monodose container therein. In an aspect, bonding at least a portion of the hermetically-sealable overwrap includes in block 3130 bonding at least a portion of the hermetically-sealable overwrap covering the multi-monodose container to at least a portion of a surface of the multi-monodose container around and between each of the monodose pharmaceutical vials in the row of interconnected monodose pharmaceutical vials. For example, the hermetically-sealable overwrap can be bond to the surface of the multi-monodose container so as to form individually wrapped/hermetically sealed monodose pharmaceutical vials. In an aspect, the hermetically-sealable overwrap includes perforations aligned with frangible articulating joints allowing for separation of individually wrapped/hermetically-sealed monodose pharmaceutical vials from one another. In an aspect, sealing the hermetically-sealable overwrap includes in block 3140 heat-sealing the hermetically-sealable overwrap covering the multi-monodose container to hermetically seal the multi-monodose container therein. In an aspect, sealing the hermetically-sealable overwrap includes in block 3150 pressure-sealing the hermetically-sealable overwrap covering the multi-monodose container to hermetically seal the multi-monodose container therein. In an aspect, sealing the hermetically-sealable overwrap includes in block 3160 chemically-sealing the hermetically-sealable overwrap covering the multi-monodose container to hermetically seal the multi-monodose container therein.

In an aspect, method 2800 includes forming a gas-impermeable seal around the multi-monodose container. In an aspect, method 2800 includes forming a vapor-impermeable seal around the multi-monodose container. In an aspect, method 2800 includes forming a light-impermeable seal around the multi-monodose container. In an aspect, method 2800 includes forming an electrostatic discharge-protective seal around the multi-monodose container.

FIG. 32 is a block diagram illustrating further aspects of a method 2800 of packaging a multi-monodose container. In an aspect, method 2800 includes in block 3200 attaching at least one label to an outer surface of the hermetically-sealable overwrap, the at least one label including at least one sensor. In an aspect, method 2800 includes in block 3210 attaching at least one label to an outer surface of the hermetically-sealable overwrap, the at least one label including at least one temperature sensor. Non-limiting aspects of labels and associated environmental sensors have been described above herein.

In an aspect, a method 2800 of packaging a multi-monodose container further includes in block 3220 bending the hermetically sealed multi-monodose container at the one or more articulating joints of the multi-monodose container to form a folded configuration; and adding a tertiary covering to maintain the hermetically sealed multi-monodose container in the folded configuration. For example, once the multi-monodose container has been sealed in the hermetically-sealable overwrap, the hermetically-sealed multi-monodose container can be folded along the length of the articulating joints connecting the monodose pharmaceutical vials to create a more compact configuration. This compact configuration can be further covered with tertiary packaging, e.g., shrink wrap, to keep the hermetically-sealed multi-monodose container in the compact or folded configuration.

In an aspect, a method 2800 of packaging a multi-monodose container further includes in block 3230 at least partially perforating the hermetically-sealable overwrap to add a frangible portion to the hermetically-sealable overwrap between each of the monodose pharmaceutical vials in the row of interconnected monodose pharmaceutical vials. For example, the hermetically-sealable overwrap can include perforations for allowing separation of monodose pharmaceutical vials from one another.

Figure 33A:
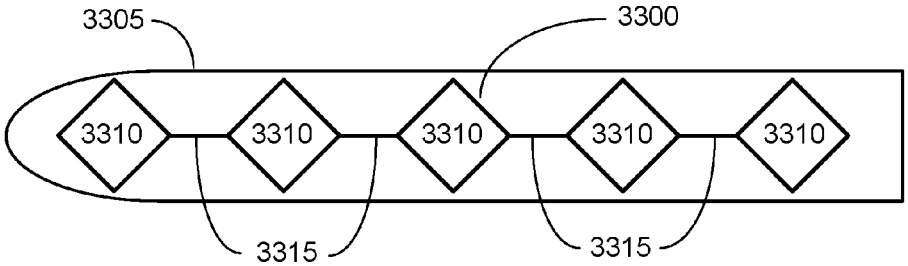
FIG. 33A illustrates aspects of a method of packaging a multi-monodose container.
Figure 33B:
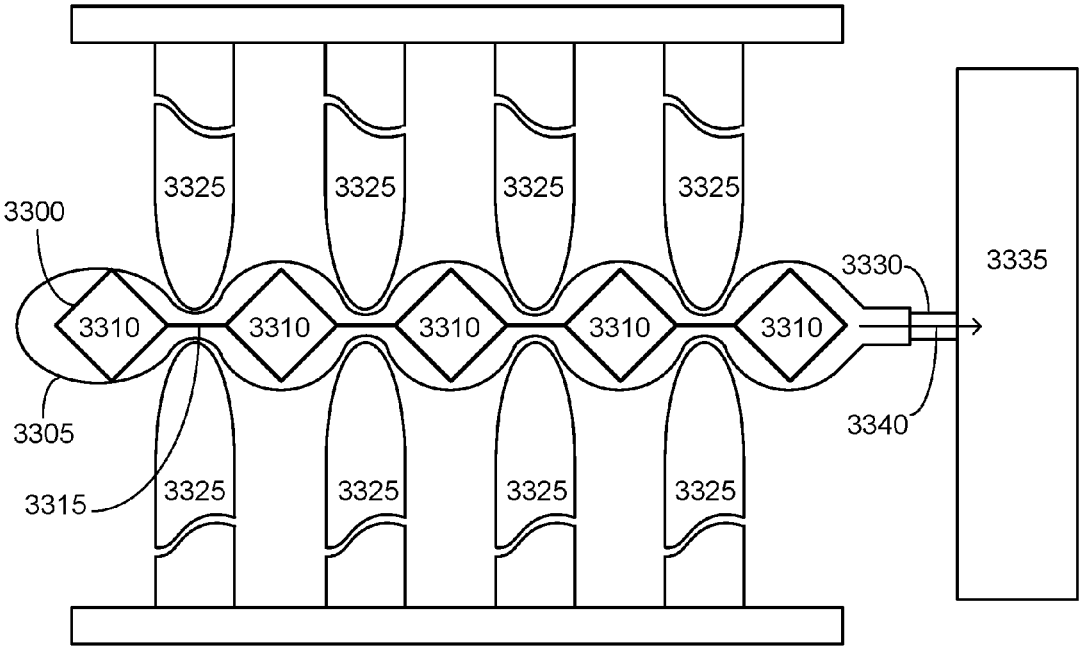
FIG. 33B depicts aspects of a method of packaging a multi-monodose container.
Figure 33C:
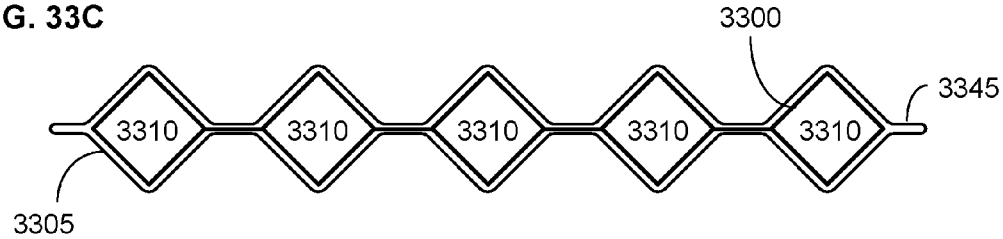
FIG. 33C shows aspects of a method of packaging a multi-monodose container.
Figure 33D:
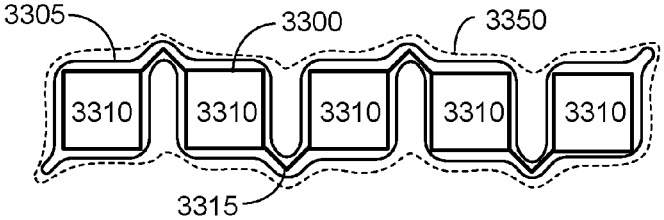
FIG. 33D illustrates aspects of a method of packaging a multi-monodose container.

FIG. 33A-33D illustrate further aspects of a method of packaging a multi-monodose container. FIG. 33A shows a top-down view of a multi-monodose container 3300 covered by a hermetically-sealable overwrap 3305. Multi-monodose container 3300 includes a row of interconnected monodose pharmaceutical vials 3310 connected by one or more articulating joints 3315. FIG. 33B shows a top-down view of multi-monodose container 3300 covered by overwrap 3305. In this non-limiting example, a force is being exerted while at least a portion of the injected inert gas is being evacuated from the hermetically-sealable overwrap. In this non-limiting example, a force is being exerted on the external surface of the hermetically-sealable overwrap 3305 covering the multi-monodose container 3300 with multiple mechanical probes 3325. Each of the mechanical probes 3325 is exerting a force on the external surface of the hermetically-sealable overwrap 3305 at a position aligned with or proximal to the articulating joints 3315. In this non-limiting example, a flow conduit 3330 is connected to a vacuum source 3335 is shown inserted into an opening defined by the hermetically-sealable overwrap 3305. In some embodiments, a portion of the hermetically-sealable overwrap 3305 is pressure sealed to the flow conduit 3330 to form a pocket around the multi-monodose container 3300. Also shown is at least a portion of air being evacuated 3340 (arrow) from the hermetically-sealable overwrap 3305 by virtue of vacuum source 3335. FIG. 33C shows a top-down view multi-monodose container 3300 and the row of monodose pharmaceutical vials 3310 hermetically sealed 3345 within hermetically-sealable overwrap 3305. In some embodiments, the hermetically sealed multi-monodose container is bent at the one or more articulating joints to form a folded and more compact configuration. FIG. 33D illustrates a top-down view of multi-monodose container 3300 hermetically sealed in hermetically-sealable overwrap 3305. The multi-monodose container 3300 and the hermetically-sealable overwrap 3305 are bent at the articulating joint 3315 to bring the monodose pharmaceutical vials 3310 into closer proximity to one another in a folded configuration. In some embodiments, the multi-monodose container 3300 in the folded configuration is further covered by a tertiary covering 3350.

Figure 34A:
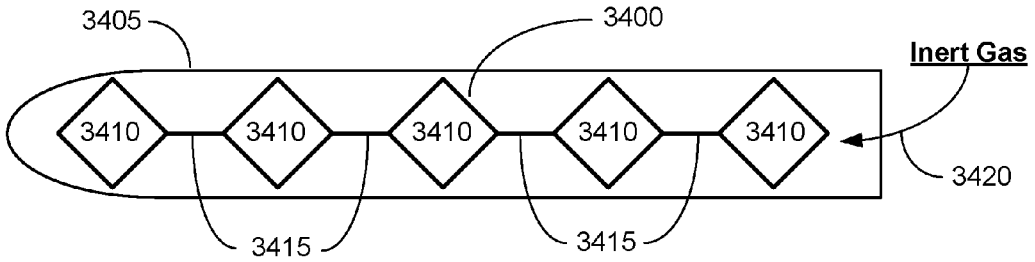
FIG. 34A depicts aspects of a method of packaging a multi-monodose container.
Figure 34B:
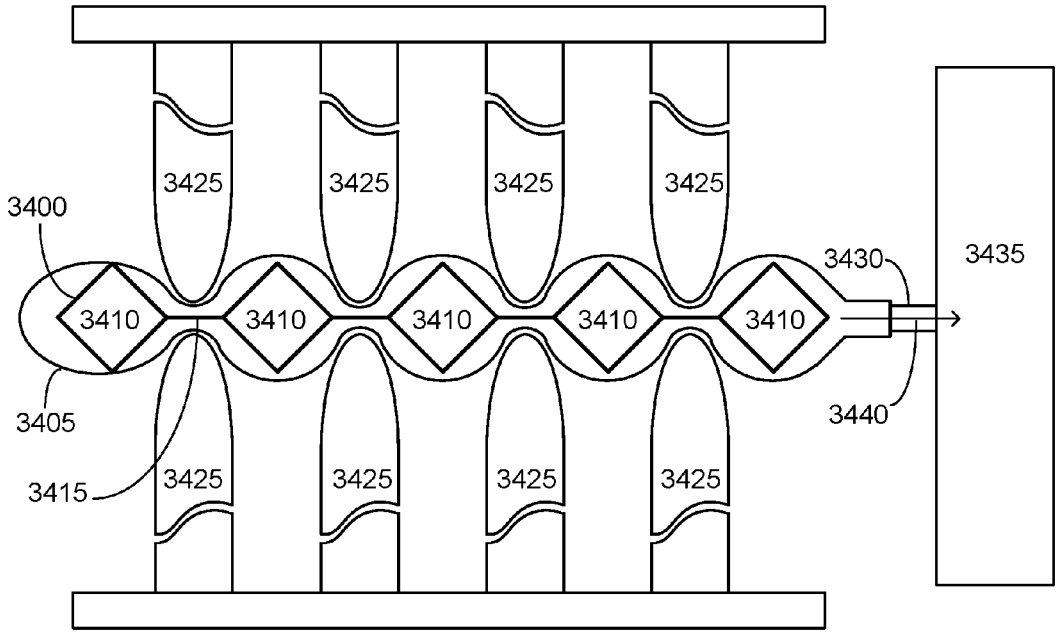
FIG. 34B shows aspects of a method of packaging a multi-monodose container.
Figure 34C:
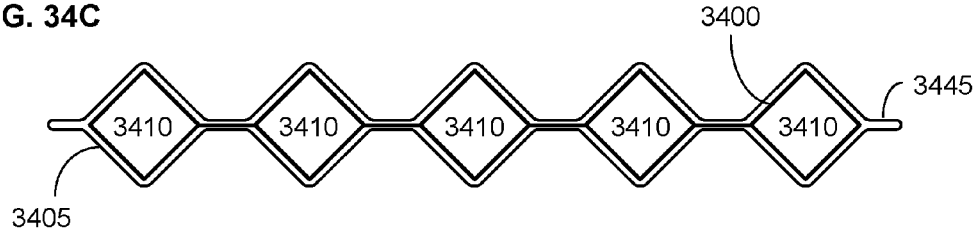
FIG. 34C illustrates aspects of a method of packaging a multi-monodose container.
Figure 34D:
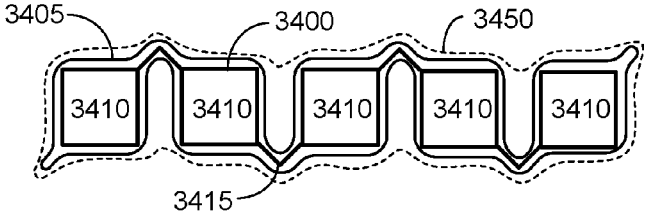
FIG. 34D depicts aspects of a method of packaging a multi-monodose container.

FIG. 34A-34D illustrate further aspects of a method of packaging a multi-monodose container. FIG. 34A shows a top-down view of a multi-monodose container 3400 covered by a hermetically-sealable overwrap 3405. Multi-monodose container 3400 includes a row of interconnected monodose pharmaceutical vials 3410 connected by one or more articulating joints 3415. Also shown is inert gas being injected 3420 (arrow) into the hermetically-sealable overwrap 3405 covering the multi-monodose container 3400. FIG. 34B shows a top-down view of multi-monodose container 3400 covered by overwrap 3405. In this non-limiting example, a force is being exerted while at least a portion of the injected inert gas is being evacuated from the hermetically-sealable overwrap. In this non-limiting example, a force is being exerted on the external surface of the hermetically-sealable overwrap 3405 covering the multi-monodose container 3400 with multiple mechanical probes 3425. Each of the mechanical probes 3425 is exerting a force on the external surface of the hermetically-sealable overwrap 3405 at a position aligned with or proximal to the articulating joints 3415. In this non-limiting example, a flow conduit 3430 is connected to a vacuum source 3435 is shown inserted into an opening defined by the hermetically-sealable overwrap 3405. In some embodiments, a portion of the hermetically-sealable overwrap 3405 is pressure sealed to the flow conduit 3430 to form a pocket around the multi-monodose container 3400. Also shown is at least a portion of the injected inert gas being evacuated 3440 (arrow) from the hermetically-sealable overwrap 3405 by virtue of vacuum source 3435. FIG. 34C shows a top-down view multi-monodose container 3400 and the row of monodose pharmaceutical vials 3410 hermetically sealed 3445 within hermetically-sealable overwrap 3405. In some embodiments, the hermetically sealed multi-monodose container is bent at the one or more articulating joints to form a folded and more compact configuration. FIG. 34D illustrates a top-down view of multi-monodose container 3400 hermetically sealed in hermetically-sealable overwrap 3405. The multi-monodose container 3400 and the hermetically-sealable overwrap 3405 are bent at the articulating joint 3415 to bring the monodose pharmaceutical vials 3410 into closer proximity to one another in a folded configuration. In some embodiments, the multi-monodose container 3400 in the folded configuration is further covered by a tertiary covering 3450.

One skilled in the art will recognize that the herein described component, devices, objects, and the discussion accompanying them are used as examples for the sake of conceptual clarity and that various configuration modifications are contemplated. Consequently, as used herein, the specific exemplars set forth and the accompanying discussion are intended to be representative of their more general classes. In general, use of any specific exemplar is intended to be representative of its class, and the non-inclusion of specific components, devices, and objects should not be taken as limiting.

With respect to the use of substantially any plural and/or singular terms herein, the plural can be translated to the singular and/or from the singular to the plural as is appropriate to the context and/or application. The various singular/plural permutations are not expressly set forth herein for sake of clarity.

In some instances, one or more components can be referred to herein as "configured to," "configured by," "configurable to," "operable/operative to," "adapted/adaptable," "able to," "conformable/conformed to," etc. Those skilled in the art will recognize that such terms (e.g. "configured to") can generally encompass active-state components and/or inactive-state components and/or standby-state components, unless context requires otherwise.

While particular aspects of the present subject matter described herein have been shown and described, changes and modifications can be made without departing from the subject matter described herein and its broader aspects and, therefore, the appended claims are to encompass within their scope all such changes and modifications as are within the true spirit and scope of the subject matter described herein. Terms used herein, and especially in the appended claims (e.g., bodies of the appended claims) are generally intended as "open" terms (e.g., the term "including" should be interpreted as "including but not limited to," the term "having" should be interpreted as "having at least," the term "includes" should be interpreted as "includes but is not limited to," etc.). If a specific number of an introduced claim recitation is intended, such an intent will be explicitly recited in the claim, and in the absence of such recitation no such intent is present. For example, as an aid to understanding, the following appended claims can contain usage of the introductory phrases "at least one" and "one or more" to introduce claim recitations. However, the use of such phrases should not be construed to imply that the introduction of a claim recitation by the indefinite articles "a" or "an" limits any particular claim containing such introduced claim recitation to claims containing only one such recitation, even when the same claim includes the introductory phrases "one or more" or "at least one" and indefinite articles such as "a" or "an" (e.g., "a" and/or "an" should typically be interpreted to mean "at least one" or "one or more"); the same holds true for the use of definite articles used to introduce claim recitations. In addition, even if a specific number of an introduced claim recitation is explicitly recited, such recitation should typically be interpreted to mean at least the recited number (e.g., the bare recitation of "two recitations," without other modifiers, typically means at least two recitations, or two or more recitations). Furthermore, in those instances where a convention analogous to "at least one of A, B, and C, etc." is used, in general such a construction is intended in the sense one having skill in the art would understand the convention (e.g., "a system having at least one of A, B, and C" would include but not be limited to systems that have A alone, B alone, C alone, A and B together, A and C together, B and C together, and/or A, B, and C together, etc.). In those instances where a convention analogous to "at least one of A, B, or C, etc." is used, in general such a construction is intended in the sense one having skill in the art would understand the convention (e.g., "a system having at least one of A, B, or C" would include but not be limited to systems that have A alone, B alone, C alone, A and B together, A and C together, B and C together, and/or A, B, and C together, etc.). Typically a disjunctive word and/or phrase presenting two or more alternative terms, whether in the description, claims, or drawings, should be understood to contemplate the possibilities of including one of the terms, either of the terms, or both terms unless context dictates otherwise. For example, the phrase "A or B" will be typically understood to include the possibilities of "A" or "B" or "A and B."

Aspects of the Subject Matter Described Herein are Set Out in the Following Numbered Paragraphs:

1. A method of packaging a multi-monodose container, comprising: covering a molded structure with a hermetically-sealable overwrap, the molded structure including a first portion and a second portion, the first portion including a row of interconnected monodose pharmaceutical vials, each of the interconnected monodose pharmaceutical vials enclosing a dose of at least one pharmaceutical agent; the second portion affixed to the first portion and including a textured surface pattern positioned to direct gas flow between the first portion and a region adjacent to the second portion; evacuating at least a portion of air from around the molded structure covered by the hermetically-sealable overwrap, the evacuated at least a portion of the air at least partially flowing over the textured surface pattern of the second portion of the molded structure; forming a hermetic seal around the row of interconnected monodose pharmaceutical vials by bonding the hermetically-sealable overwrap to at least a portion of a surface of the molded structure; and separating the second portion of the molded structure from the first portion of the molded structure.

2. The method of paragraph 1, wherein covering the molded structure with the hermetically-sealable overwrap comprises inserting the molded structure into an opening defined by the hermetically-sealable overwrap.

3. The method of paragraph 2, wherein inserting the molded structure into the opening defined by the hermetically-sealable overwrap comprises inserting the first portion of the molded structure into the opening defined by the hermetically-sealable overwrap first so that the second portion of the molded structure is proximal to the opening defined by the hermetically-sealable overwrap.

4. The method of paragraph 1, wherein covering the molded structure with the hermetically-sealable overwrap comprises positioning the molded structure between a first layer of hermetically-sealable overwrap and a second layer of hermetically-sealable overwrap; and sealing together one or more edges of the first layer and the second layer of the hermetically-sealable overwrap.

5. The method of paragraph 1, wherein covering the molded structure with the hermetically-sealable overwrap comprises covering the molded structure with a hermetically-sealable pouch.

6. The method of paragraph 1, wherein covering the molded structure with the hermetically-sealable overwrap comprises covering the molded structure with a hermetically-sealable sleeve.

7. The method of paragraph 1, wherein covering the molded structure with the hermetically-sealable overwrap comprises covering the molded structure with a hermetically-sealable foil laminate.

8. The method of paragraph 1, wherein covering the molded structure with the hermetically-sealable overwrap comprises covering the molded structure with a hermetically-sealable overwrap formed from at least one of polyester, foil, polypropylene, cast polypropylene, polyethylene, high-density polyethylene, metallocene polyethylene, linear low density polyethylene, or metalized film.

9. The method of paragraph 1, wherein covering the molded structure with the hermetically-sealable overwrap comprises covering the molded structure with a gas-impermeable overwrap.

10. The method of paragraph 1, wherein covering the molded structure with the hermetically-sealable overwrap comprises covering the molded structure with a vapor-impermeable overwrap.

11. The method of paragraph 1, wherein covering the molded structure with the hermetically-sealable overwrap comprises covering the molded structure with a light-impermeable overwrap.

12. The method of paragraph 1, wherein covering the molded structure with the hermetically-sealable overwrap comprises covering the molded structure with an electrostatic discharge-protective overwrap.

13. The method of paragraph 1, wherein the molded structure including the first portion and the second portion is formed by a blow-fill-seal manufacturing process.

14. The method of paragraph 1, wherein the molded structure including the first portion and the second portion is formed from at least one biocompatible thermoplastic material.

15. The method of paragraph 1, wherein the row of interconnected monodose pharmaceutical vials comprises two or more interconnected monodose pharmaceutical vials.

16. The method of paragraph 1, wherein each of the interconnected monodose pharmaceutical vials is polygonal in cross-section perpendicular to an axis formed by the first portion and the second portion of the molded structure.

17. The method of paragraph 1, wherein the dose of the at least one pharmaceutical agent comprises a dose of at least one vaccine.

18. The method of paragraph 1, wherein the dose of the at least one pharmaceutical agent comprises a dose of at least one therapeutic agent.

19. The method of paragraph 1, wherein the dose of the at least one pharmaceutical agent is in liquid form.

20. The method of paragraph 1, wherein the dose of the at least one pharmaceutical agent is in lyophilized form.

21. The method of paragraph 1, wherein each of the interconnected monodose vials comprises: an internal volume holding the dose of the at least one pharmaceutical agent.

22. The method of paragraph 21, wherein the internal volume holding the dose of the at least one pharmaceutical agent includes an inert gas-filled head space.

23. The method of paragraph 1, wherein each of the interconnected monodose pharmaceutical vials includes a needle-penetrable access portion.

24. The method of paragraph 1, wherein at least one of the monodose pharmaceutical vials is attached through an articulating joint to at least one adjacent monodose pharmaceutical vial, the articulating joint sufficiently flexible to reversibly mate a planar outer surface of the at least one of the monodose pharmaceutical vials with a planar outer surface of the at least one adjacent monodose pharmaceutical vial.

25. The method of paragraph 1, wherein the textured surface pattern positioned to direct gas flow between the first portion and the region adjacent to the second portion comprises a debossed surface pattern positioned to direct gas flow between the first portion and the region adjacent to the second portion.

26. The method of paragraph 1, wherein the textured surface pattern positioned to direct gas flow between the first portion and the region adjacent to the second portion comprises an embossed surface pattern positioned to direct gas flow between the first portion and the region adjacent to the second portion.

27. The method of paragraph 1, wherein at least a portion of the textured surface pattern includes channels aligned parallel to the directed gas flow between the first portion and the region adjacent to the second portion.

28. The method of paragraph 1, wherein the second portion is affixed to the first portion adjacent to a top portion of the row of interconnected monodose pharmaceutical vials.

29. The method of paragraph 1, wherein the second portion is affixed to the first portion adjacent to a bottom portion of the row of interconnected monodose pharmaceutical vials.

30. The method of paragraph 1, wherein the first portion of the molded structure includes at least one label including at least one sensor.

31. The method of paragraph 1, wherein each of the interconnected monodose pharmaceutical vials includes a label including at least one of a temperature sensor, a moisture sensor, a light sensor, or an oxygen sensor.

32. The method of paragraph 1, wherein evacuating the at least a portion of the air from around the molded structure covered by the hermetically-sealable overwrap comprises inserting a flow conduit connected to a vacuum source into an opening defined by the hermetically-sealable overwrap at a position adjacent to the textured surface pattern on the second portion of the molded structure; pressure sealing a portion of the hermetically-sealable overwrap around the inserted flow conduit to form a hermetically-sealed pocket around the molded structure; and evacuating the at least a portion of the air from the hermetically-sealed pocket around the molded structure, the evacuated at least a portion of the air at least partially flowing over the textured surface pattern of the second portion of the molded structure.

33. The method of paragraph 1, comprising injecting an inert gas around the molded structure covered by the hermetically-sealable overwrap; and evacuating at least a portion of the injected inert gas from around the molded structure covered by the hermetically-sealable overwrap, the evacuated at least a portion of the injected inert gas at least partially flowing over the textured surface pattern of the second portion of the molded structure.

34. The method of paragraph 33, wherein injecting the inert gas around the molded structure covered by the hermetically-sealable overwrap comprises injecting nitrogen around the molded structure covered by the hermetically-sealable overwrap.

35. The method of paragraph 33, wherein injecting the inert gas around the molded structure covered by the hermetically-sealable overwrap comprises injecting a noble gas around the molded structure covered by the hermetically-sealable overwrap.

36. The method of paragraph 33, comprising evacuating the at least a portion of the air from around the molded structure covered by the hermetically-sealable overwrap prior to injecting the inert gas.

37. The method of paragraph 1, wherein forming the hermetic seal around the row of interconnected monodose pharmaceutical vials comprises forming a gas-impermeable seal around the row of interconnected monodose pharmaceutical vials.

38. The method of paragraph 1, wherein forming the hermetic seal around the row of interconnected monodose pharmaceutical vials comprises forming a vapor-impermeable seal around the row of interconnected monodose pharmaceutical vials.

39. The method of paragraph 1, wherein forming the hermetic seal around the row of interconnected monodose pharmaceutical vials comprises forming a light-impermeable seal around the row of interconnected monodose pharmaceutical vials.

40. The method of paragraph 1, wherein forming the hermetic seal around the row of interconnected monodose pharmaceutical vials comprises forming an electrostatic discharge-protective seal around the row of interconnected monodose pharmaceutical vials.

41. The method of paragraph 1, wherein forming the hermetic seal around the row of interconnected monodose pharmaceutical vials comprises forming the hermetic seal around the row of interconnected monodose pharmaceutical vials under balanced or near-balanced pressure.

42. The method of paragraph 1, wherein forming the hermetic seal around the row of interconnected monodose pharmaceutical vials comprises forming the hermetic seal around the row of interconnected monodose pharmaceutical vials under positive pressure.

43. The method of paragraph 1, wherein bonding the hermetically-sealable overwrap to the at least a portion of the surface of the molded structure comprises bonding the hermetically-sealable overwrap to a surface of the first portion of the molded structure proximal to the second portion of the molded structure.

44. The method of paragraph 1, wherein bonding the hermetically-sealable overwrap to the at least a portion of the surface of the molded structure comprises bonding the hermetically-sealable overwrap to a surface of the first portion of the molded structure between each of the interconnected monodose pharmaceutical vials.

45. The method of paragraph 1, wherein bonding the hermetically-sealable overwrap to the at least a portion of the surface of the molded structure comprises applying heat to bond the hermetically-sealable overwrap to the at least a portion of the surface of the molded structure.

46. The method of paragraph 1, wherein bonding the hermetically-sealable overwrap to the at least a portion of the surface of the molded structure comprises applying pressure to bond the hermetically-sealable overwrap to the at least a portion of the surface of the molded structure.

47. The method of paragraph 1, wherein bonding the hermetically-sealable overwrap to the at least a portion of the surface of the molded structure comprises chemically-bonding the hermetically-sealable overwrap to the at least a portion of the surface of the molded structure.

48. The method of paragraph 1, further comprising at least partially perforating the hermetically-sealable overwrap to add a frangible portion to the hermetically-sealable overwrap between each of the interconnected monodose pharmaceutical vials.

49. The method of paragraph 1, further comprising applying at least one label having at least one sensor to an external surface of the hermetically-sealable overwrap.

50. A method of packaging a multi-monodose container, comprising covering a molded structure with a hermetically-sealable overwrap, the molded structure including a row of interconnected monodose pharmaceutical vials, each of the interconnected monodose pharmaceutical vials enclosing a dose of at least one pharmaceutical agent, and a textured surface pattern positioned to direct gas flow between a first portion of the molded structure and a region adjacent to a second portion of the molded structure; evacuating at least a portion of air from around the molded structure covered by the hermetically-sealable overwrap, the evacuated at least a portion of the air at least partially flowing over the textured surface pattern on the molded structure; and forming a hermetic seal around the row of interconnected monodose pharmaceutical vials.

51. The method of paragraph 50, wherein covering the molded structure with the hermetically-sealable overwrap comprises inserting the molded structure into an opening defined by the hermetically-sealable overwrap.

52. The method of paragraph 50, wherein covering the molded structure with the hermetically-sealable overwrap comprises positioning the molded structure between a first layer of hermetically-sealable overwrap and a second layer of hermetically-sealable overwrap; and sealing together one or more edges of the first layer and the second layer of hermetically-sealable overwrap.

53. The method of paragraph 50, wherein covering the molded structure with the hermetically-sealable overwrap comprises covering the molded structure with a hermetically-sealable pouch.

54. The method of paragraph 50, wherein covering the molded structure with the hermetically-sealable overwrap comprises covering the molded structure with a hermetically-sealable sleeve.

55. The method of paragraph 50, wherein covering the molded structure with the hermetically-sealable overwrap comprises covering the molded structure with a hermetically-sealable foil laminate.

56. The method of paragraph 50, wherein covering the molded structure with the hermetically-sealable overwrap comprises covering the molded structure with a hermetically-sealable overwrap formed from at least one of polyester, foil, polypropylene, cast polypropylene, polyethylene, high-density polyethylene, metallocene polyethylene, linear low density polyethylene, or metalized film.

57. The method of paragraph 50, wherein covering the molded structure with the hermetically-sealable overwrap comprises covering the molded structure with a gas-impermeable overwrap.

58. The method of paragraph 50, wherein covering the molded structure with the hermetically-sealable overwrap comprises covering the molded structure with a vapor-impermeable overwrap.

59. The method of paragraph 50, wherein covering the molded structure with the hermetically-sealable overwrap comprises covering the molded structure with a light-impermeable overwrap.

60. The method of paragraph 50, wherein covering the molded structure with the hermetically-sealable overwrap comprises covering the molded structure with an electrostatic discharge-protective overwrap.

61. The method of paragraph 50, wherein the molded structure including the row of interconnected monodose pharmaceutical vials and the textured surface pattern is formed by a blow-fill-seal manufacturing process.

62. The method of paragraph 50, wherein the molded structure including the row of interconnected monodose pharmaceutical vials and the textured surface pattern is formed from at least one biocompatible thermoplastic material.

63. The method of paragraph 50, wherein the row of interconnected monodose pharmaceutical vials comprises two or more interconnected monodose pharmaceutical vials.

64. The method of paragraph 50, wherein each of the interconnected monodose pharmaceutical vials is square, triangular, hexagonal, or polygonal in horizontal cross-section.

65. The method of paragraph 50, wherein the dose of the at least one pharmaceutical agent comprises a dose of at least one vaccine.

66. The method of paragraph 50, wherein the dose of the at least one pharmaceutical agent comprises a dose of at least one therapeutic agent.

67. The method of paragraph 50, wherein the dose of the at least one pharmaceutical agent is in liquid form.

68. The method of paragraph 50, wherein the dose of the at least one pharmaceutical agent is in lyophilized form.

69. The method of paragraph 50, wherein each of the interconnected monodose vials comprises an internal volume holding the dose of the at least one pharmaceutical agent.

70. The method of paragraph 69, wherein the internal volume holding the dose of the at least one pharmaceutical agent includes an inert gas-filled head space.

71. The method of paragraph 50, wherein each of the interconnected monodose pharmaceutical vials includes a needle-penetrable access portion.

72. The method of paragraph 50, wherein at least one of the monodose pharmaceutical vials is attached through an articulating joint to at least one adjacent monodose pharmaceutical vial, the articulating joint sufficiently flexible to reversibly mate a planar outer surface of the at least one of the monodose pharmaceutical vials with a planar outer surface of the at least one adjacent monodose pharmaceutical vial.

73. The method of paragraph 50, wherein at least a portion of the textured surface pattern includes channels aligned parallel to the directed gas flow between the first portion of the molded structure and the region adjacent to the second portion of the molded structure.

74. The method of paragraph 50, wherein the textured surface pattern is on an outer surface of at least one of the interconnected monodose pharmaceutical vials.

75. The method of paragraph 50, wherein the textured surface pattern is on a surface of the molded structure adjacent to the row of interconnected monodose pharmaceutical vials.

76. The method of paragraph 50, wherein the textured surface pattern is on a tab portion adjacent to a top portion of the row of interconnected monodose pharmaceutical vials.

77. The method of paragraph 50, wherein the textured surface pattern is on a tab portion adjacent to a bottom portion of the row of interconnected pharmaceutical vials.

78. The method of paragraph 50, wherein the textured surface pattern positioned to direct gas flow between the first portion of the molded structure and the region adjacent to the second portion of the molded structure comprises a debossed surface pattern positioned to direct gas flow between the first portion of the molded structure and the region adjacent to the second portion of the molded structure.

79. The method of paragraph 50, wherein the textured surface pattern positioned to direct gas flow between the first portion of the molded structure and the region adjacent to the second portion of the molded structure comprises an embossed surface pattern positioned to direct gas flow between the first portion of the molded structure and the region adjacent to the second portion of the molded structure.

80. The method of paragraph 50, wherein the molded structure includes at least one label including at least one sensor.

81. The method of paragraph 50, wherein each of the interconnected monodose pharmaceutical vials includes a label including at least one of a temperature sensor, a moisture sensor, a light sensor, or an oxygen sensor.

82. The method of paragraph 50, wherein evacuating the at least a portion of the air from around the molded structure covered by the hermetically-sealable overwrap comprises inserting a flow conduit connected to a vacuum source into an opening defined by the hermetically-sealable overwrap at a position adjacent to the textured surface pattern on the second portion of the molded structure; pressure sealing a portion of the hermetically-sealable overwrap around the inserted flow conduit to form a hermetically-sealed pocket around the molded structure; and evacuating the at least a portion of the air from the hermetically-sealed pocket around the molded structure, the evacuated at least a portion of the air at least partially flowing over the textured surface pattern of the second portion of the molded structure.

83. The method of paragraph 50, comprising injecting an inert gas around the molded structure covered by the hermetically-sealable overwrap; and evacuating at least a portion of the injected inert gas from around the molded structure covered by the hermetically-sealable overwrap, the evacuated at least a portion of the injected inert gas at least partially flowing over the textured surface pattern of the second portion of the molded structure.

84. The method of paragraph 83, wherein injecting the inert gas around the molded structure covered by the hermetically-sealable overwrap comprises injecting nitrogen around the molded structure covered by the hermetically-sealable overwrap.

85. The method of paragraph 83, wherein injecting the inert gas around the molded structure covered by the hermetically-sealable overwrap comprises injecting a noble gas around the molded structure covered by the hermetically-sealable overwrap.

86. The method of paragraph 83, comprising evacuating the at least a portion of the air from around the molded structure covered by the hermetically-sealable overwrap prior to injecting the inert gas.

87. The method of paragraph 50, wherein forming the hermetic seal around the row of interconnected monodose pharmaceutical vials comprises forming a gas-impermeable seal around the row of interconnected monodose pharmaceutical vials.

88. The method of paragraph 50, wherein forming the hermetic seal around the row of interconnected monodose pharmaceutical vials comprises forming a vapor-impermeable seal around the row of interconnected monodose pharmaceutical vials.

89. The method of paragraph 50, wherein forming the hermetic seal around the row of interconnected monodose pharmaceutical vials comprises forming a light-impermeable seal around the row of interconnected monodose pharmaceutical vials.

90. The method of paragraph 50, wherein forming the hermetic seal around the row of interconnected monodose pharmaceutical vials comprises forming an electrostatic discharge-protective seal around the row of interconnected monodose pharmaceutical vials.

91. The method of paragraph 50, wherein forming the hermetic seal around the row of interconnected monodose pharmaceutical vials comprises forming a hermetic seal around the entirety of the molded structure including the row of interconnected monodose pharmaceutic vials.

92. The method of paragraph 50, wherein forming the hermetic seal around the row of interconnected monodose pharmaceutical vials comprises bonding at least a portion of the hermetically-sealable overwrap to at least a portion of a surface of the molded structure.

93. The method of paragraph 50, wherein forming the hermetic seal around the row of interconnected monodose pharmaceutical vials comprises bonding at least a portion of the hermetically-sealable overwrap to at least a portion of a surface of the molded structure around and between each of the interconnected monodose pharmaceutical vials.

94. The method of paragraph 50, wherein forming the hermetic seal around the row of interconnected monodose pharmaceutical vials comprises applying heat to the hermetically-sealable overwrap to form the hermetic seal around the row of interconnected monodose pharmaceutical vials.

95. The method of paragraph 50, wherein forming the hermetic seal around the row of interconnected monodose pharmaceutical vials comprises applying pressure to the hermetically-sealable overwrap to form the hermetic seal around the row of interconnected monodose pharmaceutical vials.

96. The method of paragraph 50, wherein forming the hermetic seal around the row of interconnected monodose pharmaceutical vials comprises chemically-bonding the hermetically-sealable overwrap to form the hermetic seal around the row of interconnected monodose pharmaceutical vials.

97. The method of paragraph 50, wherein forming the hermetic seal around the row of interconnected monodose pharmaceutical vials comprises forming the hermetic seal around the row of interconnected monodose pharmaceutical vials under balanced or near-balanced pressure.

98. The method of paragraph 50, wherein forming the hermetic seal around the row of interconnected monodose pharmaceutical vials comprises forming the hermetic seal around the row of interconnected monodose pharmaceutical vials under positive pressure.

99. The method of paragraph 50, comprising separating the first portion of the molded structure from the second portion of the molded structure.

100. The method of paragraph 50, comprising at least partially perforating the hermetically-sealable overwrap to add a frangible portion to the hermetically-sealable overwrap between each of the monodose pharmaceutical vials in the row of interconnected monodose pharmaceutical vials.

101. The method of paragraph 50, comprising applying at least one label having at least one sensor to an external surface of the hermetically-sealable overwrap.

102. A multi-monodose container comprising a molded structure including a first portion and a second portion, the first portion including a row of interconnected monodose pharmaceutical vials, each of the interconnected monodose pharmaceutical vials having an internal volume configured to hold a dose of at least one pharmaceutical agent; and the second portion affixed to the first portion, the second portion including a textured surface pattern positioned to direct gas flow between the first portion and a region adjacent to the second portion.

103. The multi-monodose container of paragraph 102, wherein the molded structure including the first portion and the second portion is formed by a blow molding manufacturing process.

104. The multi-monodose container of paragraph 102, wherein the molded structure including the first portion and the second portion is formed by an injection molding manufacturing process.

105. The multi-monodose container of paragraph 102, wherein the molded structure including the first portion and the second portion is formed by a blow-fill-seal manufacturing process.

106. The multi-monodose container of paragraph 102, wherein the molded structure including the first portion and the second portion is formed from at least one biocompatible polymer.

107. The multi-monodose container of paragraph 102, wherein the molded structure including the first portion and the second portion is formed from at least one thermoplastic material.

108. The multi-monodose container of paragraph 102, wherein the row of interconnected monodose pharmaceutical vials comprises at least two interconnected monodose pharmaceutical vials.

109. The multi-monodose container of paragraph 102, wherein the row of interconnected monodose pharmaceutical vials comprises three or more interconnected monodose pharmaceutical vials.

110. The multi-monodose container of paragraph 102, wherein each of the interconnected monodose pharmaceutical vials is polygonal in cross-section perpendicular to an axis formed by the first portion and the second portion of the molded structure.

111. The multi-monodose container of paragraph 102, wherein each of the interconnected monodose pharmaceutical vials is square in cross-section perpendicular to an axis formed by the first portion and the second portion of the molded structure.

112. The multi-monodose container of paragraph 102, wherein each of the interconnected monodose pharmaceutical vials is triangular in cross-section perpendicular to an axis formed by the first portion and the second portion of the molded structure.

113. The multi-monodose container of paragraph 102, wherein each of the interconnected monodose pharmaceutical vials is hexagonal in cross-section perpendicular to an axis formed by the first portion and the second portion.

114. The multi-monodose container of paragraph 102, wherein the internal volume configured to hold the dose of the at least one pharmaceutical agent is about 1.0 milliliter.

115. The multi-monodose container of paragraph 102, wherein the internal volume configured to hold the dose of the at least one pharmaceutical agent is in a range between about 0.2 milliliter to about 10 milliliters.

116. The multi-monodose container of paragraph 102, wherein the internal volume configured to hold the dose of the at least one pharmaceutical agent includes an inert gas-filled head space.

117. The multi-monodose container of paragraph 116, wherein the inert gas-filled head space comprises a nitrogen-filled head space.

118. The multi-monodose container of paragraph 102, wherein the dose of the at least one pharmaceutical agent comprises a dose of at least one vaccine.

119. The multi-monodose container of paragraph 102, wherein the dose of the at least one pharmaceutical agent comprises a dose of at least one therapeutic agent.

120. The multi-monodose container of paragraph 102, wherein the dose of the at least one pharmaceutical agent is in liquid form.

121. The multi-monodose container of paragraph 102, wherein the dose of the at least one pharmaceutical agent is in solid form.

122. The multi-monodose container of paragraph 102, wherein each of the interconnected monodose pharmaceutical vials includes a needle-penetrable access portion.

123. The multi-monodose container of paragraph 102, wherein each of the interconnected monodose pharmaceutical vials includes a shearable cap covering an access portion.

124. The multi-monodose container of paragraph 102, wherein each of the interconnected monodose pharmaceutical vials includes a twistable cap covering an access portion.

125. The multi-monodose container of paragraph 102, wherein each of the interconnected monodose pharmaceutical vials includes an insert covering an access portion.

126. The multi-monodose container of paragraph 102, wherein at least one of the interconnected monodose pharmaceutical vials is attached through an articulating joint to at least one adjacent monodose pharmaceutical vial, the articulating joint sufficiently flexible to reversibly mate a planar outer surface of the at least one of the interconnected monodose pharmaceutical vials with a planar outer surface of the at least one adjacent monodose pharmaceutical vial.

127. The multi-monodose container of paragraph 126, wherein the articulating joint is frangible.

128. The multi-monodose container of paragraph 102, wherein the row of interconnected monodose pharmaceutical vials is configured to form an expanded configuration and configured to form a folded configuration.

129. The multi-monodose container of paragraph 128, wherein the expanded configuration has a first rectangular packing cross-sectional area and the folded configuration has a second rectangular packing cross-sectional area, the second rectangular packing cross-sectional area smaller than the first rectangular packing cross-sectional area.

130. The multi-monodose container of paragraph 102, wherein the second portion of the molded structure is affixed to the first portion of the molded structure in proximity to a top of the row of interconnected monodose pharmaceutical vials.

131. The multi-monodose container of paragraph 102, wherein the second portion of the molded structure is affixed to the first portion of the molded structure in proximity to a bottom of the row of interconnected monodose pharmaceutical vials.

132. The multi-monodose container of paragraph 102, wherein the textured surface pattern positioned to direct gas flow between the first portion and the region adjacent to the second portion comprises a debossed surface pattern positioned to direct gas flow between the first portion and the region adjacent to the second portion.

133. The multi-monodose container of paragraph 102, wherein the textured surface pattern positioned to direct gas flow between the first portion and the region adjacent to the second portion comprises an embossed surface pattern positioned to direct gas flow between the first portion and the region adjacent to the second portion.

134. The multi-monodose container of paragraph 102, wherein at least a portion of the textured surface pattern includes channels aligned parallel to the directed gas flow between the first portion and the region adjacent to the second portion.

135. The multi-monodose container of paragraph 102, comprising at least one label associated with the first portion of the molded structure, the at least one label including at least one sensor.

136. The multi-monodose container of paragraph 135, wherein the at least one sensor includes at least one temperature sensor.

137. The multi-monodose container of paragraph 135, wherein the at least one sensor includes at least one of a light sensor or an oxygen sensor.

138. The multi-monodose container of paragraph 102, wherein each of the interconnected monodose pharmaceutical vials includes a label including at least one of a temperature sensor, a moisture sensor, a light sensor, or an oxygen sensor.

139. A multi-monodose container comprising a molded structure including a row of interconnected monodose pharmaceutical vials, each of the interconnected monodose pharmaceutical vials having an internal volume configured to hold a dose of at least one pharmaceutical agent; and a textured surface pattern positioned to direct gas flow between a first portion of the molded structure and a region adjacent to a second portion of the molded structure.

140. The multi-monodose container of paragraph 139, wherein the molded structure is formed by a blow molding manufacturing process.

141. The multi-monodose container of paragraph 139, wherein the molded structure is formed by an injection molding manufacturing process.

142. The multi-monodose container of paragraph 139, wherein the molded structure is formed by a blow-fill-seal manufacturing process.

143. The multi-monodose container of paragraph 139, wherein the molded structure is formed from at least one biocompatible thermoplastic material.

144. The multi-monodose container of paragraph 139, wherein the row of interconnected monodose pharmaceutical vials comprises two or more interconnected monodose pharmaceutical vials.

145. The multi-monodose container of paragraph 139, wherein each of the interconnected monodose pharmaceutical vials is polygonal in cross-section perpendicular to an axis formed by the first portion and the second portion.

146. The multi-monodose container of paragraph 139, wherein each of the interconnected monodose pharmaceutical vials is square in cross-section perpendicular to an axis formed by the first portion and the second portion.

147. The multi-monodose container of paragraph 139, wherein each of the interconnected monodose pharmaceutical vials is triangular in cross-section perpendicular to an axis formed by the first portion and the second portion.

148. The multi-monodose container of paragraph 139, wherein each of the interconnected monodose pharmaceutical vials is hexagonal in cross-section perpendicular to an axis formed by the first portion and the second portion.

149. The multi-monodose container of paragraph 139, wherein the internal volume configured to hold the dose of the at least one pharmaceutical agent is about 1.0 milliliter.

150. The multi-monodose container of paragraph 139, wherein the internal volume configured to hold the dose of the at least one pharmaceutical agent is in a range between about 0.2 milliliter to about 10 milliliters.

151. The multi-monodose container of paragraph 139, wherein the internal volume configured to hold the dose of the at least one pharmaceutical agent includes an inert gas-filled head space.

152. The multi-monodose container of paragraph 139, wherein the inert gas-filled head space comprises a nitrogen-fillable head space.

153. The multi-monodose container of paragraph 139, wherein the dose of the at least one pharmaceutical agent comprises a dose of at least one vaccine.

154. The multi-monodose container of paragraph 139, wherein the dose of the at least one pharmaceutical agent comprises a dose of at least one therapeutic agent.

155. The multi-monodose container of paragraph 139, wherein the dose of the at least one pharmaceutical agent is in liquid form.

156. The multi-monodose container of paragraph 139, wherein the dose of the at least one pharmaceutical agent is in solid form.

157. The multi-monodose container of paragraph 139, wherein each of the interconnected monodose pharmaceutical vials includes a needle-penetrable access portion.

158. The multi-monodose container of paragraph 139, wherein each of the interconnected monodose pharmaceutical vials includes a shearable cap covering an access portion.

159. The multi-monodose container of paragraph 139, wherein each of the interconnected monodose pharmaceutical vials includes a twistable cap covering an access portion.

160. The multi-monodose container of paragraph 139, wherein each of the interconnected monodose pharmaceutical vials includes an insert covering an access portion.

161. The multi-monodose container of paragraph 139, wherein at least one of the interconnected monodose pharmaceutical vials is attached through an articulating joint to at least one adjacent monodose pharmaceutical vial, the articulating joint sufficiently flexible to reversibly mate a planar outer surface of the at least one of the interconnected monodose pharmaceutical vials with a planar outer surface of the at least one adjacent monodose pharmaceutical vial.

162. The multi-monodose container of paragraph 161, wherein the articulating joint is frangible.

163. The multi-monodose container of paragraph 139, wherein the row of interconnected monodose pharmaceutical vials is configured to form an expanded configuration and configured to form a folded configuration.

164. The multi-monodose container of paragraph 163, wherein the expanded configuration has a first rectangular packing cross-sectional area and the folded configuration has a second rectangular packing cross-sectional area, the second rectangular packing cross-sectional area smaller than the first rectangular packing cross-sectional.

165. The multi-monodose container of paragraph 139, wherein the textured surface pattern positioned to direct gas flow between the first portion of the molded structure and the region adjacent to the second portion of the molded structure comprises a debossed surface pattern positioned to direct gas flow between the first portion of the molded structure and the region adjacent to the second portion of the molded structure.

166. The multi-monodose container of paragraph 139, wherein the textured surface pattern positioned to direct gas flow between the first portion of the molded structure and the region adjacent to the second portion of the molded structure comprises an embossed surface pattern positioned to direct gas flow between the first portion of the molded structure and the region adjacent to the second portion of the molded structure.

167. The multi-monodose container of paragraph 139, wherein at least a portion of the textured surface pattern includes channels aligned parallel to the directed gas flow between the first portion of the molded structure and the region adjacent to the second portion of the molded structure.

168. The multi-monodose container of paragraph 139, wherein the textured surface pattern is on an outer surface of at least one of the interconnected monodose pharmaceutical vials.

169. The multi-monodose container of paragraph 139, wherein the textured surface pattern is on a surface of the molded structure adjacent to the row of interconnected monodose pharmaceutical vials.

170. The multi-monodose container of paragraph 139, wherein the textured surface pattern is on a tab portion adjacent to a top portion of the row of interconnected monodose pharmaceutical vials.

171. The multi-monodose container of paragraph 139, wherein the textured surface pattern is on a tab portion adjacent to a bottom portion of the row of interconnected pharmaceutical vials.

172. The multi-monodose container of paragraph 139, further comprising at least one label on the molded structure, the at least one label including at least one sensor.

173. The multi-monodose container of paragraph 172, wherein the at least one sensor includes at least one temperature sensor.

174. The multi-monodose container of paragraph 172, wherein the at least one sensor includes at least one of a light sensor or an oxygen sensor.

175. The multi-monodose container of paragraph 139, wherein each of the interconnected monodose pharmaceutical vials includes a label including at least one of a temperature sensor, a moisture sensor, a light sensor, or an oxygen sensor.

176. A method of packaging a foldable container, comprising covering a multi-monodose container in an expanded configuration with a hermetically-sealable overwrap, the multi-monodose container including a row of interconnected monodose pharmaceutical vials, each of the monodose pharmaceutical vials enclosing a dose of at least one pharmaceutical agent; and one or more articulating joints connecting each of the monodose pharmaceutical vials in the row of interconnected monodose pharmaceutical vials to at least one adjacent monodose pharmaceutical vial, the one or more articulating joints sufficiently flexible to reversibly mate a planar outer surface of each of the monodose pharmaceutical vials with a planar outer surface of the at least one adjacent monodose pharmaceutical vial to form a folded configuration of the multi-monodose container; exerting a force on at least one of the monodose pharmaceutical vials in the row of interconnected monodose pharmaceutical vials, the exerted force directed toward the at least one adjacent monodose pharmaceutical vial; bending the one or more articulating joints to form the folded configuration of the multi-monodose container in response to exerting the force on the at least one of the monodose pharmaceutical vials in the row of interconnected monodose pharmaceutical vials; and sealing the hermetically-sealable overwrap to form a hermetic seal around the folded configuration of the multi-monodose container therein.

177. The method of paragraph 176, wherein covering the multi-monodose container in an expanded configuration with the hermetically-sealable overwrap comprises inserting the multi-monodose container in an expanded configuration through an opening defined by the hermetically-sealable overwrap.

178. The method of paragraph 176, wherein covering the multi-monodose container in an expanded configuration with the hermetically-sealable overwrap comprises positioning the multi-monodose container in an expanded configuration between a first layer of hermetically-sealable overwrap and a second layer of hermetically-sealable overwrap; and sealing together one or more edges of the first layer and the second layer of the hermetically-sealable overwrap.

179. The method of paragraph 176, wherein covering the multi-monodose container in an expanded configuration with the hermetically-sealable overwrap comprises covering the multi-monodose container in an expanded configuration with a hermetically-sealable pouch.

180. The method of paragraph 176, wherein covering the multi-monodose container in an expanded configuration with the hermetically-sealable overwrap comprises covering the multi-monodose container in an expanded configuration with a hermetically-sealable sleeve.

181. The method of paragraph 176, wherein covering the multi-monodose container in an expanded configuration with the hermetically-sealable overwrap comprises covering the multi-monodose container in an expanded configuration with a hermetically-sealable foil laminate.

182. The method of paragraph 176, wherein covering the multi-monodose container in an expanded configuration with the hermetically-sealable overwrap comprises covering the multi-monodose container in an expanded configuration with a hermetically-sealable overwrap formed from at least one of polyester, foil, polypropylene, cast polypropylene, polyethylene, high-density polyethylene, metallocene polyethylene, linear low density polyethylene, or metalized film.

183. The method of paragraph 176, wherein covering the multi-monodose container in an expanded configuration with the hermetically-sealable overwrap comprises covering the multi-monodose container in an expanded configuration with a gas-impermeable overwrap.

184. The method of paragraph 176, wherein covering the multi-monodose container in an expanded configuration with the hermetically-sealable overwrap comprises covering the multi-monodose container in an expanded configuration with a vapor-impermeable overwrap.

185. The method of paragraph 176, wherein covering the multi-monodose container in an expanded configuration with the hermetically-sealable overwrap comprises covering the multi-monodose container in an expanded configuration with a light-impermeable overwrap.

186. The method of paragraph 176, wherein covering the multi-monodose container in an expanded configuration with the hermetically-sealable overwrap comprises covering the multi-monodose container in an expanded configuration with an electrostatic discharge-protective overwrap.

187. The method of paragraph 176, wherein the multi-monodose container is formed by a blow-fill-seal manufacturing process.

188. The method of paragraph 176, wherein the multi-monodose container is formed from at least one biocompatible thermoplastic material.

189. The method of paragraph 176, wherein the row of interconnected monodose pharmaceutical vials comprises: a row of two or more interconnected monodose pharmaceutical vials.

190. The method of paragraph 176, wherein each of the monodose pharmaceutical vials is square, triangular, hexagonal, or polygonal in horizontal cross-section.

191. The method of paragraph 176, wherein the dose of the at least one pharmaceutical agent comprises: a dose of at least one vaccine.

192. The method of paragraph 176, wherein the dose of the at least one pharmaceutical agent comprises: a dose of at least one therapeutic agent.

193. The method of paragraph 176, wherein the dose of the at least one pharmaceutical agent is in liquid form.

194. The method of paragraph 176, wherein the dose of the at least one pharmaceutical agent is in lyophilized form.

195. The method of paragraph 176, wherein each of the monodose pharmaceutical vials in the row of monodose pharmaceutical vials includes an internal volume holding the dose of the at least one pharmaceutical agent.

196. The method of paragraph 195, wherein the internal volume holding the dose of the at least one pharmaceutical agent includes an inert gas-filled head space.

197. The method of paragraph 176, wherein each of the monodose pharmaceutical vials in the row of interconnected monodose pharmaceutical vials includes a needle-penetrable access portion.

198. The method of paragraph 176, wherein the articulating joint is frangible.

199. The method of paragraph 176, wherein the expanded configuration of the multi-monodose container has a first rectangular packing cross-sectional area and the folded configuration of the multi-monodose container has a second rectangular packing cross-sectional area, the second rectangular packing cross-sectional area smaller than the first rectangular packing cross-sectional area.

200. The method of paragraph 176, wherein the multi-monodose container includes at least one label including at least one sensor.

201. The method of paragraph 176, wherein each of the monodose pharmaceutical vials in the row of interconnected monodose pharmaceutical vials includes a label including at least one of a temperature sensor, a moisture sensor, a light sensor, or an oxygen sensor.

202. The method of paragraph 176, wherein exerting the force on the at least one of the monodose pharmaceutical vials in the row of interconnected monodose pharmaceutical vials comprises exerting the force on the at least one of the monodose pharmaceutical vials in the row of interconnected monodose pharmaceutical vials with at least one mechanical probe.

203. The method of paragraph 176, wherein exerting the force on the at least one of the monodose pharmaceutical vials in the row of interconnected monodose pharmaceutical vials comprises exerting the force on the at least one of the monodose pharmaceutical vials in the row of interconnected monodose pharmaceutical vials with pressurized gas.

204. The method of paragraph 176, wherein exerting the force on the at least one of the monodose pharmaceutical vials in the row of interconnected monodose pharmaceutical vials comprises exerting a force on a first monodose pharmaceutical vial at a first end of the row of interconnected monodose pharmaceutical vials towards a first adjacent monodose pharmaceutical vial and exerting a force on a second monodose pharmaceutical vial at a second end of the row of interconnected monodose pharmaceutical vials toward a second adjacent monodose pharmaceutical vial.

205. The method of paragraph 204, further comprising simultaneously exerting the force on the first monodose pharmaceutical vial at the first end of the row of monodose pharmaceutical vials towards the first adjacent monodose pharmaceutical vial and exerting the force on the second monodose pharmaceutical vial at the second end of the row of monodose pharmaceutical vials toward a second adjacent monodose pharmaceutical vial.

206. The method of paragraph 204, further comprising sequentially exerting the force on the first monodose pharmaceutical vial at the first end of the row of monodose pharmaceutical vials towards the first adjacent monodose pharmaceutical vial and exerting the force on the second monodose pharmaceutical vial at the second end of the row of monodose pharmaceutical vials toward a second adjacent monodose pharmaceutical vial.

207. The method of paragraph 176, further comprising sealing at least a portion of the hermetically-sealable overwrap to form a pouch around the folded configuration of the multi-monodose container; injecting an inert gas into the formed pouch around the folded configuration of the multi-monodose container; evacuating at least a portion of the injected inert gas from the formed pouch around the folded configuration of the multi-monodose container; and sealing the formed pouch to form a hermetic seal around the folded configuration of the multi-monodose container therein.

208. The method of paragraph 176, comprising evacuating at least a portion of air from around the folded configuration of the multi-monodose container covered by the hermetically-sealable overwrap; and sealing the hermetically-sealable overwrap to form a hermetic seal around the folded configuration of the multi-monodose container therein.

209. The method of paragraph 208, wherein evacuating the at least a portion of the air from around the folded configuration of the multi-monodose container covered by the hermetically-sealable overwrap comprises inserting a flow conduit connected to a vacuum source into an opening defined by the hermetically-sealable overwrap; pressure sealing a portion of the hermetically-sealable overwrap around the inserted flow conduit to form a pocket around the folded configuration of the multi-monodose container; and evacuating the at least a portion of the air from the pocket around the folded configuration of the multi-monodose container.

210. The method of paragraph 176, comprising injecting an inert gas around the folded configuration of the multi-monodose container covered by the hermetically-sealable overwrap; and evacuating at least a portion of the injected inert gas from around the folded configuration of the multi-monodose container covered by the hermetically-sealable overwrap.

211. The method of paragraph 210, wherein evacuating the at least a portion of the injected inert gas from around the folded configuration of the multi-monodose container covered by the hermetically-sealable overwrap comprises inserting a flow conduit connected to a vacuum source into an opening defined by the hermetically-sealable overwrap; pressure sealing a portion of the hermetically-sealable overwrap around the inserted flow conduit to form a pocket around the folded configuration of the multi-monodose container; and evacuating the at least a portion of the injected inert gas from the pocket around the folded configuration of the multi-monodose container.

212. The method of paragraph 210, wherein injecting an inert gas around the folded configuration of the multi-monodose container covered by the hermetically-sealable overwrap comprises injecting nitrogen around the folded configuration of the multi-monodose container covered by the hermetically-sealable overwrap.

213. The method of paragraph 210, wherein injecting an inert gas around the folded configuration of the multi-monodose container covered by the hermetically-sealable overwrap comprises injecting a noble gas around the folded configuration of the multi-monodose container covered by the hermetically-sealable overwrap.

214. The method of paragraph 210, comprising evacuating at least a portion of air from around the folded configuration of the multi-monodose container covered by the hermetically-sealable overwrap prior to injecting the inert gas around the folded configuration of the multi-monodose container.

215. The method of paragraph 176, wherein sealing the hermetically-sealable overwrap to form the hermetic seal around the folded configuration of the multi-monodose container therein comprises heat-sealing the hermetically-sealable overwrap to form the hermetic seal around the folded configuration of the multi-monodose container therein.

216. The method of paragraph 176, wherein sealing the hermetically-sealable overwrap to form the hermetic seal around the folded configuration of the multi-monodose container therein comprises pressure-sealing the hermetically-sealable overwrap to form the hermetic seal around the folded configuration of the multi-monodose container therein.

217. The method of paragraph 176, wherein sealing the hermetically-sealable overwrap to form a hermetic seal around the folded configuration of the multi-monodose container therein comprises chemically-sealing the hermetically-sealable overwrap to form a hermetic seal around the folded configuration of the multi-monodose container therein.

218. The method of paragraph 176, further comprising attaching at least one label to an outer surface of the hermetically-sealable overwrap, the at least one label including at least one sensor.

219. The method of paragraph 176, further comprising attaching at least one label to an outer surface of the hermetically-sealable overwrap, the at least one label including at least one temperature sensor.

220. A method of packaging a multi-monodose container, comprising covering the multi-monodose container with a hermetically-sealable overwrap, the multi-monodose container including a row of interconnected monodose pharmaceutical vials, each of the monodose pharmaceutical vials enclosing a dose of at least one pharmaceutical agent; and one or more articulating joints connecting each of the monodose pharmaceutical vials in the row of interconnected monodose pharmaceutical vials to at least one adjacent monodose pharmaceutical vial, the one or more articulating joints sufficiently flexible to reversibly mate a planar outer surface of each of the monodose pharmaceutical vials with a planar outer surface of the at least one adjacent monodose pharmaceutical vial to form a folded configuration of the multi-monodose container; exerting a force on at least a portion of an external surface of the hermetically-sealable overwrap covering the multi-monodose container, the exerted force directed toward the one or more articulating joints of the multi-monodose container; evacuating at least a portion of air from around the multi-monodose container covered by the hermetically-sealable overwrap; and sealing the hermetically-sealable overwrap covering the multi-monodose container to hermetically seal the multi-monodose container therein.

221. The method of paragraph 220, wherein covering the multi-monodose container with the hermetically-sealable overwrap comprises inserting the multi-monodose container through an opening defined by the hermetically-sealable overwrap.

222. The method of paragraph 220, wherein covering the multi-monodose container with the hermetically-sealable overwrap comprises positioning the multi-monodose container between a first layer of hermetically-sealable overwrap and a second layer of hermetically-sealable overwrap; and sealing together one or more edges of the first layer and the second layer of the hermetically-sealable overwrap.

223. The method of paragraph 220, wherein covering the multi-monodose container with the hermetically-sealable overwrap comprises covering the multi-monodose container with a hermetically-sealable pouch.

224. The method of paragraph 220, wherein covering the multi-monodose container with the hermetically-sealable overwrap comprises covering the multi-monodose container with a hermetically-sealable sleeve.

225. The method of paragraph 220, wherein covering the multi-monodose container with the hermetically-sealable overwrap comprises covering the multi-monodose container with a hermetically-sealable foil laminate.

226. The method of paragraph 220, wherein covering the multi-monodose container with the hermetically-sealable overwrap comprises covering the multi-monodose container with a hermetically-sealable overwrap formed from at least one of polyester, foil, polypropylene, cast polypropylene, polyethylene, high-density polyethylene, metallocene polyethylene, linear low density polyethylene, or metalized film.

227. The method of paragraph 220, wherein covering the multi-monodose container in an expanded configuration with the hermetically-sealable overwrap comprises covering the multi-monodose container in an expanded configuration with a gas-impermeable overwrap.

228. The method of paragraph 220, wherein covering the multi-monodose container with the hermetically-sealable overwrap comprises covering the multi-monodose container with a vapor-impermeable overwrap.

229. The method of paragraph 220, wherein covering the multi-monodose container with the hermetically-sealable overwrap comprises covering the multi-monodose container with a light-impermeable overwrap.

230. The method of paragraph 220, wherein covering the multi-monodose container with the hermetically-sealable overwrap comprises covering the multi-monodose container with an electrostatic discharge-protective overwrap.

231. The method of paragraph 220, wherein the multi-monodose container is formed by a blow-fill-seal manufacturing process.

232. The method of paragraph 220, wherein the multi-monodose container is formed from at least one biocompatible thermoplastic material.

233. The method of paragraph 220, wherein the row of interconnected monodose pharmaceutical vials comprises a row of two or more monodose pharmaceutical vials.

234. The method of paragraph 220, wherein each of the monodose pharmaceutical vials in the row of interconnected monodose pharmaceutical vials is square, triangular, hexagonal, or polygonal in horizontal cross-section.

235. The method of paragraph 220, wherein the dose of the at least one pharmaceutical agent comprises a dose of at least one vaccine.

236. The method of paragraph 220, wherein the dose of the at least one pharmaceutical agent comprises a dose of at least one therapeutic agent.

237. The method of paragraph 220, wherein the dose of the at least one pharmaceutical agent is in liquid form.

238. The method of paragraph 220, wherein the dose of the at least one pharmaceutical agent is in lyophilized form.

239. The method of paragraph 220, wherein each of the monodose pharmaceutical vials in the row of interconnected monodose pharmaceutical vials comprises an internal volume holding the dose of the at least one pharmaceutical agent.

240. The method of paragraph 239, wherein the internal volume holding the dose of the at least one pharmaceutical agent includes an inert gas-filled head space.

241. The method of paragraph 220, wherein each of the monodose pharmaceutical vials in the row of interconnected monodose pharmaceutical vials includes a needle-penetrable access portion.

242. The method of paragraph 220, wherein the multi-monodose container includes at least one label including at least one sensor.

243. The method of paragraph 220, wherein each of the monodose pharmaceutical vials in the row of interconnected monodose pharmaceutical vials includes a label including at least one of a temperature sensor, a moisture sensor, a light sensor, or an oxygen sensor.

244. The method of paragraph 220, wherein exerting the force on the at least a portion of the external surface of the hermetically-sealable overwrap covering the multi-monodose container comprises exerting the force on the at least a portion of the external surface of the hermetically-sealable overwrap covering the multi-monodose container with one or more mechanical probes.

245. The method of paragraph 220, wherein exerting the force on the at least a portion of the external surface of the hermetically-sealable overwrap covering the multi-monodose container comprises exerting the force on the at least a portion of the external surface of the hermetically-sealable overwrap covering the multi-monodose container with pressurized gas.

246. The method of paragraph 220, wherein evacuating the at least a portion of the air from around the multi-monodose container covered by the hermetically-sealable overwrap comprises inserting a flow conduit connected to a vacuum source into an opening defined by the hermetically-sealable overwrap; pressure sealing a portion of the hermetically-sealable overwrap around the inserted flow conduit to form a pocket around the multi-monodose container; and evacuating the at least a portion of the air from the pocket around the multi-monodose container.

247. The method of paragraph 220, further comprising injecting an inert gas around the multi-monodose container covered by the hermetically-sealable overwrap; and evacuating at least a portion of the injected inert gas from around the multi-monodose container covered by the hermetically-sealable overwrap.

248. The method of paragraph 247, wherein injecting the inert gas around the multi-monodose container covered by the hermetically-sealable overwrap comprises injecting nitrogen around the multi-monodose container covered by the hermetically-sealable overwrap.

249. The method of paragraph 247, wherein injecting the inert gas around the multi-monodose container covered by the hermetically-sealable overwrap comprises injecting a noble gas around the multi-monodose container covered by the hermetically-sealable overwrap.

250. The method of paragraph 247, further comprising evacuating the at least a portion of the air from around the multi-monodose container covered by the hermetically-sealable overwrap prior to injecting the inert gas into the hermetically-sealable overwrap.

251. The method of paragraph 220, wherein sealing the hermetically-sealable overwrap covering the multi-monodose container to hermetically seal the multi-monodose container therein comprises sealing a first layer of hermetically-sealable overwrap to a second layer of hermetically-sealable overwrap to hermetically seal the multi-monodose container therein.

252. The method of paragraph 220, wherein sealing the hermetically-sealable overwrap covering the multi-monodose container to hermetically seal the multi-monodose container therein comprises bonding at least a portion of the hermetically-sealable overwrap covering the multi-monodose container to at least a portion of a surface of the multi-monodose container to hermetically seal the multi-monodose container therein.

253. The method of paragraph 252, wherein bonding the at least a portion of the hermetically-sealable overwrap covering the multi-monodose container to the at least a portion of the surface of the multi-monodose container to hermetically seal the multi-monodose container therein comprises bonding at least a portion of the hermetically-sealable overwrap covering the multi-monodose container to at least a portion of a surface of the multi-monodose container associated with the one or more articulating joints to hermetically seal the multi-monodose container therein.

254. The method of paragraph 252, wherein bonding the at least a portion of the hermetically-sealable overwrap to the at least a portion of the surface of the multi-monodose container therein comprises bonding at least a portion of the hermetically-sealable overwrap covering the multi-monodose container to at least a portion of a surface of the multi-monodose container around and between each of the monodose pharmaceutical vials in the row of interconnected monodose pharmaceutical vials.

255. The method of paragraph 220, wherein sealing the hermetically-sealable overwrap covering the multi-monodose container to hermetically seal the multi-monodose container therein comprises heat-sealing the hermetically-sealable overwrap covering the multi-monodose container to hermetically seal the multi-monodose container therein.

256. The method of paragraph 220, wherein sealing the hermetically-sealable overwrap covering the multi-monodose container to hermetically seal the multi-monodose container therein comprises pressure-sealing the hermetically-sealable overwrap covering the multi-monodose container to hermetically seal the multi-monodose container therein.

257. The method of paragraph 220, wherein sealing the hermetically-sealable overwrap covering the multi-monodose container to hermetically seal the multi-monodose container therein comprises chemically-sealing the hermetically-sealable overwrap covering the multi-monodose container to hermetically seal the multi-monodose container therein.

258. The method of paragraph 220, further comprising attaching at least one label to an outer surface of the hermetically-sealable overwrap, the at least one label including at least one sensor.

259. The method of paragraph 220, further comprising attaching at least one label to an outer surface of the hermetically-sealable overwrap, the at least one label including at least one temperature sensor.

260. The method of paragraph 220, further comprising bending the hermetically sealed multi-monodose container at the one or more articulating joints of the multi-monodose container to form a folded configuration; and adding a tertiary covering to maintain the hermetically sealed multi-monodose container in the folded configuration.

261. The method of paragraph 220, comprising at least partially perforating the hermetically-sealable overwrap to add a frangible portion to the hermetically-sealable overwrap between each of the monodose pharmaceutical vials in the row of interconnected monodose pharmaceutical vials.

All of the above U.S. patents, U.S. patent application publications, U.S. patent applications, foreign patents, foreign patent applications and non-patent publications referred to in this specification and/or listed in any Application Data Sheet, are incorporated herein by reference, to the extent not inconsistent herewith.

While various aspects and embodiments have been disclosed herein, other aspects and embodiments will be apparent to those skilled in the art. The various aspects and embodiments disclosed herein are for purposes of illustration and are not intended to be limiting, with the true scope and spirit being indicated by the following claims.

The invention claimed is:

1. A method of packaging a foldable container, comprising:

covering a multi-monodose container in an expanded configuration with a hermetically-sealable overwrap, the multi-monodose container including a row of interconnected monodose pharmaceutical vials, each of the monodose pharmaceutical vials polygonal in horizontal cross-section and enclosing a dose of at least one pharmaceutical agent; and one or more articulating joints connecting each of the monodose pharmaceutical vials in the row of interconnected monodose pharmaceutical vials to at least one adjacent monodose pharmaceutical vial, the one or more articulating joints sufficiently flexible to reversibly mate a planar outer surface of each of the monodose pharmaceutical vials with a planar outer surface of the at least one adjacent monodose pharmaceutical vial to form a folded configuration of the multi-monodose container, wherein the expanded configuration of the multi-monodose container has a first rectangular packing cross-sectional area;

exerting a force on at least one of the monodose pharmaceutical vials in the row of interconnected monodose pharmaceutical vials, the exerted force directed toward the at least one adjacent monodose pharmaceutical vial;

bending the one or more articulating joints to form the folded configuration of the multi-monodose container in response to exerting the force on the at least one of the monodose pharmaceutical vials in the row of interconnected monodose pharmaceutical vials, wherein the folded configuration of the multi-monodose container has a second rectangular packing cross-sectional area that is smaller than the first rectangular packing cross-sectional area of the expanded configuration; and sealing the hermetically-sealable overwrap to form a hermetic seal around the folded configuration of the multi-monodose container therein.

2. The method of claim 1, wherein covering the multi-monodose container in an expanded configuration with the hermetically-sealable overwrap comprises:

inserting the multi-monodose container in an expanded configuration through an opening defined by the hermetically-sealable overwrap.

3. The method of claim 1, wherein covering the multi-monodose container in an expanded configuration with the hermetically-sealable overwrap comprises:

positioning the multi-monodose container in an expanded configuration between a first layer of hermetically-sealable overwrap and a second layer of hermetically-sealable overwrap; and sealing together one or more edges of the first layer and the second layer of the hermetically-sealable overwrap.

4. The method of claim 1, wherein covering the multi-monodose container in an expanded configuration with the hermetically-sealable overwrap comprises:

covering the multi-monodose container in an expanded configuration with a hermetically-sealable foil laminate.

5. The method of claim 1, wherein covering the multi-monodose container in an expanded configuration with the hermetically-sealable overwrap comprises:

covering the multi-monodose container in an expanded configuration with at least one of a gas-impermeable overwrap, a vapor-impermeable overwrap, or a light-impermeable overwrap.

6. The method of claim 1, wherein covering the multi-monodose container in an expanded configuration with the hermetically-sealable overwrap comprises:

covering the multi-monodose container in an expanded configuration with an electrostatic discharge-protective overwrap.

7. The method of claim 1, wherein the multi-monodose container is formed by a blow-fill-seal manufacturing process.

8. The method of claim 1, wherein the dose of the at least one pharmaceutical agent comprises:

a dose of at least one vaccine.

9. The method of claim 1, wherein the articulating joint is frangible.

10. The method of claim 1, wherein exerting the force on the at least one of the monodose pharmaceutical vials in the row of interconnected monodose pharmaceutical vials comprises:

exerting the force on the at least one of the monodose pharmaceutical vials in the row of interconnected monodose pharmaceutical vials with at least one mechanical probe.

11. The method of claim 1, wherein exerting the force on the at least one of the monodose pharmaceutical vials in the row of interconnected monodose pharmaceutical vials comprises:

exerting the force on the at least one of the monodose pharmaceutical vials in the row of interconnected monodose pharmaceutical vials with pressurized gas.

12. The method of claim 1, wherein exerting the force on the at least one of the monodose pharmaceutical vials in the row of interconnected monodose pharmaceutical vials comprises:

exerting a force on a first monodose pharmaceutical vial at a first end of the row of interconnected monodose pharmaceutical vials towards a first adjacent monodose pharmaceutical vial and exerting a force on a second monodose pharmaceutical vial at a second end of the row of interconnected monodose pharmaceutical vials toward a second adjacent monodose pharmaceutical vial.

13. The method of claim 12, further comprising simultaneously exerting the force on the first monodose pharmaceutical vial at the first end of the row of monodose pharmaceutical vials towards the first adjacent monodose pharmaceutical vial and exerting the force on the second monodose pharmaceutical vial at the second end of the row of monodose pharmaceutical vials toward a second adjacent monodose pharmaceutical vial.

14. The method of claim 12, further comprising sequentially exerting the force on the first monodose pharmaceutical vial at the first end of the row of monodose pharmaceutical vials towards the first adjacent monodose pharmaceutical vial and exerting the force on the second monodose pharmaceutical vial at the second end of the row of monodose pharmaceutical vials toward a second adjacent monodose pharmaceutical vial.

15. The method of claim 1, comprising:

evacuating at least a portion of air from around the folded configuration of the multi-monodose container covered by the hermetically-sealable overwrap; and sealing the hermetically-sealable overwrap to form a hermetic seal around the folded configuration of the multi-monodose container therein.

16. The method of claim 15, wherein evacuating the at least a portion of the air from around the folded configuration of the multi-monodose container covered by the hermetically-sealable overwrap comprises:

inserting a flow conduit connected to a vacuum source into an opening defined by the hermetically-sealable overwrap;

pressure sealing a portion of the hermetically-sealable overwrap around the inserted flow conduit to form a pocket around the folded configuration of the multi-monodose container; and evacuating the at least a portion of the air from the pocket around the folded configuration of the multi-monodose container.

17. The method of claim 1, comprising:

injecting an inert gas around the folded configuration of the multi-monodose container covered by the hermetically-sealable overwrap; and evacuating at least a portion of the injected inert gas from around the folded configuration of the multi-monodose container covered by the hermetically-sealable overwrap.

18. The method of claim 17, wherein evacuating the at least a portion of the injected inert gas from around the folded configuration of the multi-monodose container covered by the hermetically-sealable overwrap comprises:

inserting a flow conduit connected to a vacuum source into an opening defined by the hermetically-sealable overwrap;

pressure sealing a portion of the hermetically-sealable overwrap around the inserted flow conduit to form a pocket around the folded configuration of the multi-monodose container; and evacuating the at least a portion of the injected inert gas from the pocket around the folded configuration of the multi-monodose container.

19. The method of claim 17, further comprising:

evacuating at least a portion of air from around the folded configuration of the multi-monodose container covered by the hermetically-sealable overwrap prior to injecting the inert gas around the folded configuration of the multi-monodose container.

20. The method of claim 1, wherein sealing the hermetically-sealable overwrap to form the hermetic seal around the folded configuration of the multi-monodose container therein comprises:

at least one of heat-sealing, pressure-sealing, or chemically sealing the hermetically-sealable overwrap to form the hermetic seal around the folded configuration of the multi-monodose container therein.

21. The method of claim 1, further comprising:

attaching at least one label to an outer surface of the hermetically-sealable overwrap, the at least one label including at least one sensor.

22. A method of packaging a multi-monodose container, comprising:

covering the multi-monodose container with a hermetically-sealable overwrap, the multi-monodose container including a row of interconnected monodose pharmaceutical vials, each of the monodose pharmaceutical vials polygonal in horizontal cross-section and enclosing a dose of at least one pharmaceutical agent; and one or more articulating joints connecting each of the monodose pharmaceutical vials in the row of interconnected monodose pharmaceutical vials to at least one adjacent monodose pharmaceutical vial, the one or more articulating joints sufficiently flexible to reversibly mate a planar outer surface of each of the monodose pharmaceutical vials with a planar outer surface of the at least one adjacent monodose pharmaceutical vial to form a folded configuration of the multi-monodose container;

exerting a force on at least a portion of an external surface of the hermetically-sealable overwrap covering the multi-monodose container, the exerted force directed toward the one or more articulating joints of the multi-monodose container;

evacuating at least a portion of air from around the multi-monodose container covered by the hermetically-sealable overwrap; and sealing the hermetically-sealable overwrap covering the multi-monodose container to hermetically seal the multi-monodose container therein.

23. The method of claim 22, wherein covering the multi-monodose container with the hermetically-sealable overwrap comprises:

inserting the multi-monodose container through an opening defined by the hermetically-sealable overwrap.

24. The method of claim 22, wherein covering the multi-monodose container with the hermetically-sealable overwrap comprises:

positioning the multi-monodose container between a first layer of hermetically-sealable overwrap and a second layer of hermetically-sealable overwrap; and sealing together one or more edges of the first layer and the second layer of the hermetically-sealable overwrap.

25. The method of claim 22, wherein covering the multi-monodose container with the hermetically-sealable overwrap comprises:

covering the multi-monodose container with a hermetically-sealable foil laminate.

26. The method of claim 22, wherein covering the multi-monodose container with the hermetically-sealable overwrap comprises:

covering the multi-monodose container with at least one of a gas-impermeable overwrap, a vapor-impermeable overwrap, or a light-impermeable overwrap.

27. The method of claim 22, wherein covering the multi-monodose container with the hermetically-sealable overwrap comprises:

covering the multi-monodose container with an electrostatic discharge-protective overwrap.

28. The method of claim 22, wherein the multi-monodose container is formed by a blow-fill-seal manufacturing process.

29. The method of claim 22, wherein the dose of the at least one pharmaceutical agent comprises a dose of at least one vaccine.

30. The method of claim 22, wherein exerting the force on the at least a portion of the external surface of the hermetically-sealable overwrap covering the multi-monodose container comprises:

exerting the force on the at least a portion of the external surface of the hermetically-sealable overwrap covering the multi-monodose container with pressurized gas.

31. The method of claim 22, wherein evacuating the at least a portion of the air from around the multi-monodose container covered by the hermetically-sealable overwrap comprises:

inserting a flow conduit connected to a vacuum source into an opening defined by the hermetically-sealable overwrap;

pressure sealing a portion of the hermetically-sealable overwrap around the inserted flow conduit to form a pocket around the multi-monodose container; and evacuating the at least a portion of the air from the pocket around the multi-monodose container.

32. The method of claim 22, further comprising:

injecting an inert gas around the multi-monodose container covered by the hermetically-sealable overwrap; and evacuating at least a portion of the injected inert gas from around the multi-monodose container covered by the hermetically-sealable overwrap.

33. The method of claim 32, further comprising:

evacuating the at least a portion of the air from around the multi-monodose container covered by the hermetically-sealable overwrap prior to injecting the inert gas into the hermetically-sealable overwrap.

34. The method of claim 22, wherein exerting the force on the at least a portion of the external surface of the hermetically-sealable overwrap covering the multi-monodose container comprises:

exerting the force on the at least a portion of the external surface of the hermetically-sealable overwrap covering the multi-monodose container with one or more mechanical probes.

35. The method of claim 22, wherein sealing the hermetically-sealable overwrap covering the multi-monodose container to hermetically seal the multi-monodose container therein comprises:

sealing a first layer of hermetically-sealable overwrap to a second layer of hermetically-sealable overwrap to hermetically seal the multi-monodose container therein.

36. The method of claim 22, wherein sealing the hermetically-sealable overwrap covering the multi-monodose container to hermetically seal the multi-monodose container therein comprises:

bonding at least a portion of the hermetically-sealable overwrap covering the multi-monodose container to at least a portion of a surface of the multi-monodose container to hermetically seal the multi-monodose container therein.

37. The method of claim 36, wherein bonding the at least a portion of the hermetically-sealable overwrap covering the multi-monodose container to the at least a portion of the surface of the multi-monodose container to hermetically seal the multi-monodose container therein comprises:

bonding at least a portion of the hermetically-sealable overwrap covering the multi-monodose container to at least a portion of a surface of the multi-monodose container associated with the one or more articulating joints to hermetically seal the multi-monodose container therein.

38. The method of claim 36, wherein bonding the at least a portion of the hermetically-sealable overwrap to the at least a portion of the surface of the multi-monodose container therein comprises:

bonding at least a portion of the hermetically-sealable overwrap covering the multi-monodose container to at least a portion of a surface of the multi-monodose container around and between each of the monodose pharmaceutical vials in the row of interconnected monodose pharmaceutical vials.

39. The method of claim 22, wherein sealing the hermetically-sealable overwrap covering the multi-monodose container to hermetically seal the multi-monodose container therein comprises:

at least one of heat-sealing, pressure-sealing, or chemically sealing the hermetically-sealable overwrap covering the multi-monodose container to hermetically seal the multi-monodose container therein.

40. The method of claim 22, further comprising:

attaching at least one label to an outer surface of the hermetically-sealable overwrap, the at least one label including at least one sensor.

41. The method of claim 22, further comprising:

bending the hermetically sealed multi-monodose container at the one or more articulating joints of the multi-monodose container to form the folded configuration; and adding a tertiary covering to maintain the hermetically sealed multi-monodose container in the folded configuration.

42. The method of claim 22, comprising:

at least partially perforating the hermetically-sealable overwrap to add a frangible portion to the hermetically-sealable overwrap between each of the monodose pharmaceutical vials in the row of interconnected monodose pharmaceutical vials.

* * * * *